US012635792B2

(12) United States Patent
Li et al.

(10) Patent No.: US 12,635,792 B2
(45) Date of Patent: May 26, 2026

(54) FOLDABLE CABINET

(71) Applicant: Guangdong Rixin Precision Manufacturing Co., Ltd., Qingyuan (CN)

(72) Inventors: Jingong Li, Qingyuan (CN); Jianhong Li, Qingyuan (CN)

(73) Assignee: Guangdong Rixin Precision Manufacturing Co., Ltd., Qingyuan (CN)

( * ) Notice: Subject to any disclaimer, the term of this patent is extended or adjusted under 35 U.S.C. 154(b) by 79 days.

(21) Appl. No.: 18/663,214

(22) Filed: May 14, 2024

(65) Prior Publication Data

US 2025/0143455 A1 May 8, 2025

(30) Foreign Application Priority Data

Nov. 7, 2023 (CN) ..... 202311475042.6

(51) Int. Cl.

| | |
|---|---|
| ***A47B 43/00*** | (2006.01) |
| ***A47B 47/00*** | (2006.01) |
| ***A47B 47/02*** | (2006.01) |
| *A47B 47/04* | (2006.01) |

(52) U.S. Cl.

CPC ..... *A47B 43/00* (2013.01); *A47B 47/00* (2013.01); *A47B 47/0075* (2013.01); *A47B 47/02* (2013.01); *A47B 47/042* (2013.01)

(58) Field of Classification Search

CPC ..... A47B 43/00; A47B 47/02; A47B 47/0075; A47B 47/00; A47B 47/042; A47B 43/02

See application file for complete search history.

(56) References Cited

U.S. PATENT DOCUMENTS

| | | | | | |
|---|---|---|---|---|---|
| 3,061,396 | A * | 10/1962 | Hock | ..... | A47B 43/02 312/258 |
| 4,703,981 | A * | 11/1987 | Stewart | ..... | A47B 43/00 312/258 |
| 6,478,391 | B1 * | 11/2002 | Stoever | ..... | A47B 47/02 312/265.5 |

(Continued)

FOREIGN PATENT DOCUMENTS

| | | | | | |
|---|---|---|---|---|---|
| CN | 105640056 | A * | 6/2016 | ..... | A47B 47/0075 |
| CN | 119055043 | A * | 12/2024 | ..... | F16C 11/04 |
| DE | 202009005189 | U1 * | 10/2010 | ..... | A47B 43/00 |

*Primary Examiner* — Kimberley S Wright

(57) ABSTRACT

A foldable cabinet has a side board comprising a side board body, a first connecting portion and a first turning portion. The back board comprises a back board body, a second turning portion and a fourth connecting portion. The first connecting portion hingedly connected with the side frame through a vertically arranged first shaft. The first turning portion is hingedly connected with the second turning portion through a vertically arranged second shaft. The fourth connecting portions of two back boards are detachably connected. In the folded state and assembled state and a transition state therebetween, an opening of the first groove of each first connecting portion and an opening of the second groove of corresponding fifth connecting portion always face different directions, and an opening of the third groove of each second connecting portion and an opening of the fourth groove of corresponding third connecting portion always face different directions.

18 Claims, 54 Drawing Sheets

(56) References Cited

U.S. PATENT DOCUMENTS

| | | | | |
|---|---|---|---|---|
| 2005/0067927 | A1* | 3/2005 | Ho | A47B 43/00 312/258 |
| 2006/0226744 | A1* | 10/2006 | Wu | A47B 43/00 312/258 |
| 2007/0210682 | A1* | 9/2007 | Wise | A47B 87/00 312/108 |
| 2008/0012455 | A1* | 1/2008 | Zheng | A47B 47/0075 312/262 |
| 2008/0122328 | A1* | 5/2008 | Hsu | A47B 47/042 312/297 |
| 2016/0331128 | A1* | 11/2016 | Chuang | A47B 96/02 |
| 2025/0146339 | A1* | 5/2025 | Li | E05D 3/02 |

* cited by examiner

FOLDABLE CABINET

CROSS-REFERENCE TO PRIOR APPLICATION

The application claims the benefit of the priority of Chinese Patent Application No. 202311475042.6 filed on Nov. 7, 2023, the contents of which are incorporated herein by reference.

TECHNICAL FIELD

The application relates to the technical field of bins, more particularly to a foldable cabinet.

BACKGROUND

The foldable cabinets in the market are usually provided with hinge leaves for connecting cabinet boards. In order to ensure the quality of a hinge connection, if only one hinge leaf can be provided, it has to be a long hinge leaf at a higher cost. In the case that more short hinge leaves are used, they need to meet the coaxial requirement, thereby resulting in higher assembly demands and affecting the production efficiency. Although standardized general-purpose components have reduced manufacturing costs, it is difficult for the products produced on a large scale to cut mounting costs and assembly costs of the general-purpose components. In addition, in order to ensure the hinge connection quality of relatively long seams of joints, usually long hinge leaves with higher costs or more sets of short hinge leaves which meet the coaxial requirement and have higher assembly demands can be used. Furthermore, both long hinge leaves and short hinge leaves need to be welded or bolted onto the cabinet panels, leading to a time-consuming and labor-intensive assembly process.

SUMMARY

The application aims to provide a foldable cabinet which simplifies the hinge structure, reduces mounting difficulty, and saves economic costs.

In order to achieve the above goal, the application provides a foldable cabinet, comprising:

a framework provided with two side frames which are oppositely disposed and vertically arranged;

panel assemblies provided into two sets, corresponding to the two side frames, respectively; wherein each set of panel assembly comprises a side board and a back board, each side board is provided with a side board body, and first connecting portions and a first turning portion which are disposed on two lateral sides thereof, each back board is provided with a back board body, and a second turning portion and a fourth connecting portion which are disposed on two lateral sides thereof, the first connecting portions are hingedly connected with the side frames through first shafts which are vertically arranged, the first turning portion is hingedly connected with the second turning portion through a vertically arranged second shaft, and the fourth connecting portions of the two back boards are detachably connected;

wherein each first connecting portion extends from a portion of the edge of respective side board body and bends to define a first groove, the first turning portion is provided with a second connecting portion bending to define a third groove, the second turning portion is provided with a third connecting portion bending to define a fourth groove, each side frame is provided with a fifth connecting portion bending to define a second groove, each first shaft is disposed to extend through the first groove of the first connecting portion and the second groove of corresponding fifth connecting portion, each second shaft is disposed to extend through the third groove of the second connecting portion and the fourth groove of corresponding third connecting portion;

when the foldable cabinet is in a folded state, the side boards, the back boards, and the framework are superposed, with the back boards being located between the side boards and the framework;

when the foldable cabinet is in an unfolded state, the side boards are located between the framework and the back boards in such a manner that the side boards are substantially perpendicular to the framework, and the sideboards are substantially perpendicular to the back boards; and throughout the folded state and the unfolded state of the foldable cabinet and a transition state therebetween, an opening of the first groove of each first connecting portion and an opening of the second groove of corresponding fifth connecting portion always face different directions, and an opening of the third groove of each second connecting portion and an opening of the fourth groove of corresponding third connecting portion always face different directions.

In some embodiments of the application:

the first connecting portion may be provided on a portion of an edge of the side board;

the side frame may be further provided with a side frame body and a first limiting portion, and the first limiting portion and the fifth connecting portion may be located behind the side frame body, a portion of the edge of the first limiting portion may extend and bend to define the fifth connecting portion;

the first turning portion may be further provided with a second limiting portion, the second connecting portion may be connected with the side board body through the second limiting portion, and a portion of an edge of the second limiting portion may extend and bend to define the second connecting portion;

the second turning portion may be further provided with a third limiting portion, the third connecting portion may be connected with the back board body through the third limiting portion, and a portion of an edge of the third limiting portion may extend and bend to define the third connecting portion; and when the foldable cabinet is in the unfolded state, a portion of an edge of the side board body may abut against the fifth connecting portion, a portion of an edge of the first limiting portion may abut against the first connecting portion, a portion of an edge of the second limiting portion may abut against the third connecting portion, and a portion of an edge of the third limiting portion may abut against the second connecting portion.

In some embodiments of the application:

the side frame may be further provided with an extending portion located behind the side frame body, and the fifth connecting portion may be connected with the extending portion via the first limiting portion.

In some embodiments of the application:

the side board body, the first connecting portion, and the first turning portion may be integrally formed; and the back board body, the second turning portion, and the fourth connecting portion may be integrally formed.

In some embodiments of the application:

the first turning portion may be further provided with a first bend, a second bend, and a first transition board, the first transition board has one end connected with the side board body via the first bend, and the other end connected with the second limiting portion via the second bend; the side board bends towards one direction at least twice, to form the side board body, the first bend, the first transition board, the second bend, and the second limiting portion;

the second turning portion may be further provided with a third bend, a fourth bend, and a second transition board, the second transition board has one end connected with the back board body via the third bend, and the other end connected with the third limiting portion via the fourth bend; the back board bends at least twice, towards different directions, to form the back board body, the third bend, the second transition board, the fourth bend, and the third limiting portion; and the second connecting portion, the third connecting portion, and the second shaft may be concealed inside the foldable cabinet by the first transition board.

In some embodiments of the application:

the second bend may be an acute angle, to allow an outer surface of the first transition board to be aligned with an outer surface of the back board body.

In some embodiments of the application:

the fifth connecting portion may be located between front and rear ends of the extending portion, and the end of the extending portion proximal to the rear side may be located at the outer side of the side board body, to limit a maximum rotation angle of the side board on the framework.

In some embodiments of the application:

when the foldable cabinet is in the unfolded state, the second bend may abut against the third bend, or, the second bend may abut against the second transition board, to limit a maximum rotation angle of the back board on the side board.

In some embodiments of the application:

when the foldable cabinet is in the unfolded state, an opening of the first groove of the first connecting portion may face backwards, the opening of the first groove of the first connecting portion may be located at the side of the side board body which faces an inner side of the foldable cabinet, the opening of the second groove of the fifth connecting portion may face an outer side of the foldable cabinet, and the opening of the second groove of the fifth connecting portion may be located in front of the first limiting portion.

In some embodiments of the application:

when the foldable cabinet is in the folded state, an opening of the first groove of the first connecting portion may face right towards an inner side of the foldable cabinet, the opening of the first groove of the first connecting portion may be located in front of the side board body, an opening of the second groove of the fifth connecting portion and the opening of the first groove of the first connecting portion may face different directions, and the opening of the second groove of the fifth connecting portion may be located in front of the first limiting portion.

In some embodiments of the application:

when the foldable cabinet is in the unfolded state, an opening of the third groove of the second connecting portion may face a direction intersecting with a front-rear direction, the opening of the third groove of the second connecting portion may be inclined towards the back board, the opening of the third groove of the second connecting portion may be located at the side of the second limiting portion facing away from the back board, an opening of the fourth groove of the third connecting portion may face a direction intersecting with the front-rear direction, the opening of the fourth groove of the third connecting portion may be inclined towards an inner side of the foldable cabinet, and the opening of the fourth groove of the third connecting portion may be located in front of the third limiting portion.

In some embodiments of the application:

when the foldable cabinet is in the folded state, an opening of the third groove of the second connecting portion may face a direction intersecting with a left-right direction, the opening of the third groove of the second connecting portion may be inclined towards the back board, the opening of the third groove of the second connecting portion may be located behind the third limiting portion, the opening of the fourth groove of the third connecting portion may face a direction intersecting with the left-right direction, an opening of the fourth groove of the third connecting portion may be inclined towards the side board, and the opening of the fourth groove of the third connecting portion may be located behind the third limiting portion.

In some embodiments of the application:

the two back boards may be respectively referred to as the first back board and the second back board, the fourth connecting portion of the first back board may be referred to as the first matching portion, the fourth connecting portion of the second back board may be referred to as the second matching portion, and the first matching portion and the second matching portion may be connected in a rotatable manner within a certain angle.

In some embodiments of the application:

the first matching portion may be provided with a slot;

the second matching portion may be provided with a tab, the tab corresponds to the slot in such a manner that the tab can be inserted in the slot and rotate a certain angle in the slot, to form a detachable connection between the first matching portion and the second matching portion; and the tab may be allowed to get in or out of the slot when planes in which the back board bodies of the first back board and the second back board lie are perpendicular to each other.

In some embodiments of the application:

the tab may be provided with a fourth limiting portion, and the fourth limiting portion may be formed by bending a portion of the tab; and when the foldable cabinet is in the unfolded state, the back board bodies of the first back board and the second back board may lie in a same plane, the fourth limiting portion may fit the first matching portion to maintain a connection state of the tab and the slot, and meanwhile limit rotation angle of the tab in the slot.

In some embodiments of the application:

the first matching portion may be further provided with a fifth limiting portion, and the fifth limiting portion may be formed by bending at least a portion of the first matching portion; and when the foldable cabinet is in the unfolded state, the back board bodies of the first back board and the second back board may lie in a same plane, and the fifth limiting portion may fit the second matching portion, to limit a rotation angle of the tab in the slot.

In some embodiments of the application, the foldable cabinet may further comprise:

a top board removably mounted on top of the framework, the side boards, and the back boards, wherein an edge of the top board is provided with a first rabbet and a second rabbet which extend along a left-right direction, the first rabbet and the second rabbet are respectively located at a rear end and a front end of the top board, a top end of the framework is inserted in the second rabbet, and a top portion of the back board is inserted in the first rabbet.

In some embodiments of the application, the foldable cabinet may further comprise:

a bottom board removeably mounted at bottom of the framework, the side boards, and the back boards; and wherein the first turning portion and the second turning portion are respectively provided with a notch, at least a portion of an edge of the bottom board is inserted in the notch, and at least a portion of the edge of the bottom board is lapped on the framework.

In some embodiments of the application, the foldable cabinet may further comprise:

a separator board removeably mounted between respective top portions and bottom portions of the framework, the side boards, and the back boards;

a dividing strip provided on the framework, between the top portion and the bottom portion of the framework, and at least a portion of an edge of the separator board is lapped on the dividing strip; and the first turning portion and the second turning portion may be respectively provided with an assembly slot, and at least a portion of an edge of the separator board may be inserted in the assembly slot.

Compared with the existing technologies, the foldable cabinet of the application has advantages as follows.

The foldable cabinet of the application provides the first connecting portion, the second connecting portion, the third connecting portion, and the fifth connecting portion on the framework, the side board, and the back board by bending, achieves hinge connections between the framework and the side boards by the first shaft extending through the first groove of the first connecting portion and the second groove of the fifth connecting portion, and hinge connections between the side boards and the back boards by the second shaft extending through the third groove of the second connecting portion and the fourth groove of the third connecting portion. Due to the bent structure in combination with long shafts, it has reduced costs and reduced subsequent mounting difficulty. Furthermore, as it only needs to additionally use long shafts as the first shafts and the second shafts instead of hinge leaves in the prior art, it simplifies the hinge structure and saves economic costs.

Figure 1:
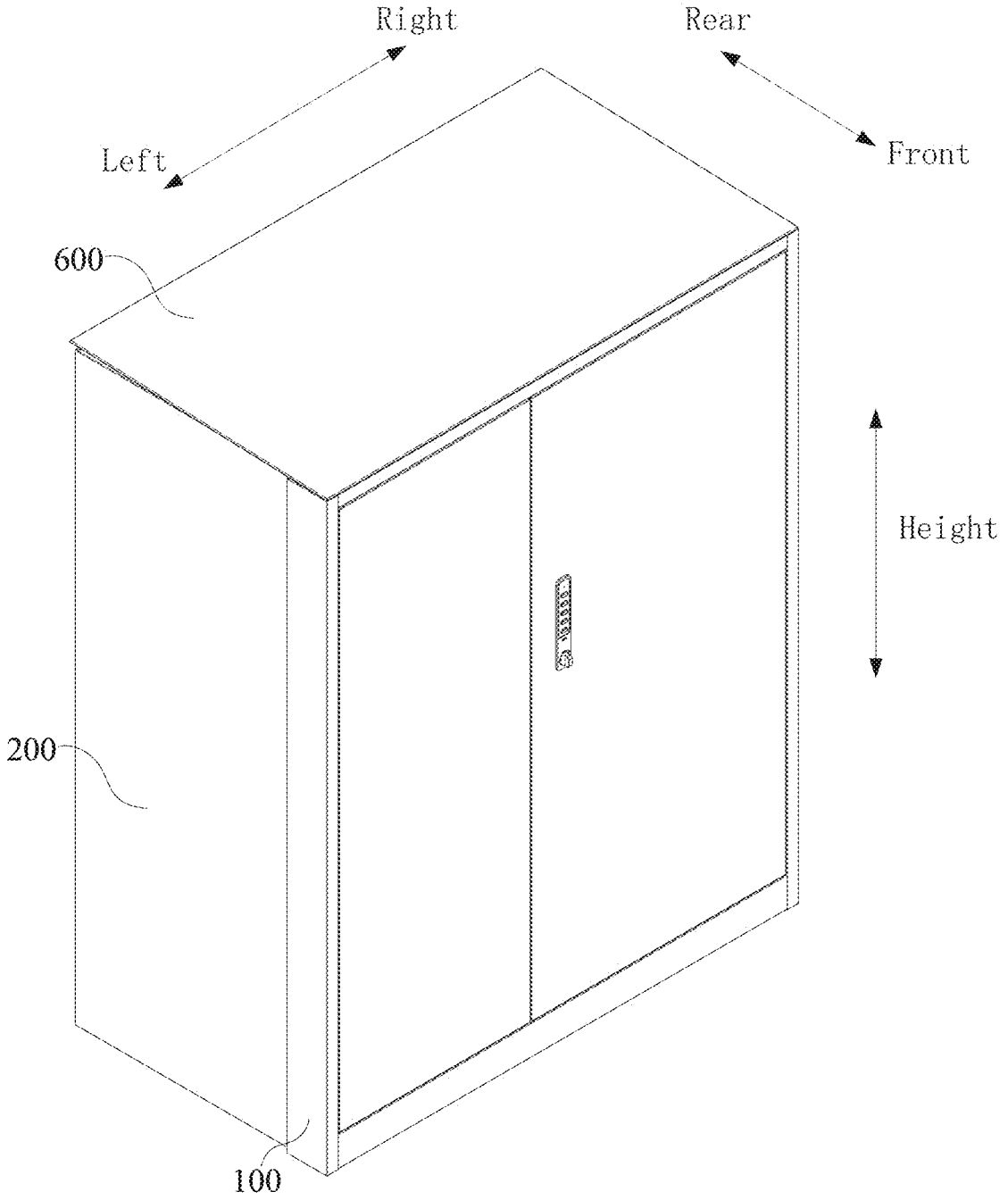
FIG. 1 is a schematic structural view of a foldable cabinet according to an embodiment of the application.

In the drawings: 100. framework; 200. side boards; 300. back boards; 400. first shafts; 500. second shafts; 600. top board; 700. bottom board; 800. separator board;

110. side frames; 120. dividing strip;

111. fifth connecting portions; 112. side frame bodies; 113. first limiting portions; 114. extending portions;

210. side board bodies; 220. first connecting portions; 230. first turning portions;

231. second connecting portions; 232. second limiting portions; 233. first bends; 234. second bends; 235. first transition boards; 236. first notches;

310. back board bodies; 320. second turning portions; 330. fourth connecting portion; 340. first back board; 350. second back board;

321. third connecting portions; 322. third limiting portions; 323. third bends; 324. fourth bends; 325. second transition boards;

331. first matching portions; 332. second matching portions; 333. second notches;

3311. slots; 3312. fifth limiting portions;

3321. tabs; 3322. fourth limiting portions;

610. first rabbet; 620. second rabbet;

710. first gap; 720. second gap.

DETAILED DESCRIPTION OF ILLUSTRATED EMBODIMENTS

The particular implementations of the application will be described below in detail in conjunction with the drawings and embodiments. The following embodiments are intended for illustration of the application and are not intended to limit the scope of the application.

It should be explained that the terms, such as "center", "longitudinal", "transverse", "upper", "lower", "front", "rear", "left", "right", "vertical", "horizontal", "top", "bottom", "inner", and "outer" as used in the description of the application, refer to orientation and position relationships as shown in the drawings for convenience of description and for the purpose of simplicity. They are not intended to indicate or hint a limitation in terms of specific orientation or configuration and operation with specific orientation to the described device or element, and should not be regarded as a limitation to the present application. Furthermore, the terms "first", "second", and "third" are used for convenience of description and are not intended to indicate or imply relative importance.

It should be explained that, unless defined or specified otherwise, the terms such as "mount", "connect" and "attach" used in the description of the present application are intended to have meanings commonly understood in a broad sense. For example, they may refer to fixedly connect, or detachably connect, or integrally connect; or mechanically connect, or electrically connect; or directly connect, or indirectly connect via an intermedium, or internally communicate between two components. The meanings of these terms used in the present application may be understood by those skilled in the art in accordance with specific conditions.

Furthermore, unless explicitly stated otherwise, "the plurality of" as used in the description of the present application refers to two or more.

The meanings of these terms used in the present application may be understood by those skilled in the art in accordance with specific conditions.

Embodiment 1

A foldable cabinet according to a preferred embodiment of the embodiments of the present application comprises a framework 100 and panel assemblies.

The framework 100 comprises two side frames 110 which are oppositely disposed and vertically arranged.

Two sets of panel assemblies are provided, corresponding to the two side frames 110, respectively. Each set of panel assembly comprises a side board 200 and a back board 300. The side board 200 is provided with a side board body 210, and first connecting portions 220 and a first turning portion 230 which are disposed on two lateral sides thereof. The back board 300 is provided with a back board body 310, and a second turning portion 320 and a fourth connecting portion 330 which are disposed on two lateral sides thereof. The first connecting portions 220 are hingedly connected with the side frame 110 through a vertically arranged first shaft 400. The first turning portion 230 is hingedly connected with the second turning portion 320 through a vertically arranged second shaft 500. The fourth connecting portions 330 of the two back boards 300 are detachably connected.

Please referring to FIG. 1, the vertical direction in the embodiment refers to the height direction of the foldable cabinet, which is the up-down direction of the foldable cabinet in the use state of the foldable cabinet, i.e., the unfolded state of the foldable cabinet. Furthermore, with regard to the front-rear direction and the left-right direction of the foldable cabinet, when viewed in the unfolded state of the foldable cabinet, the opening and closing direction of the foldable cabinet is referred to as the front-rear direction, and the other direction which is orthogonal with both the front-rear direction and the height direction is referred to as the left-right direction. In the description hereinafter, the vertical direction, the front-rear direction, and the left-right direction are applied to illustrate the positions of the various elements and parts for convenience, and these three directions are also applied to illustrate the foldable cabinet in the folded state.

To provide the foldable cabinet in the embodiment, the hinge connections between the side boards 200 and the framework 100 and the hinge connections between the side boards 200 and the back boards 300 are designed and intended to achieve the folding function of the foldable cabinet and allow users to easily mount the foldable cabinet in the unfolded state.

Each one of the two sets of panel assemblies includes the side board 200 and the back board 300. In the unfolded state, the two sets of panel assemblies and the framework 100 mutually define the cabinet body. In the folded state, both panel assemblies are folded, respectively.

The first connecting portions 220 extend from a portion of the edge of the side board body 210 and bend to define first grooves. The first turning portion 230 is provided with second connecting portions 231 bending to define third grooves. The second turning portion 320 is provided with third connecting portions 321 bending to define fourth grooves. The side frame 110 is provided with fifth connecting portions 111 bending to define second grooves. The first shaft 400 is disposed to extend through the first grooves of respective first connecting portions 220 and the second grooves of respective fifth connecting portions 111. The second shaft 500 is disposed to extend through the third grooves of respective second connecting portion 231 and the fourth grooves of respective third connecting portion 321.

Figure 17:
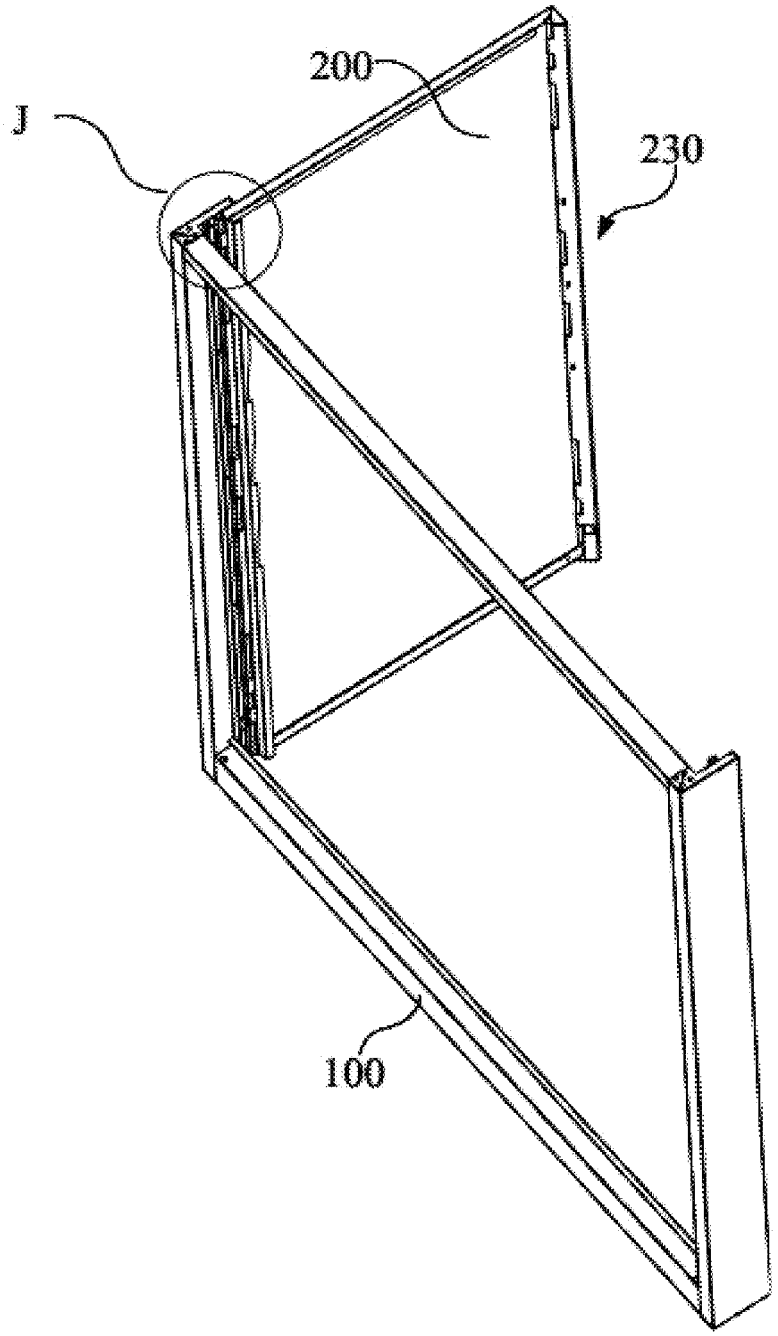
FIG. 17 is a schematic view illustrating that a framework and a side board according to an embodiment of the application are connected.
Figure 18:
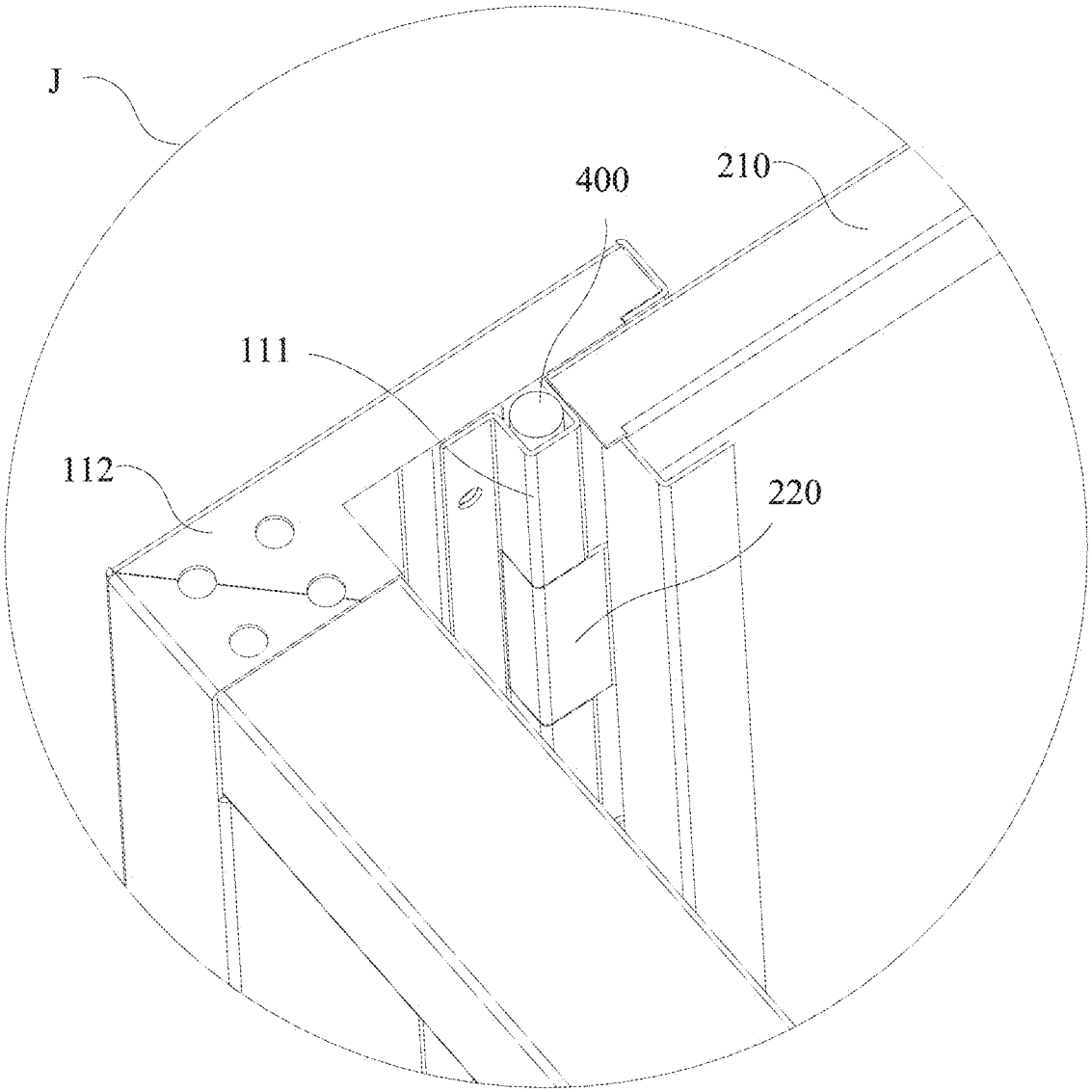
FIG. 18 is an enlarged schematic view of portion J of FIG. 17.

Please referring to FIGS. 17-18, the hinge connections between the side boards 200 and the framework 100 in the embodiment are intended to allow the side boards 200 and the framework 100 to rotate about the same shaft, which follows the same working principle as the hinge leaves in the prior art. Due to the arrangements of the first connecting portions 220 and the fifth connecting portions 111 instead of the circular holes of the hinge leaves in the prior art, the first connecting portions 220 and the fifth connecting portions 111 are allowed to rotate about respective first shaft 400, respectively, thereby achieving the hinge connections between the side boards 200 and the framework 100.

Figure 19:
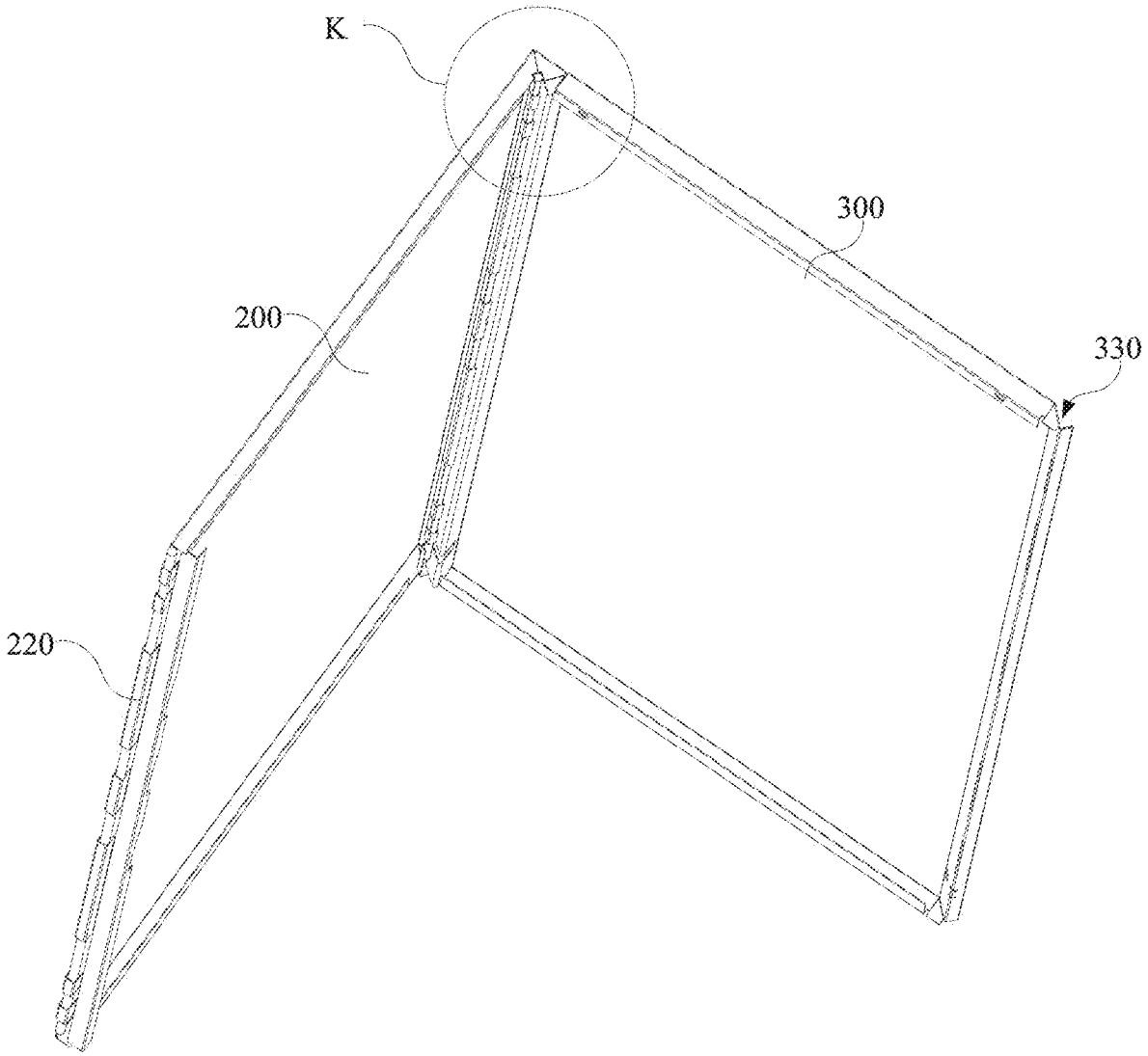
FIG. 19 is a schematic view illustrating that a side board and a back board according to an embodiment of the application are connected.
Figure 20:
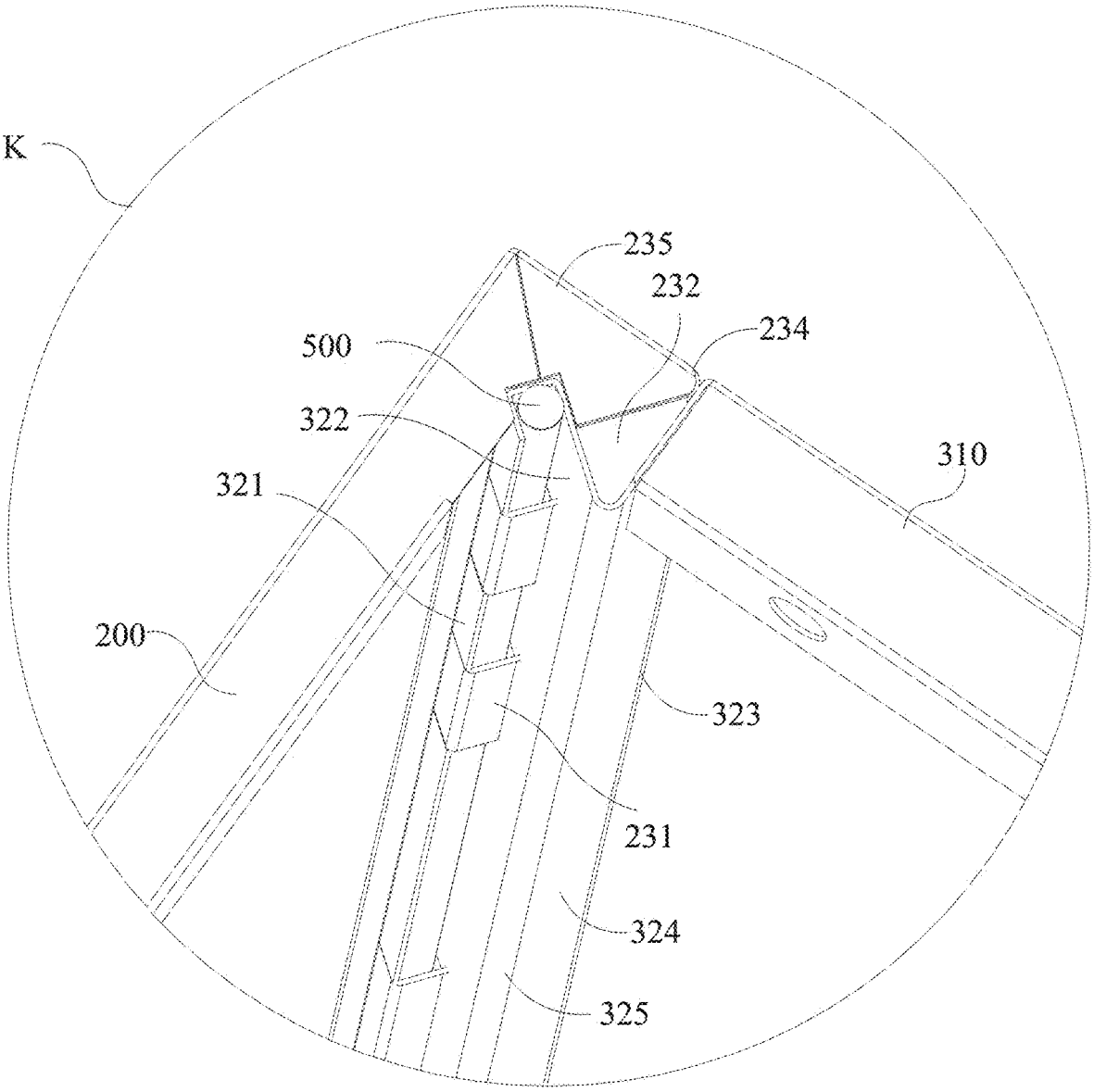
FIG. 20 is an enlarged schematic view of portion K of FIG. 19.

Please referring to FIGS. 19 and 20, similar with the arrangements of the first connecting portions 220 and the fifth connecting portions 111, the arrangements of the second connecting portions 231 and the third connecting portions 321 are also provided instead of the circular holes of the hinge leaves in the prior art. The second connecting portions 231 and the third connecting portions 321 are allowed to rotate about respective second shafts 500, respectively, thereby achieving the hinge connections between the side boards 200 and the back boards 300.

In the case that the foldable cabinet is in the folded state, the side boards 200, the back boards 300, and the framework 100 are superposed, with the back boards 300 being placed between the side boards 200 and the framework 100. In the case that the foldable cabinet is in the unfolded state, the side boards 200 are placed between the framework 100 and the back boards 300 in such a manner that the side boards 200 are substantially perpendicular to the framework 100, and the sideboards 200 are substantially perpendicular to the back boards 300.

Figure 24:
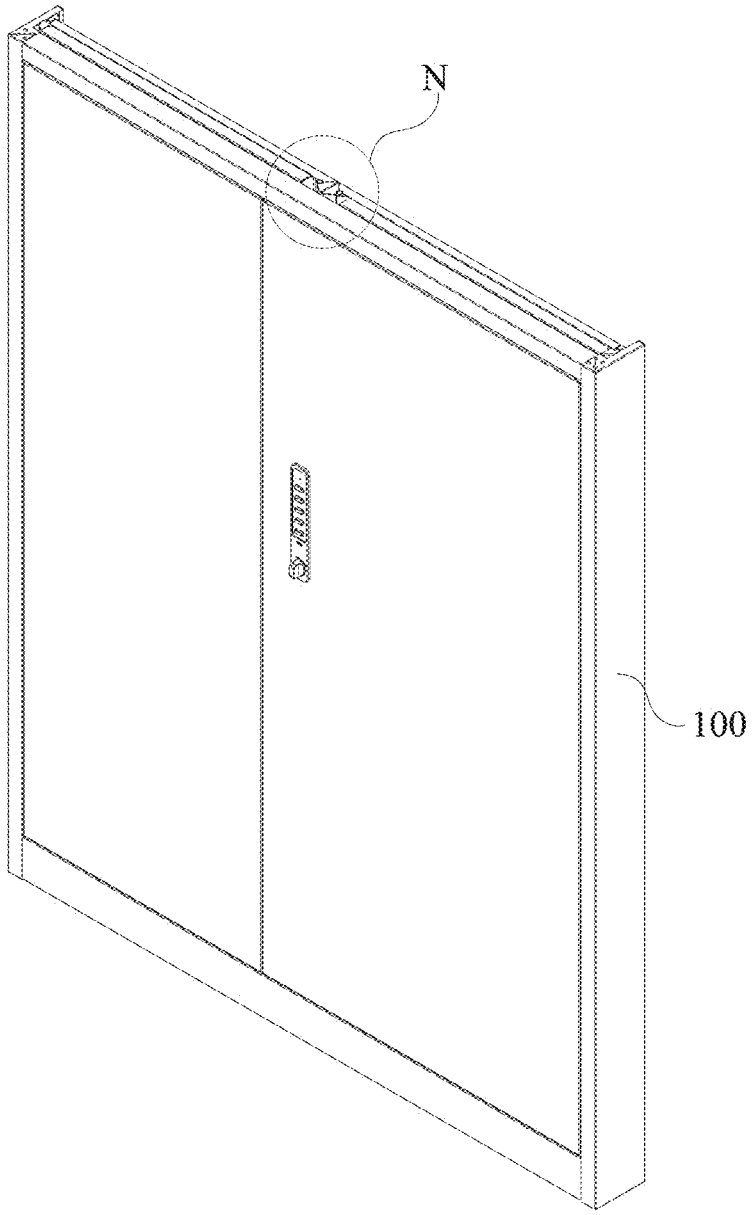
FIG. 24 is a schematic view illustrating a foldable cabinet according to an embodiment of the application in a folded state.
Figure 25:
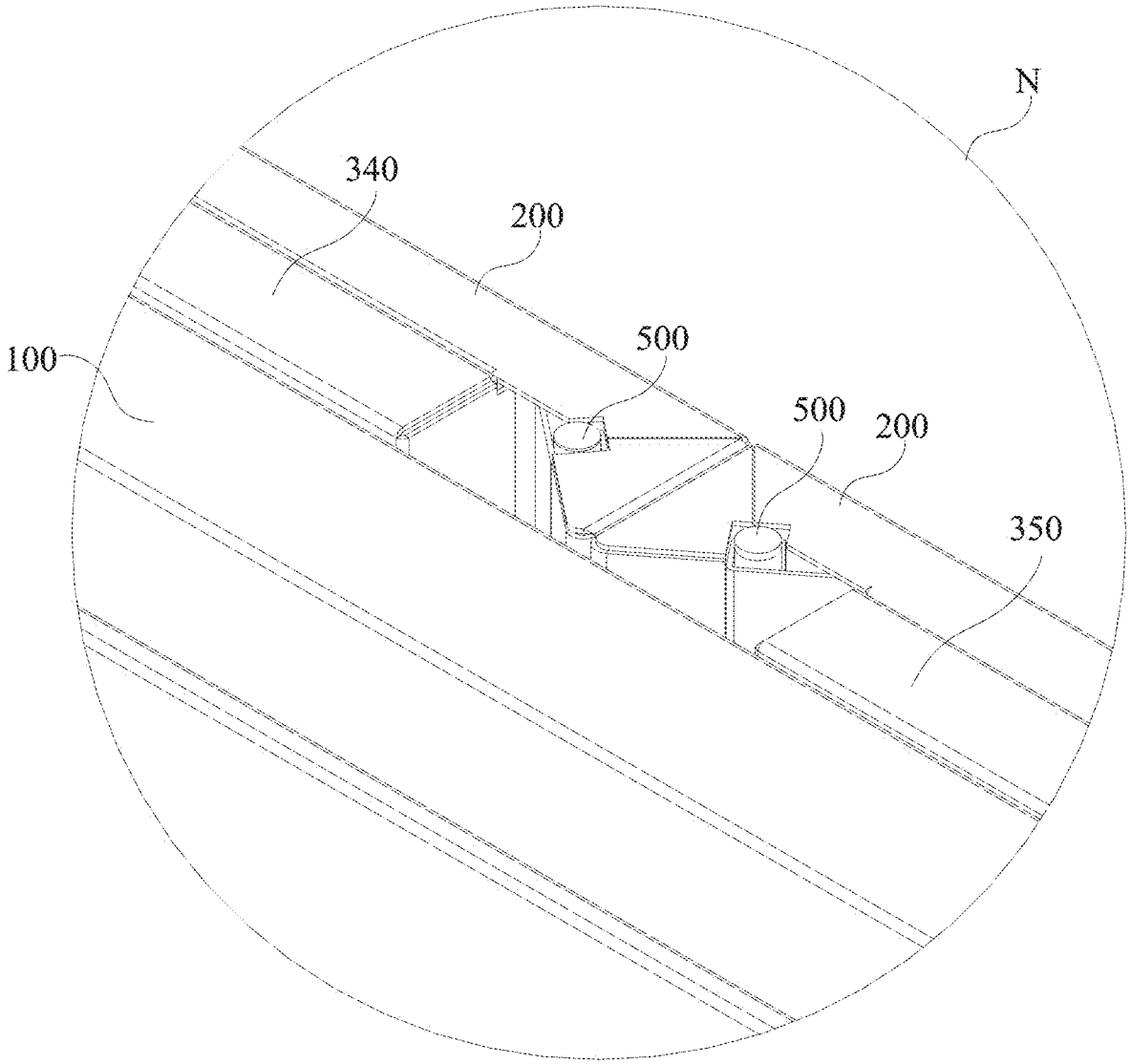
FIG. 25 is an enlarged schematic view of portion N of FIG. 24.
Figure 26:
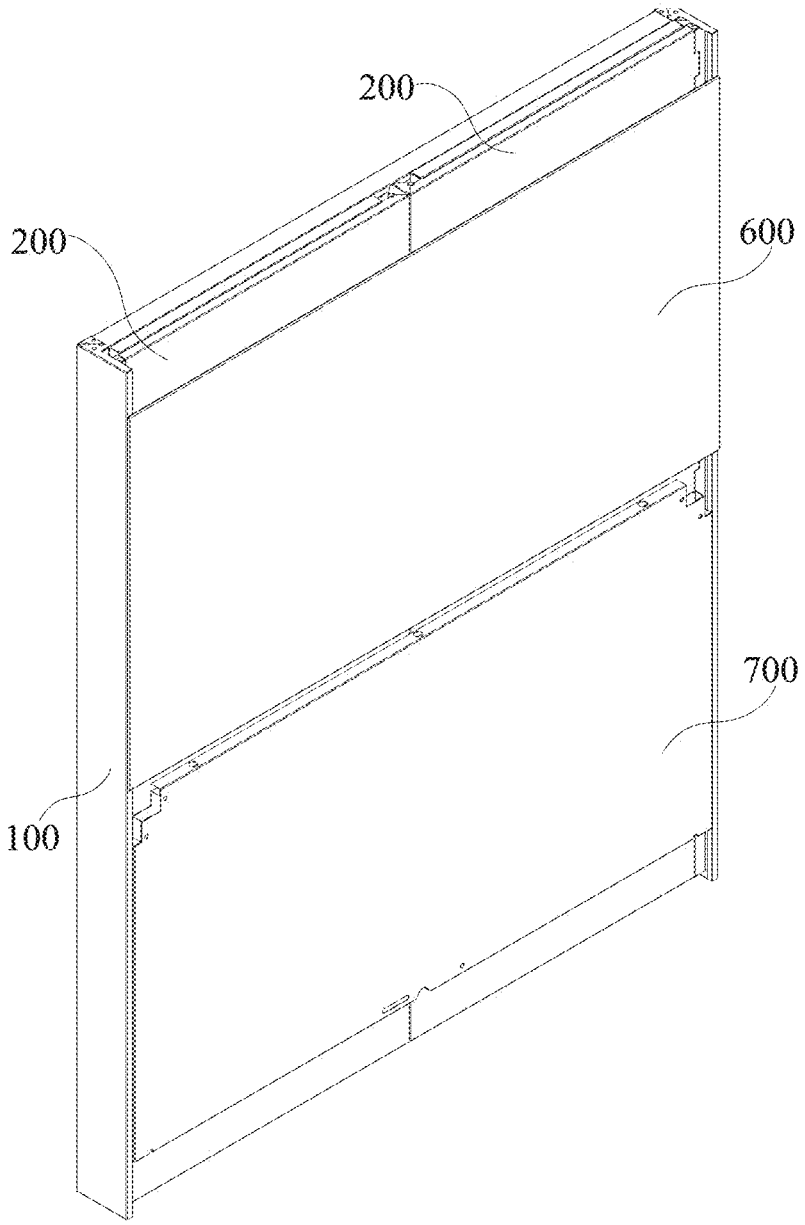
FIG. 26 is a schematic view illustrating a rear side of the foldable cabinet of FIG. 24 in the folded state.
Figure 27:
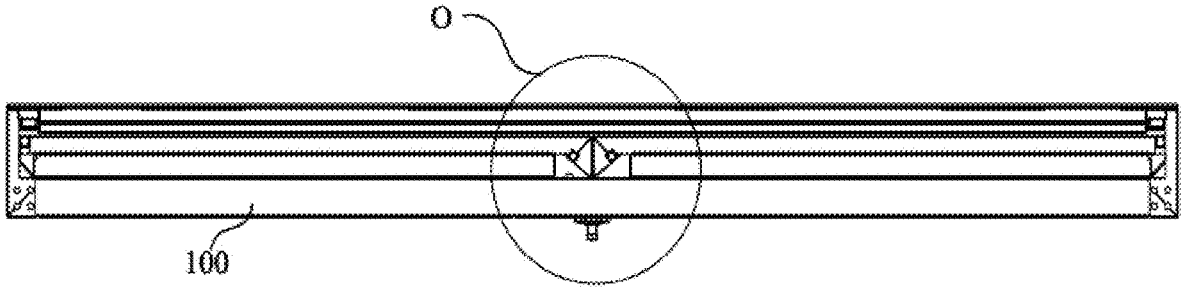
FIG. 27 is a top view of the foldable cabinet of FIG. 24 in the folded state.
Figure 28:
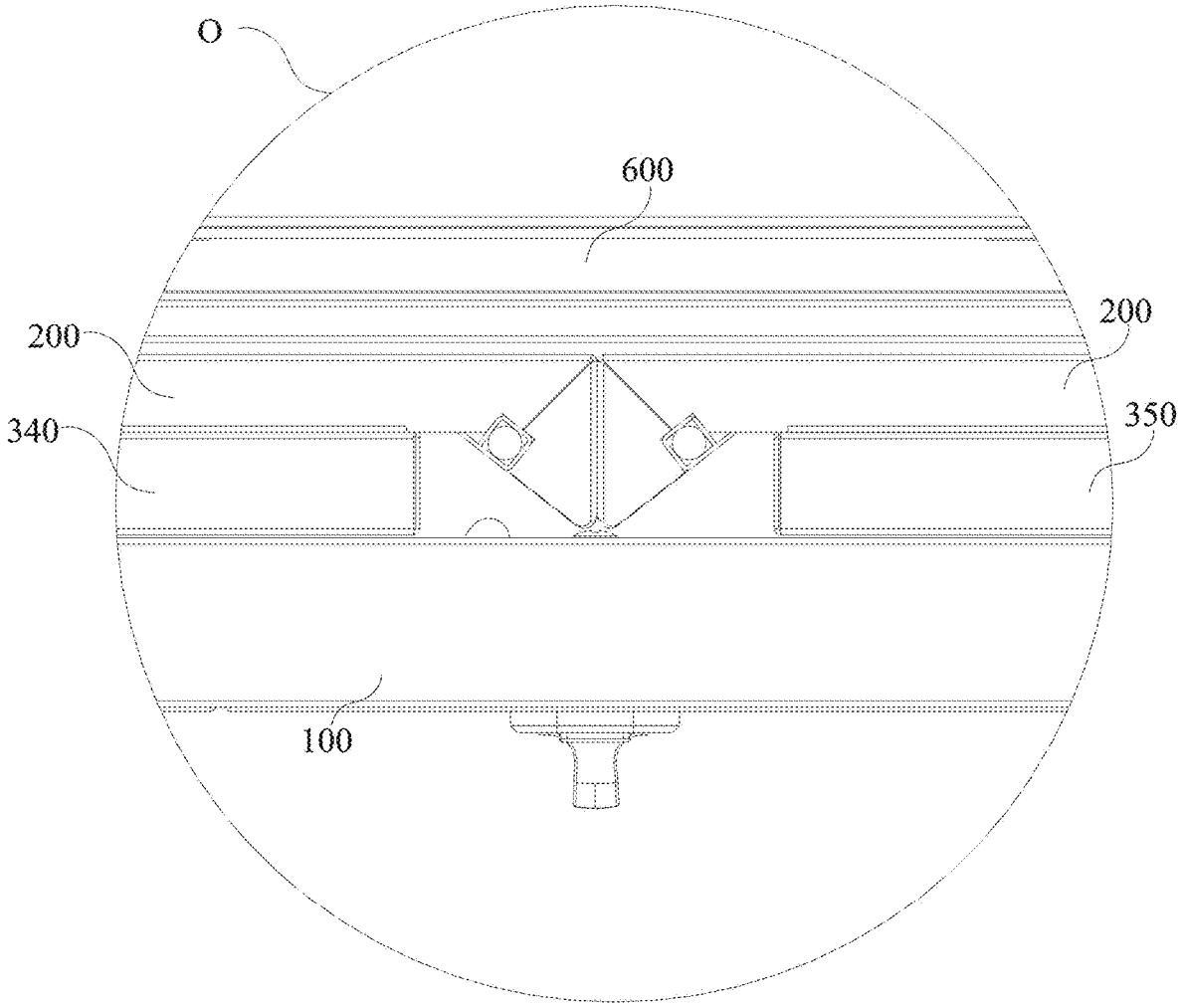
FIG. 28 is an enlarged schematic view of portion O of FIG. 27.
Figure 29:
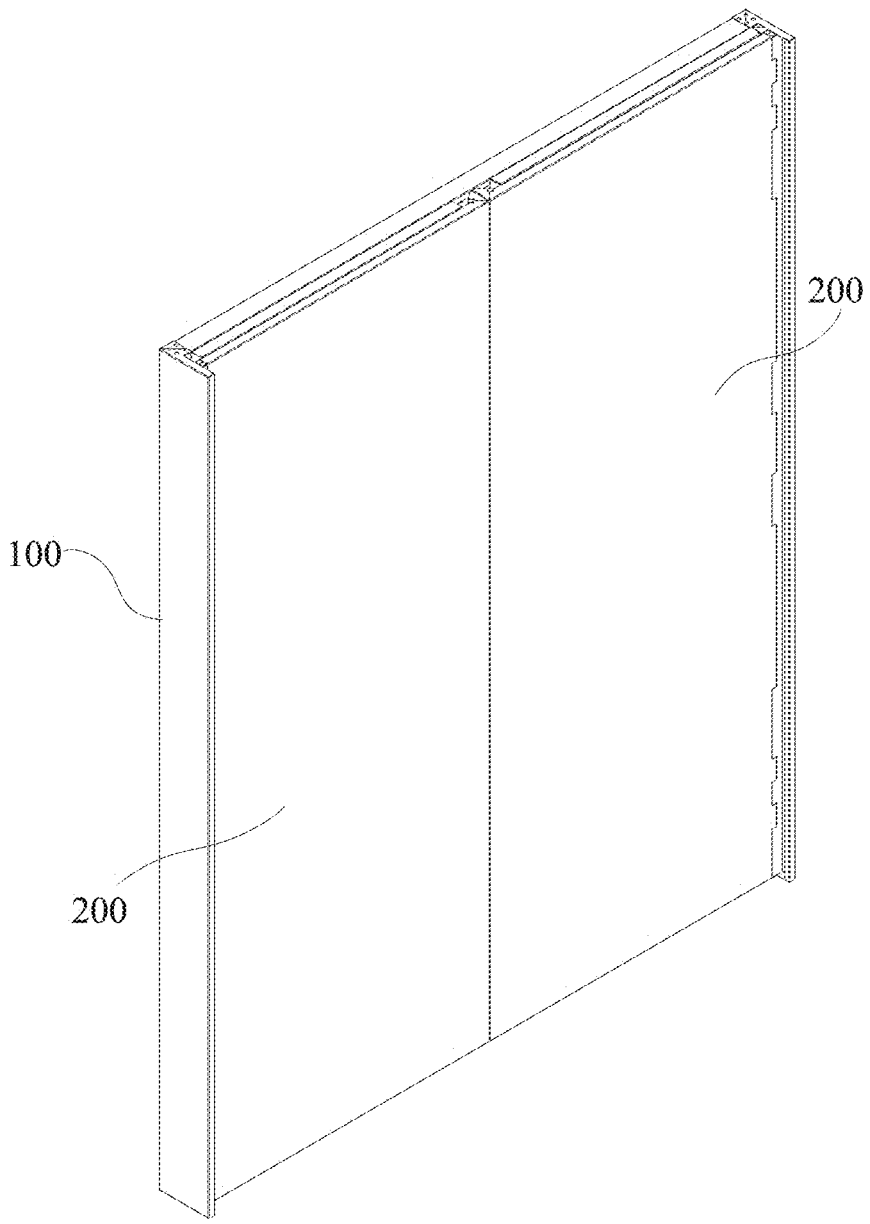
FIG. 29 is a schematic view illustrating a rear side of a portion of the foldable cabinet of FIG. 24 in the folded state.
Figure 30:
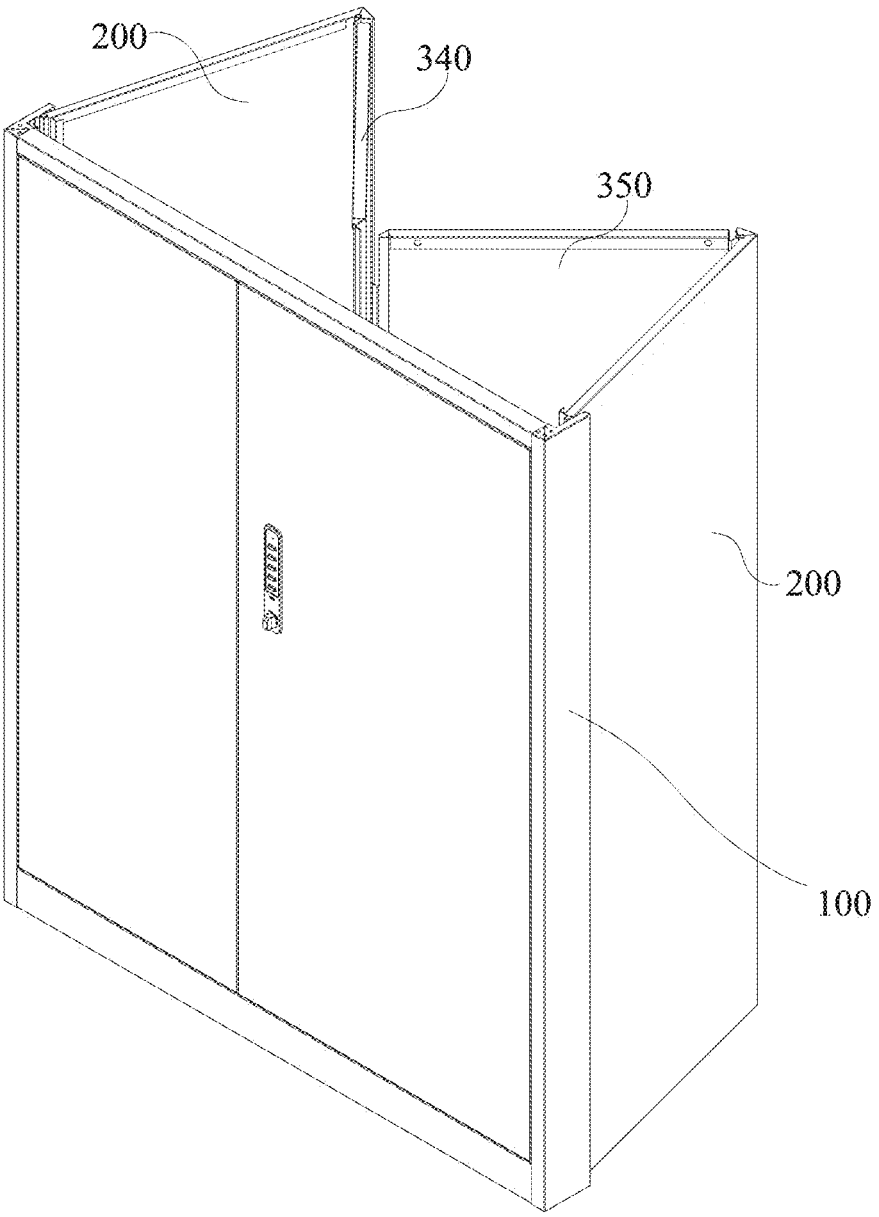
FIG. 30 is a schematic view which illustrates a foldable cabinet according to an embodiment of the application transitioning from a folded state to an unfolded state, with a first back board and a second back board being not connected.
Figure 31:
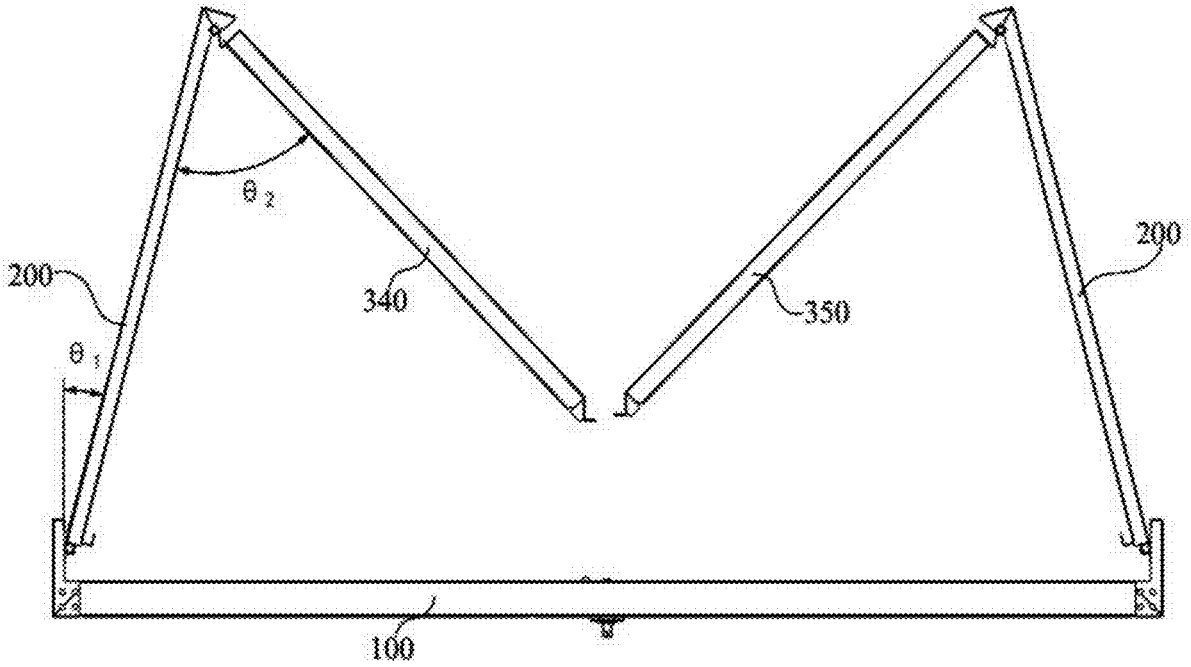
FIG. 31 is a top view of the structure illustrated in FIG. 30.

In order to improve space utilization during transportation and storage of the foldable cabinet, please referring to FIGS. 24-26, the foldable cabinet may be folded up, such that the foldable cabinet is in the folded state. To fold the foldable cabinet, please referring to FIGS. 30-31, both the top board 600 and the bottom board 700 may be removed, and the side boards 200 and the back boards 300 may be rotated towards the framework 100 until they are superposed. Then, please referring to FIGS. 26-29, the top board 600 and the bottom board 700 may be superposed on the assembly of the framework 100, the side boards 200, and the back boards 300. To assemble the foldable cabinet, the two sets of side boards 200 and back boards 300 may be respectively reversely rotated. Please referring to FIGS. 32-38, the framework 100, the side boards 200, and the back boards 300 may be unfolded in a cuboid shape. Then, please referring to FIGS. 39-42, the top board 600 and the bottom board 700 may be respectively mounted, whereby the foldable cabinet may be unfolded to enter the unfolded state.

The term "substantially perpendicular" indicates that the angle falls within a range of 85°-95°.

In the transition state of the foldable cabinet between the unfolded state and the folded state, the angle formed between the plane in which the framework 100 lies and the planes in which the side boards 200 respectively lie may be denoted by $\theta_1$, the angle formed between the planes in which the side board 200 and the back board 300 of respective one panel assembly respectively lie may be denoted by $\theta_2$, and they may satisfy: $\theta_1 \leq 95°$, and $\theta_2 \leq 95°$.

Throughout the folded state and the unfolded state of the foldable cabinet and the transition state therebetween, the opening of the first groove of each first connecting portion 220 and the opening of the second groove of corresponding fifth connecting portion 111 always face different directions, and the opening of the third groove of each second connecting portion 231 and the opening of the fourth groove of corresponding third connecting portion 321 always face different directions.

As the first connecting portions 220 and the fifth connecting portions 111 each has the opening due to inherent characteristics of the bending process, the first shaft 400 may fall off from the first connecting portion 220 and the fifth connecting portion 111 once their two openings face a same direction, resulting in a release of the hinge connections between the framework 100 and the side boards 200. In order to avoid such situation, the foldable cabinet is designed in such a manner that, throughout the folded state, the unfolded state and the transition state therebetween, the opening of respective first connecting portion 220 and the opening of respective fifth connecting portion 111 always face different directions. In particular, the two openings face different directions in the folded state, and the two openings also face different directions in the unfolded state. During the transition state between the folded state and the unfolded state, the first connecting portions 220 and the fifth connecting portions 111 relatively rotate about the corresponding first shaft 400. Throughout the rotation, the openings of each first connecting portion 220 and corresponding fifth connecting portion 111 always face different directions.

With such arrangement, no matter the foldable cabinet is in the folded state, the unfolded state, or the transition state therebetween, each first connecting portion 220 and corresponding fifth connecting portion 111 mutually limit the position of corresponding first shaft 400. In such a case, they have a function of relatively rotating about the first shaft 400 and meanwhile prevent the first shaft 400 from falling off, thereby ensuring the reliability of the hinge connections between the framework 100 and respective side board 200.

Similarly, as each of the second connecting portions 231 and the third connecting portions 321 has one opening, no matter the foldable cabinet is in the folded state, the unfolded state, or the transition state therebetween, the opening of each second connecting portion 231 and the opening of corresponding third connecting portion 321 always face different directions, such that each second connecting portion 231 and corresponding third connecting portion 321 mutually limit the position of corresponding second shaft 500. In such a case, they have a function of relatively rotating about corresponding second shaft 500 and meanwhile prevent the second shaft 500 from falling off, thereby ensuring the reliability of the hinge connections between the side boards 200 and the back boards 300.

In the prior art, hinge leaves are usually provided to achieve such hinge connections between the framework 100 and the side boards 200, and between the side boards 200 and the back boards 300. With respect to the situation of using long hinge leaves, it is necessary to provide a long hinge leaf which extends from the top of the foldable cabinet to the bottom of the foldable cabinet and thus has a higher cost. With respect to the situation of using a plurality of short hinge leaves, usually the plurality of short hinge leaves may be spaced apart and sequentially disposed along the height direction of the foldable cabinet. In such a case, the plurality of short hinge leaves, which need to meet the coaxial requirement during mounting no matter by welding or bolting, has relatively higher positioning demands and has more difficulty in assembling, thereby leading to a time-consuming assembly process with a higher cost.

According to the foldable cabinet in the embodiment, the existing sheet metal bending machines in the workshop may be used to continuously punch the side boards 200 and the back boards 300, bend them to form the first connecting portions 220, the second connecting portions 231, and the third connecting portions 321. Similarly, the fifth connecting portions 111 may be formed by bending the boards.

However, due to the inherent function limitations of the sheet metal bending machines, they cannot process circular axle holes by bending. The first connecting portions 220, the second connecting portions 231, the third connecting portions 321, and the fifth connecting portions 111 can only be bent to form the grooves which are unclosed, i.e., the grooves formed with respective openings of the first connecting portions 220, the second connecting portions 231, the third connecting portions 321, and the fifth connecting portions 111 as mentioned above. Such hinge structure has a defect in that, throughout the folded state, the unfolded state, and the transition state therebetween, if there is any moment when the openings of the first grooves of the first connecting portions 220 and the openings of the second grooves of corresponding fifth connecting portions 111 all face a same direction, the first shaft 400 will fall off from the first grooves of the first connecting portions 220 and the second grooves of the fifth connecting portions 111, resulting in a failure of the hinge structure between the side board 200 and the side frame 110. Similarly, if there is any moment when the openings of the second connecting portions 231 and corresponding third connecting portions 321 face a same direction, the second shaft 500 will fall off from the third grooves of the second connecting portions 231 and the fourth grooves of the third connecting portions 321, resulting in a failure of the hinge structure between the side board 200 and the back board 300.

Figure 48:
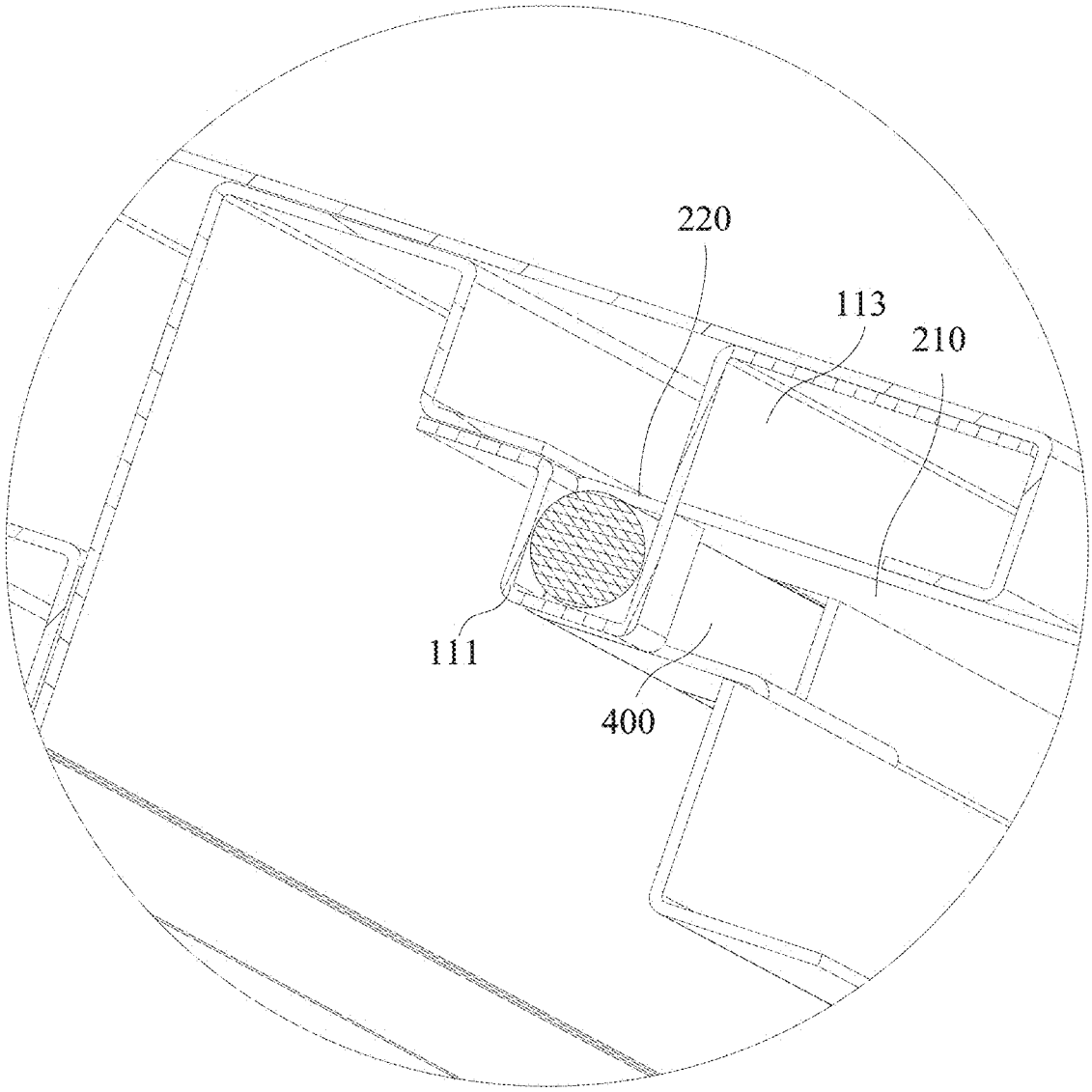
FIG. 48 is a schematic view illustrating a first connecting portion and a fifth connecting portion according to an embodiment of the application in an unfolded state.
Figure 49:
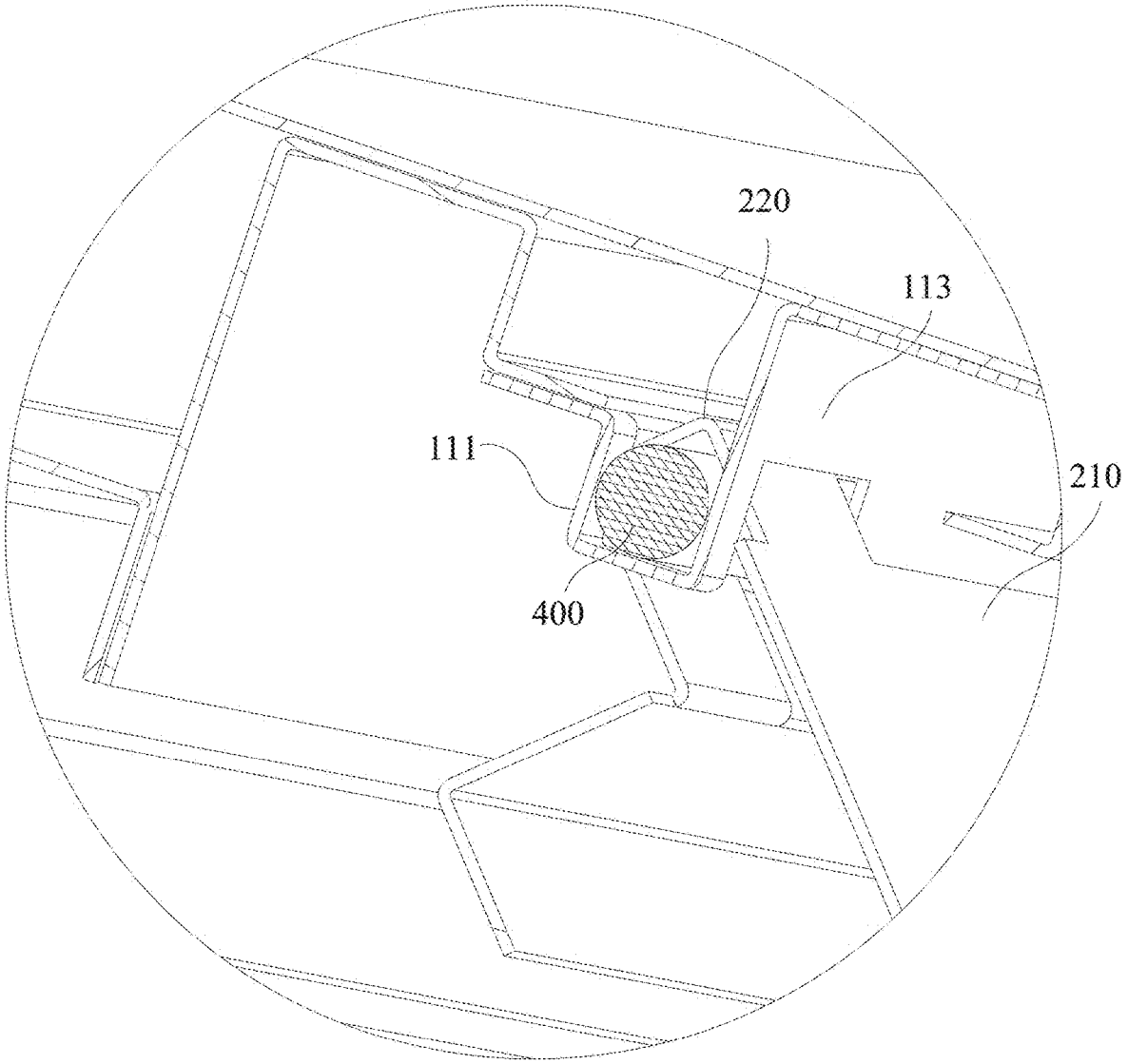
FIG. 49 is a schematic view illustrating a first connecting portion and a fifth connecting portion according to an embodiment of the application in a transition state between an unfolded state and a folded state.
Figure 50:
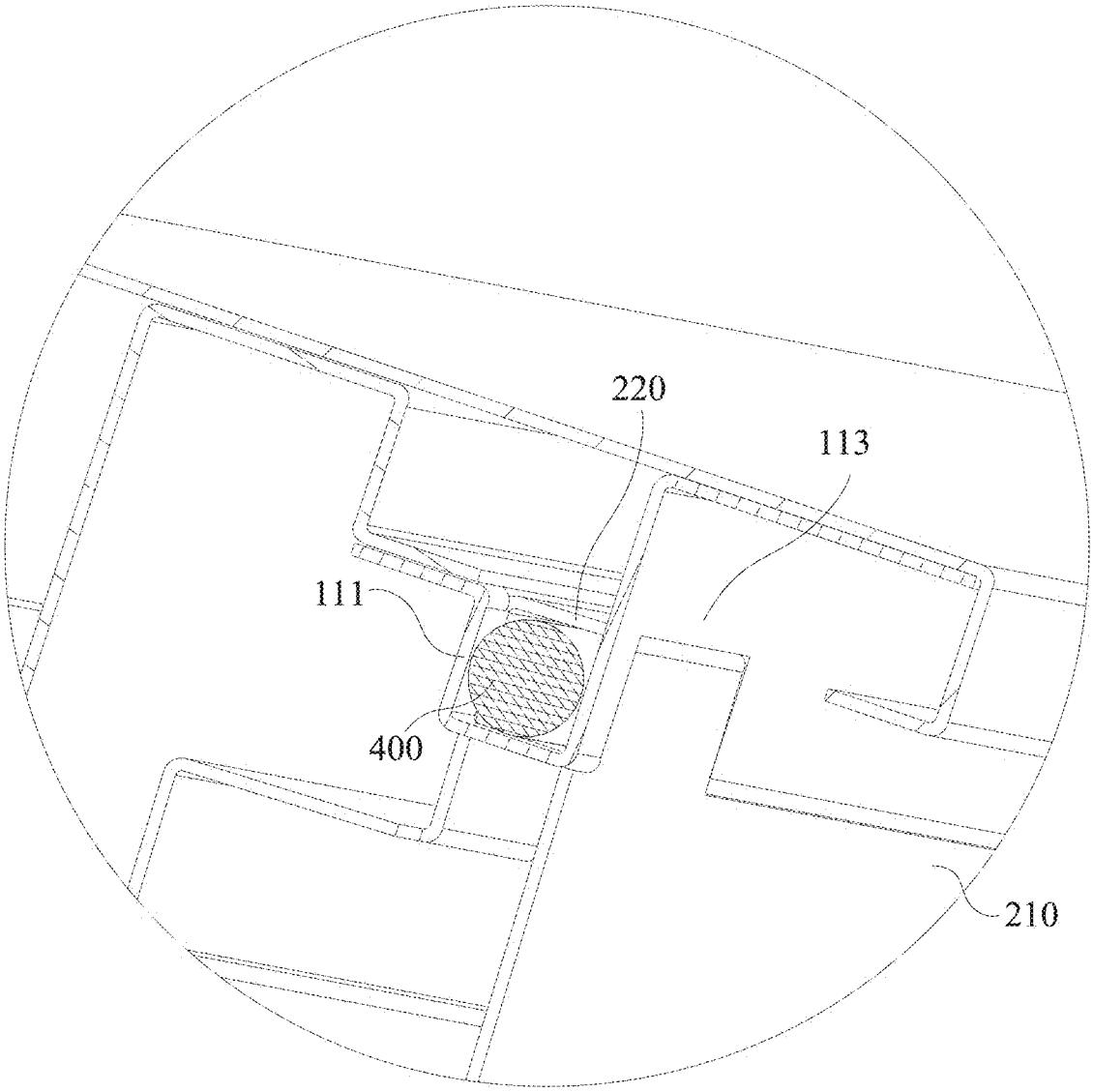
FIG. 50 is a schematic view illustrating a first connecting portion and a fifth connecting portion according to an embodiment of the application in a folded state.

In such type of foldable cabinet in the embodiment, the side boards 200 mounted on the framework 100 can be open or closed to a limited extent. Please referring to FIGS. 48-50, throughout the folded state, the unfolded state, and the transition state therebetween, the rotation angles of the side boards 200 mounted on the framework 100 fall within a range of 0°-95°, among which the folded state and the unfolded state are the two ultimate states. The first connecting portions 220, the fifth connecting portions 111 and the first shafts 400 in such two states or in the transition state between such two states can avoid the said defect. The openings of each first connecting portion 220 and corresponding fifth connecting portion 111 always face different directions, whereby the first shaft 400 can be prevented from falling off and a stable hinge structure between the side board 200 and the side frame 110 can be ensured.

Figure 51:
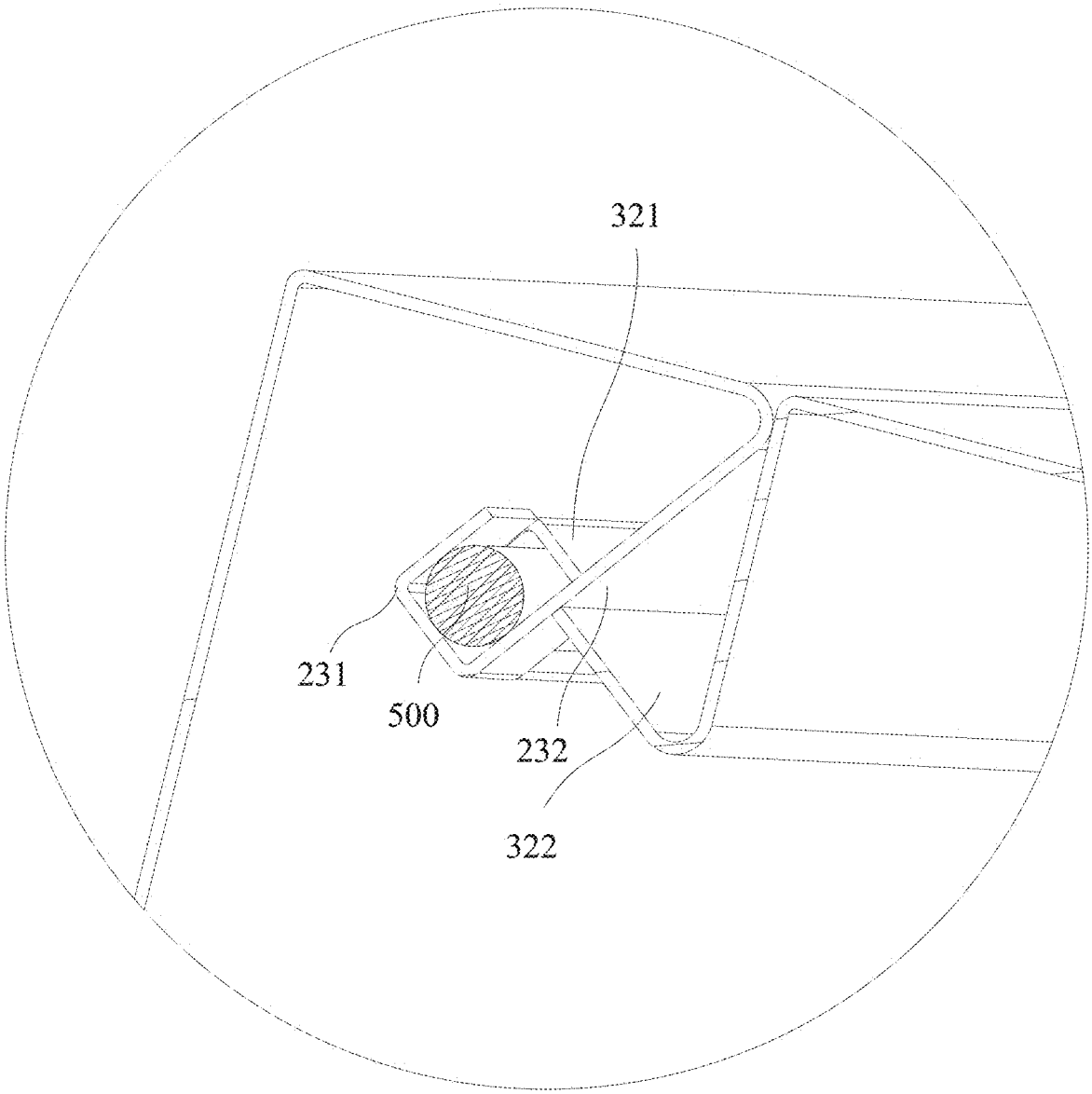
FIG. 51 is a schematic view illustrating a second connecting portion and a third connecting portion according to an embodiment of the application in an unfolded state.
Figure 52:
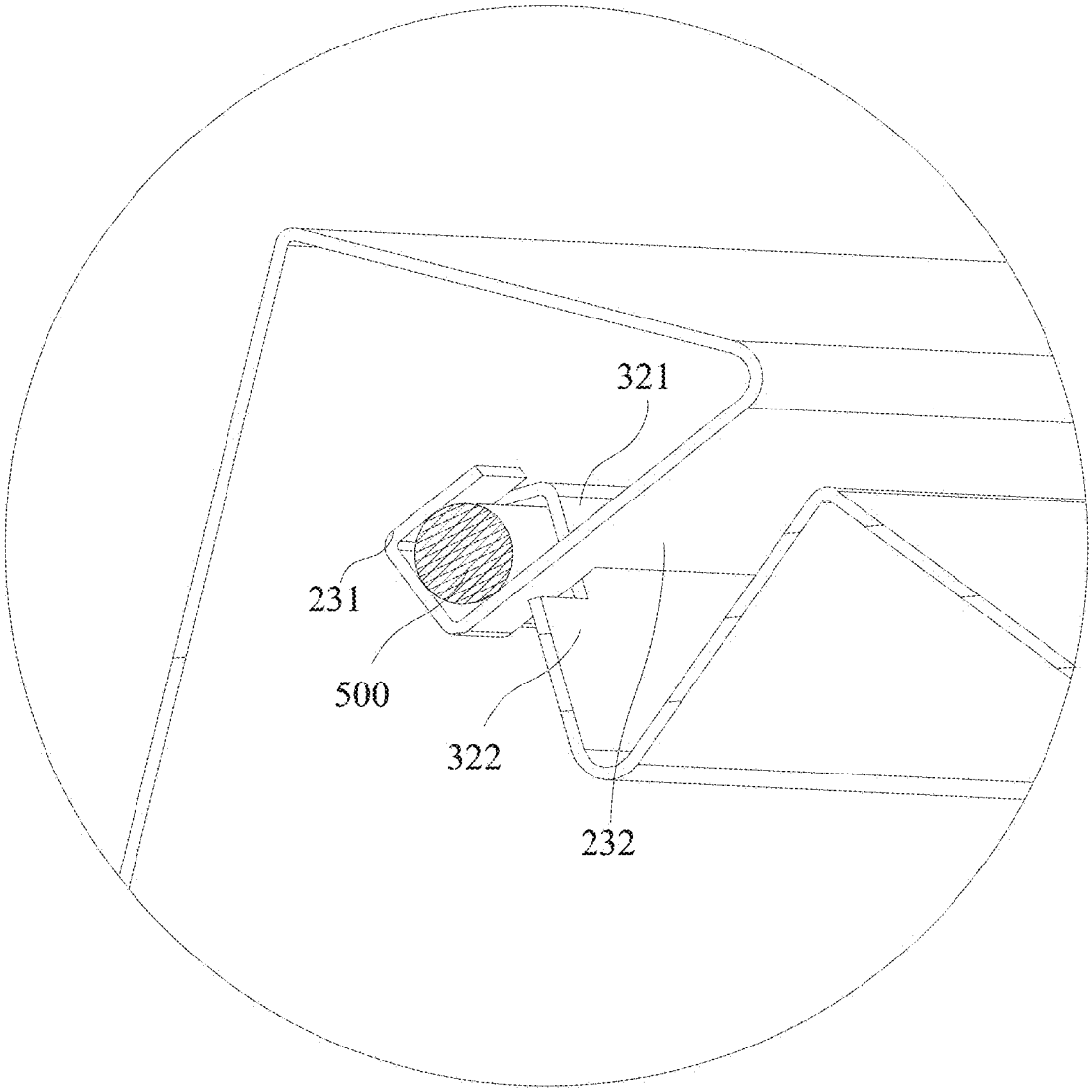
FIG. 52 is a schematic view illustrating a second connecting portion and a third connecting portion according to an embodiment of the application in a transition state between an unfolded state and a folded state.
Figure 53:
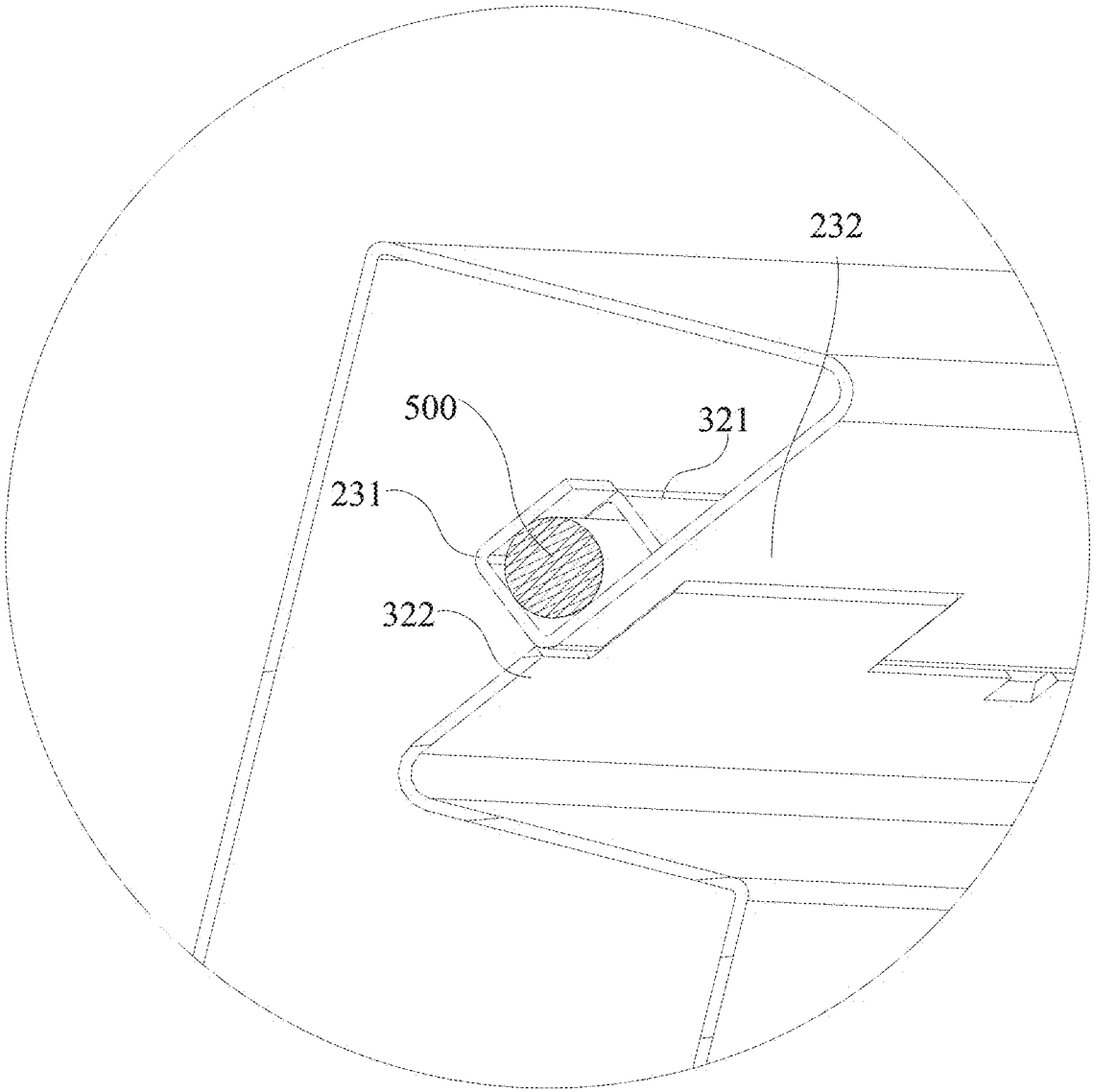
FIG. 53 is a schematic view illustrating a second connecting portion and a third connecting portion according to an embodiment of the application in a folded state.

So are the hinge structures between the side boards 200 and the back boards 300. In the folded state, the back boards 300 are located between the side boards 200 and the framework 100, and the back boards 300 mounted on the side boards 200 can be open or closed to a limited extent. Please referring to FIGS. 51-53, throughout the folded state, the unfolded state, and the transition state therebetween, the rotation angles of the back boards 300 respectively mounted on the side boards 200 fall within a range of 0°-95°, among which the folded state and the unfolded state are the two ultimate states. The second connecting portions 231, the third connecting portions 321, and the second shafts 500 in such two states or in the transition state between such two states can avoid the said defect. The openings of each first connecting portion 220 and corresponding fifth connecting portion 111 always face different directions, whereby the first shaft 400 can be prevented from falling off, and a stable hinge structure between the side board 200 and the side frame 110 can be ensured. The openings of each second connecting portion 231 and corresponding third connecting portion 321 always face different directions, whereby the second shaft 500 can be prevented from falling off, and a stable hinge structure between the back board 300 and the side board 200 can be ensured.

In the embodiment, the hinge structure formed by bending can meet the hinge requirement at reduced cost. Compared with short hinge leaves, the long shafts like the first shaft 400 and the second shaft 500 have one more function of positioning the connecting portions by themselves. In other words, the first shafts 400 facilitate positioning of the first connecting portions 220 and the fifth connecting portions 111, and the second shafts 500 facilitate positioning of the second connecting portions 231 and the third connecting portions 321. In such a case, it reduces assembly difficulty during assembling. It simplifies the hinge structure, and meanwhile reduces mounting difficulty and saves economic costs.

As conventional hinges are manufactured by the sheet metal process, concerning sheet metal products, the parts to be hinged can be directly molded with hinge structures through the sheet metal process. In such a case, not only the procurement cost of accessories can be reduced, but also the complicated assembly process of accessories can be eliminated.

In the embodiment, the characteristics of the sheet metal bending process and the hinge structure are fully combined, to integrally form rotatable long hinge structures on the edge of sheet metal boards by sheet metal bending with fewer steps, and then provide shafts extending through to connect two parts, thereby achieving connection of the two parts through a long hinge. In such a case, it does not need additional accessory cost and has a simpler assembly.

In the embodiment, the first connecting portions 220, the second connecting portions 231, the third connecting portions 321, and the fifth connecting portions 111 which are formed with rectangular grooves can meet hinge requirements and are easy to manufacture and process. In further embodiments, they may be bent to other shapes, as long as the first shafts 400 can form stable hinge structures respectively with the first connecting portions 220 and the fifth connecting portions 111, and the second shafts 500 can form stable hinge structures respectively with the second connecting portions 231 and the third connecting portions 321. Herein, the stable hinge structure mean that the first connecting portion 220 and the fifth connecting portion 111 are rotatable about the first shaft 400, with the first shaft 400 being prevented from falling off from the first connecting portion 220 and the fifth connecting portion 111. Furthermore, the radial movements of the first shaft 400 within the first connecting portion 220 and the fifth connecting portion 111 can be reduced. So are the second shaft 500, the second connecting portion 231, and the third connecting portion 321.

For example, the outer surface of the first shaft 400 may be tangent to the inner surface of the first connecting portion 220 and the inner surface of the fifth connecting portion 111, respectively. When viewed in cross-section, the first shaft 400 may be the inscribed circle of the first connecting portion 220 and the inscribed circle of the fifth connecting portion 11. The second shaft 500, the second connecting portion 231, and the third connecting portion 321 may be arranged with similar tangent relationships.

In some embodiments, the first connecting portion 220 may be provided on a portion of the edge of the side board 200.

Figure 7:
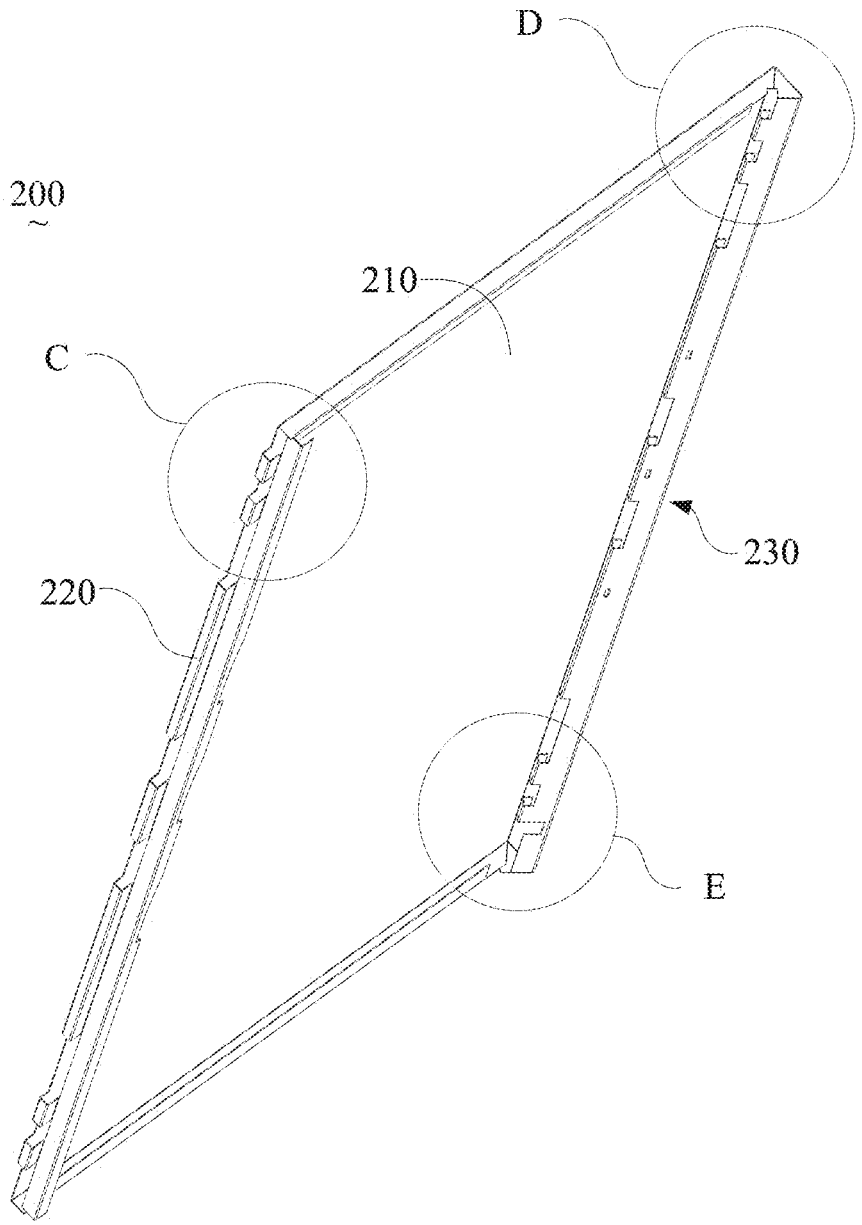
FIG. 7 is a schematic structural view illustrating a side board according to an embodiment of the application.
Figure 8:
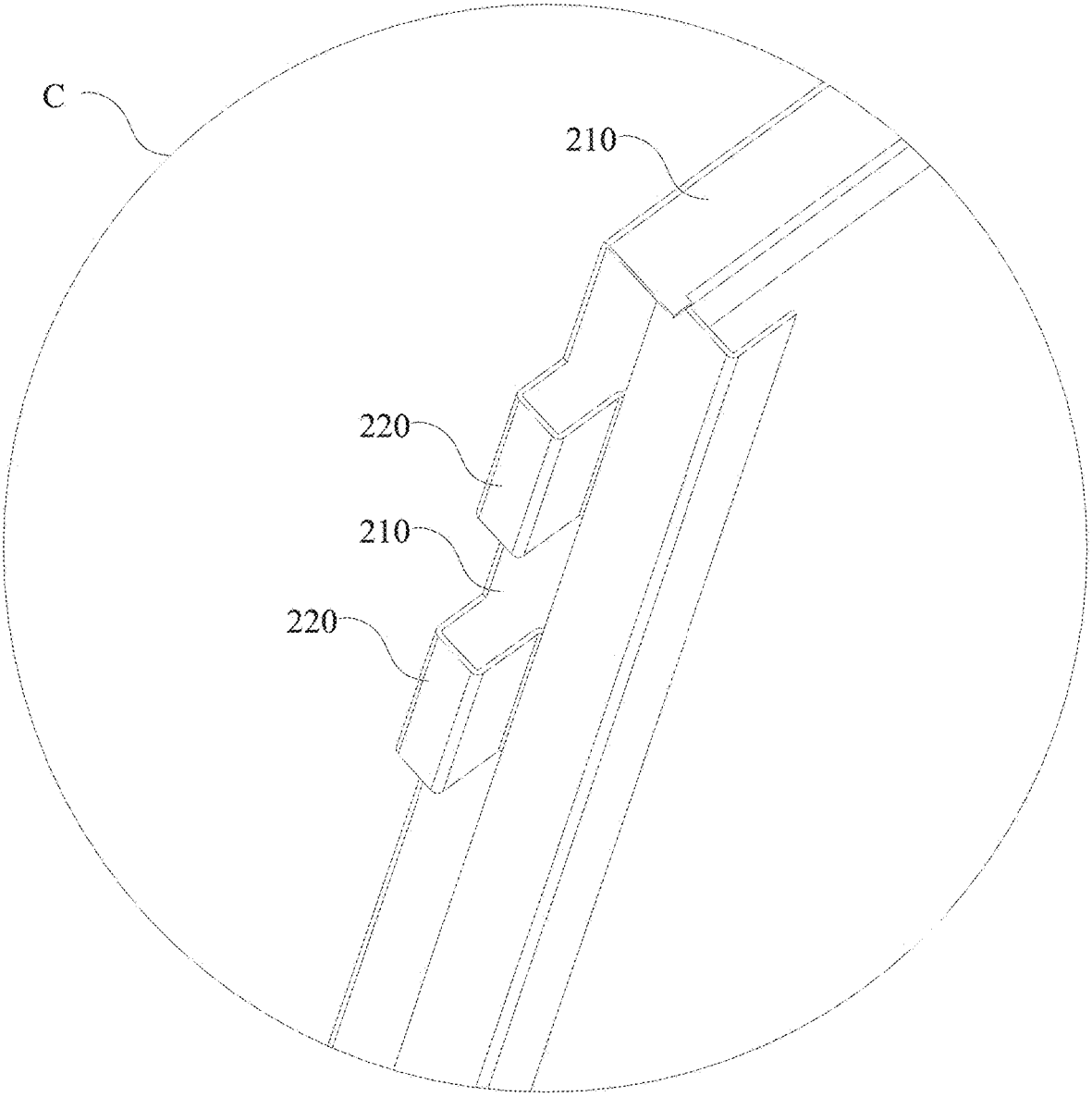
FIG. 8 is an enlarged schematic view of portion C of FIG. 7.

Please referring to FIGS. 7 and 8, the first connecting portion 220 and corresponding side board body 210 may be designed as a one-piece side board 200 which is integrally formed. Each side board 200 may have an edge bending to provide the first connecting portions 220.

Please referring to FIGS. 2-6, the side frame 110 may further comprise a side frame body 112 and a first limiting portion 113, and the first limiting portion 113 and the fifth connecting portion 111 may be located behind the side frame body 112. A portion of the edge of the first limiting portion 113 may extend and bend to provide the fifth connecting portions 111.

The fifth connecting portions 111 and corresponding first limiting portion 113 may be designed as a one-piece board, which is integrally formed and is molded with the first limiting portion 113 and the fifth connecting portion 111 through the bending process.

In the unfolded state of the foldable cabinet, a portion of the edge of the side board body 210 may abut against the fifth connecting portion 111, and a portion of the edge of the first limiting portion 113 may abut against the first connecting portion 220.

In the folded state of the foldable cabinet, the edge of the side board body 210 does not abut against the fifth connecting portion 111, and the edge of the first limiting portion 113 does not abut against the first connecting portion 220.

In other words, a portion of the edge of the side board body 210 extends to form the first connecting portion 220, and another portion of the edge of the side board body 210 abuts against corresponding fifth connecting portion 111. Similarly, a portion of the edge of the first limiting portion 113 extends to form the fifth connecting portion 111, and another portion of the edge of the first limiting portion 113 abuts against corresponding first connecting portion 220.

When the foldable cabinet changes from the folded state to the unfolded state, the first connecting portion 220 is rotated and thus the orientation relationship between the first connecting portion 220 and the fifth connecting portion 111 which are matched with each other changes. Once arriving at unfolded state, the side board body 210 and the first limiting portion 113 limit the first connecting portion 220 and the fifth connecting portion 111 at the same time, such that the first connecting portion 220 and the fifth connecting portion 111 cannot continue to rotate relative to each other, whereby the rotation angle of the side board 200 can be limited.

Figure 9:
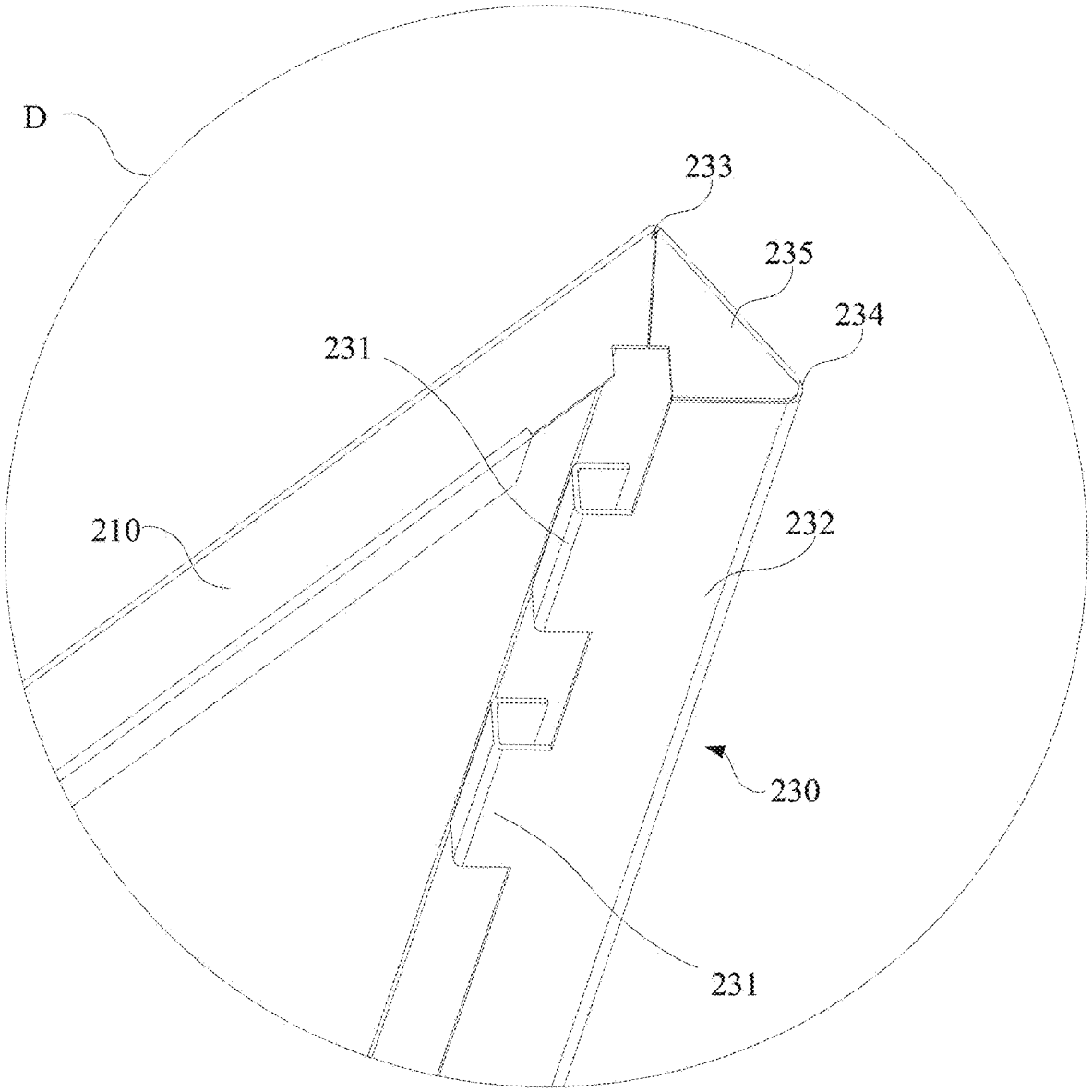
FIG. 9 is an enlarged schematic view of portion D of FIG. 7.
Figure 10:
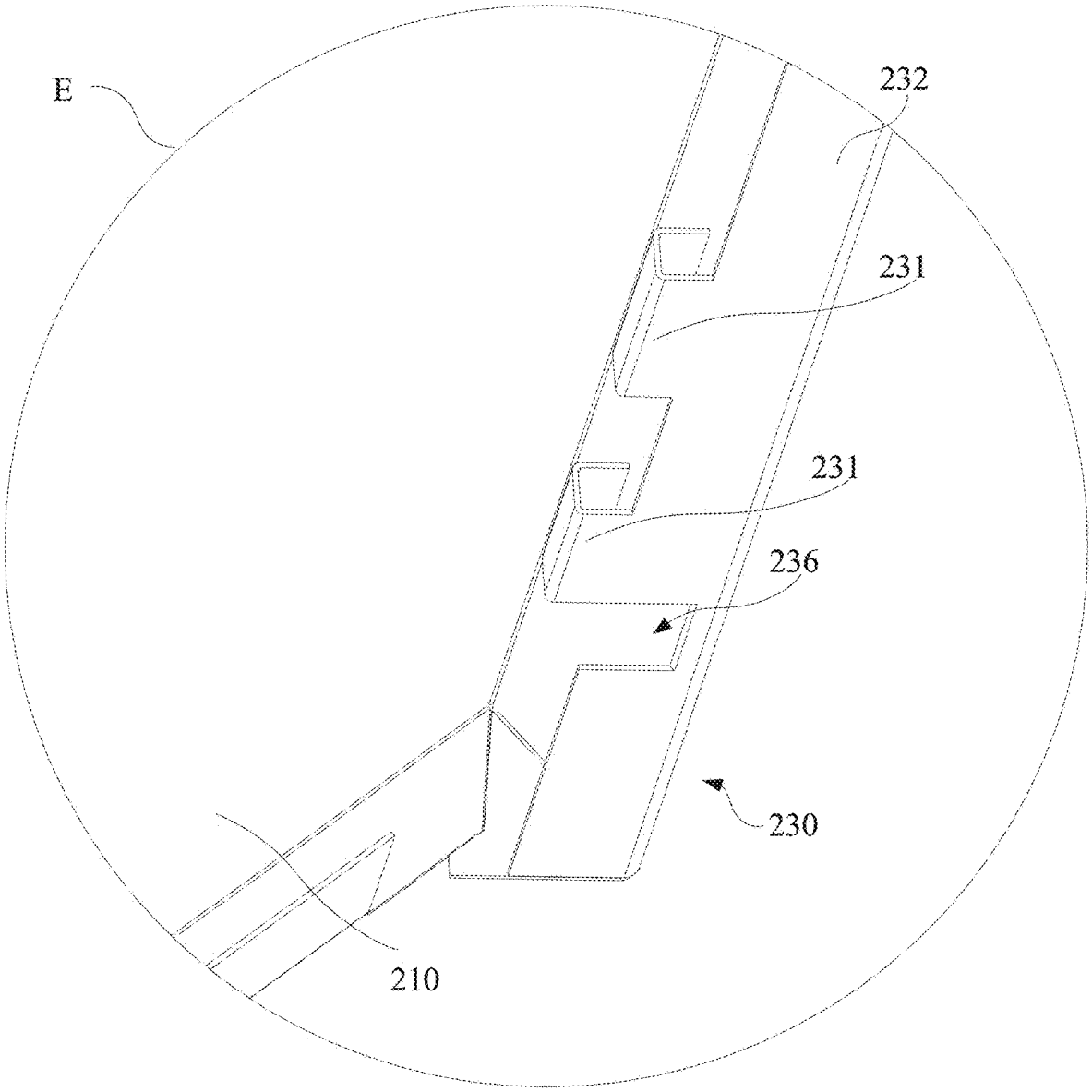
FIG. 10 is an enlarged schematic view of portion E of FIG. 7.

Please referring to FIGS. 9 and 10, the first turning portion 230 may be further provided with a second limiting portion 232, the second connecting portion 231 may be connected with the side board body 210 through the second limiting portion 232. A portion of the edge of the second limiting portion 232 may extend and bend to provide the second connecting portions 231.

The second connecting portions 231 and corresponding second limiting portion 232 may be designed as a one-piece board, which is integrally formed and has an edge bending to provide the second connecting portions 231.

Figure 13:
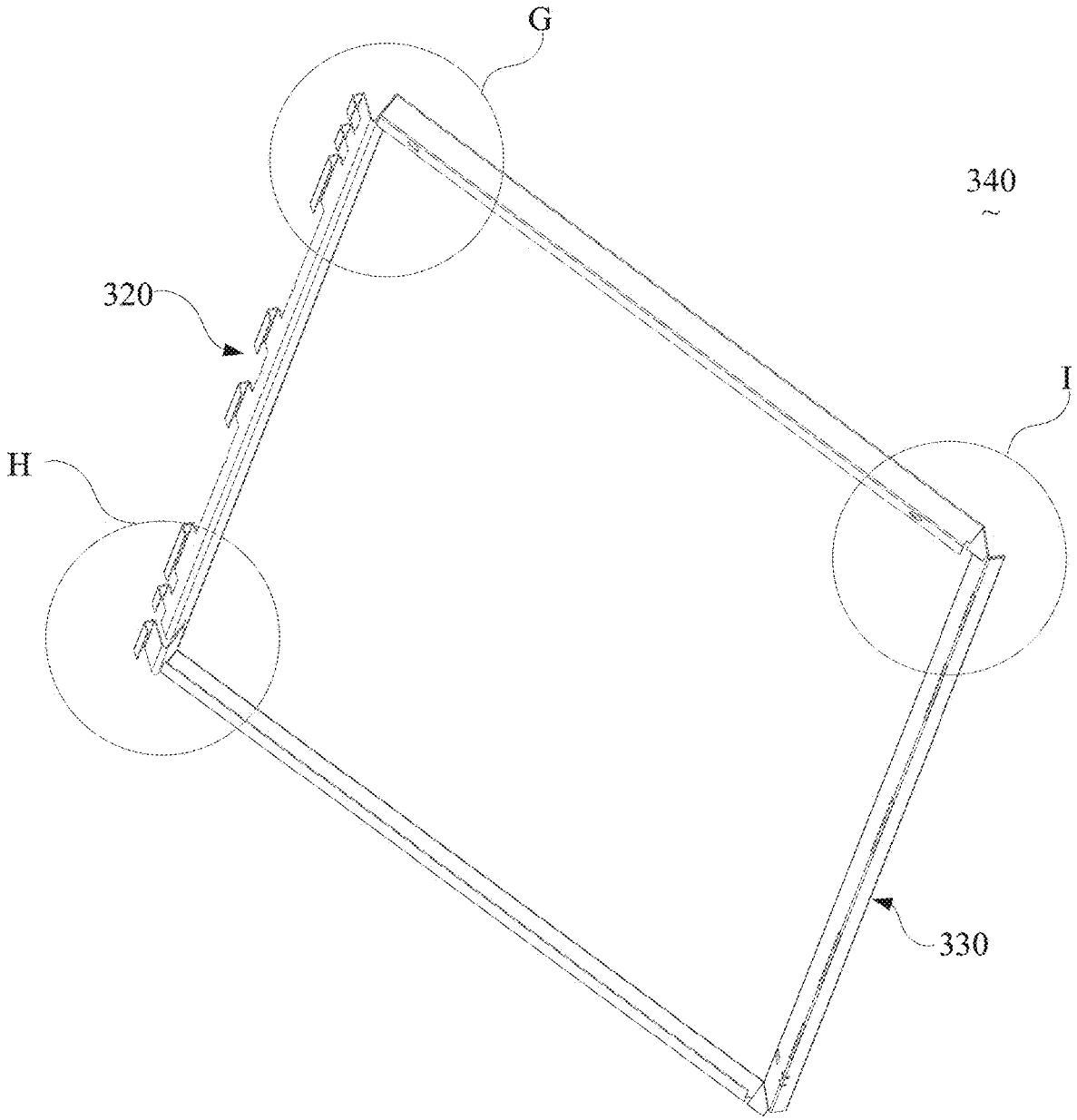
FIG. 13 is a schematic structural view illustrating a first back board according to an embodiment of the application.
Figure 14:
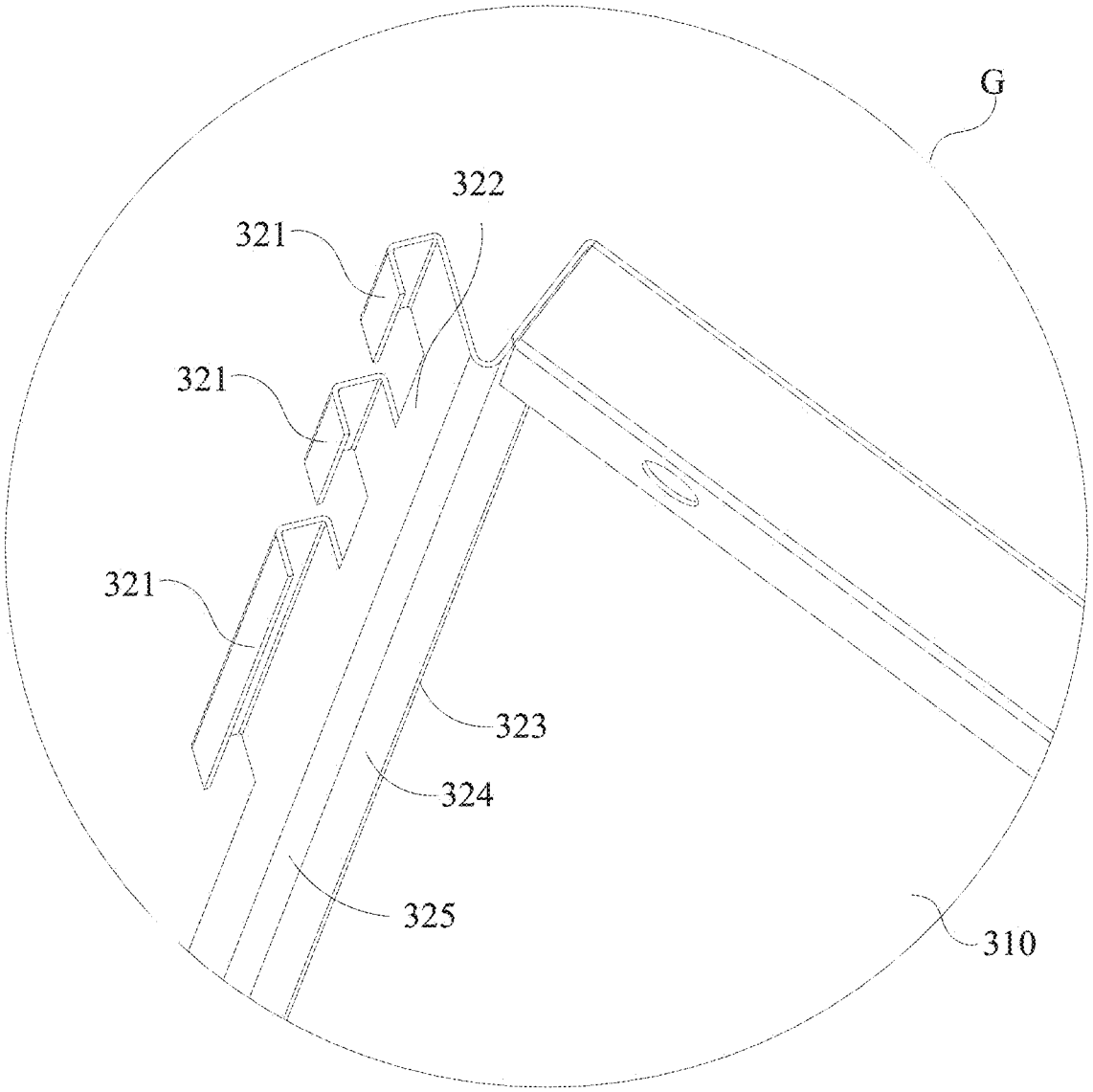
FIG. 14 is an enlarged schematic view of portion G of FIG. 13.
Figure 15:
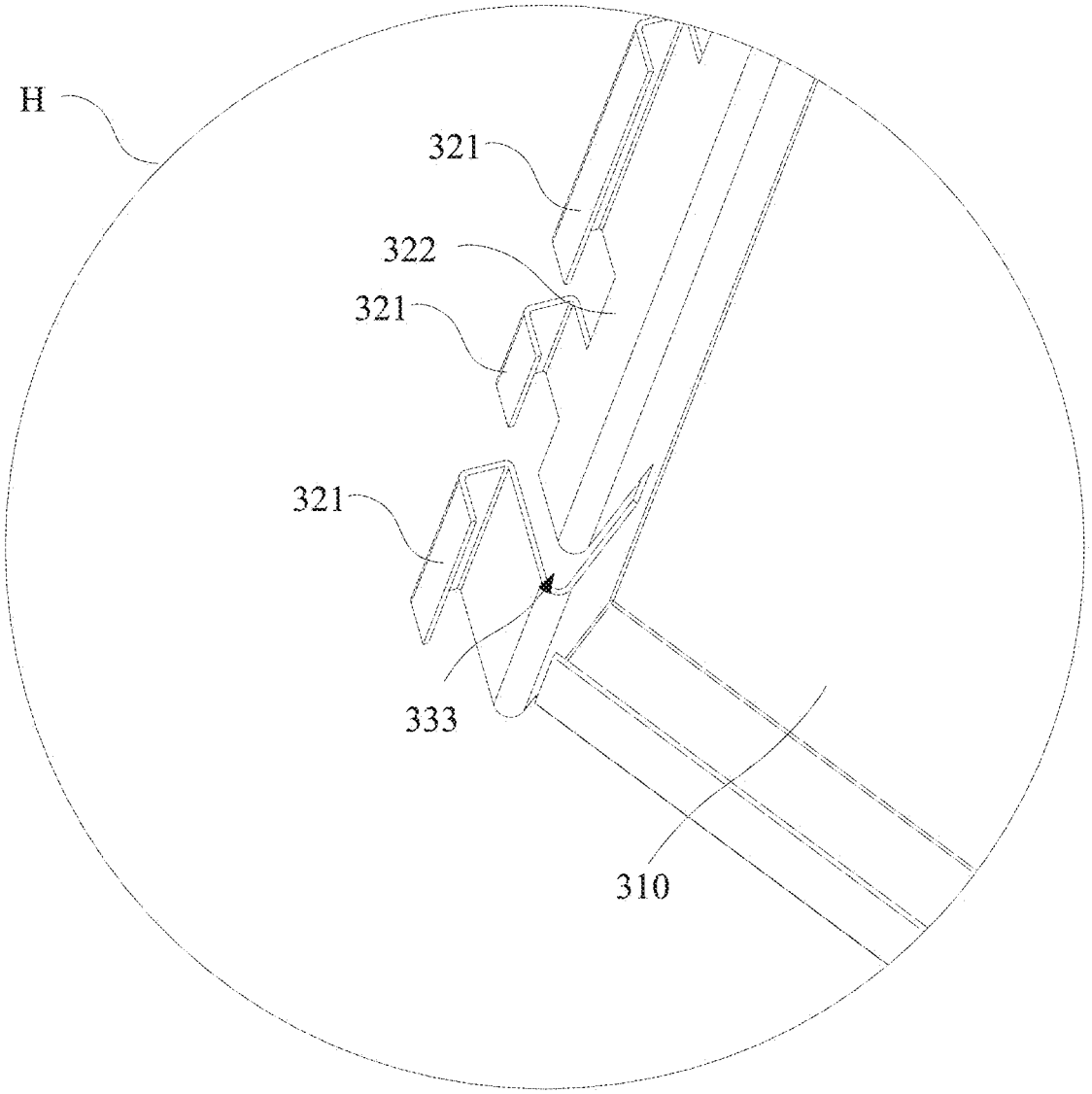
FIG. 15 is an enlarged schematic view of portion H of FIG. 13.

Please referring to FIGS. 13-15, the second turning portion 320 may be further provided with the third limiting portion 322, the third connecting portions 321 may be connected with the back board body 310 through the third limiting portion 322. A portion of the edge of the third limiting portion 322 may extend and bend to provide the third connecting portions 321.

The third connecting portions 321 and corresponding third limiting portion 322 may be designed as a one-piece board, which is integrally formed and has an edge bending to provide the third connecting portions 321.

In the unfolded state of the foldable cabinet, a portion of the edge of the second limiting portion 232 may abut against the third connecting portion 321, and a portion of the edge of the third limiting portion 322 may abut against the second connecting portion 231.

In the folded state of the foldable cabinet, the edge of the second limiting portion 232 does not abut against the third connecting portion 321, and the edge of the third limiting portion 322 does not abut against the second connecting portion 231.

When the foldable cabinet changes from the folded state to the unfolded state, the third connecting portion 321 is rotated and thus the orientation relationship between the third connecting portion 321 and the second connecting portion 231 which are matched with each other changes. Once arriving at unfolded state, the second limiting portion 232 and the third limiting portion 322 limit the second connecting portion 231 and the third connecting portion 321 at the same time, such that the third connecting portion 321 and the second connecting portion 231 cannot continue to rotate relative to each other, whereby the rotation angle of the back board 300 on the side board 200 can be limited.

Figure 4:
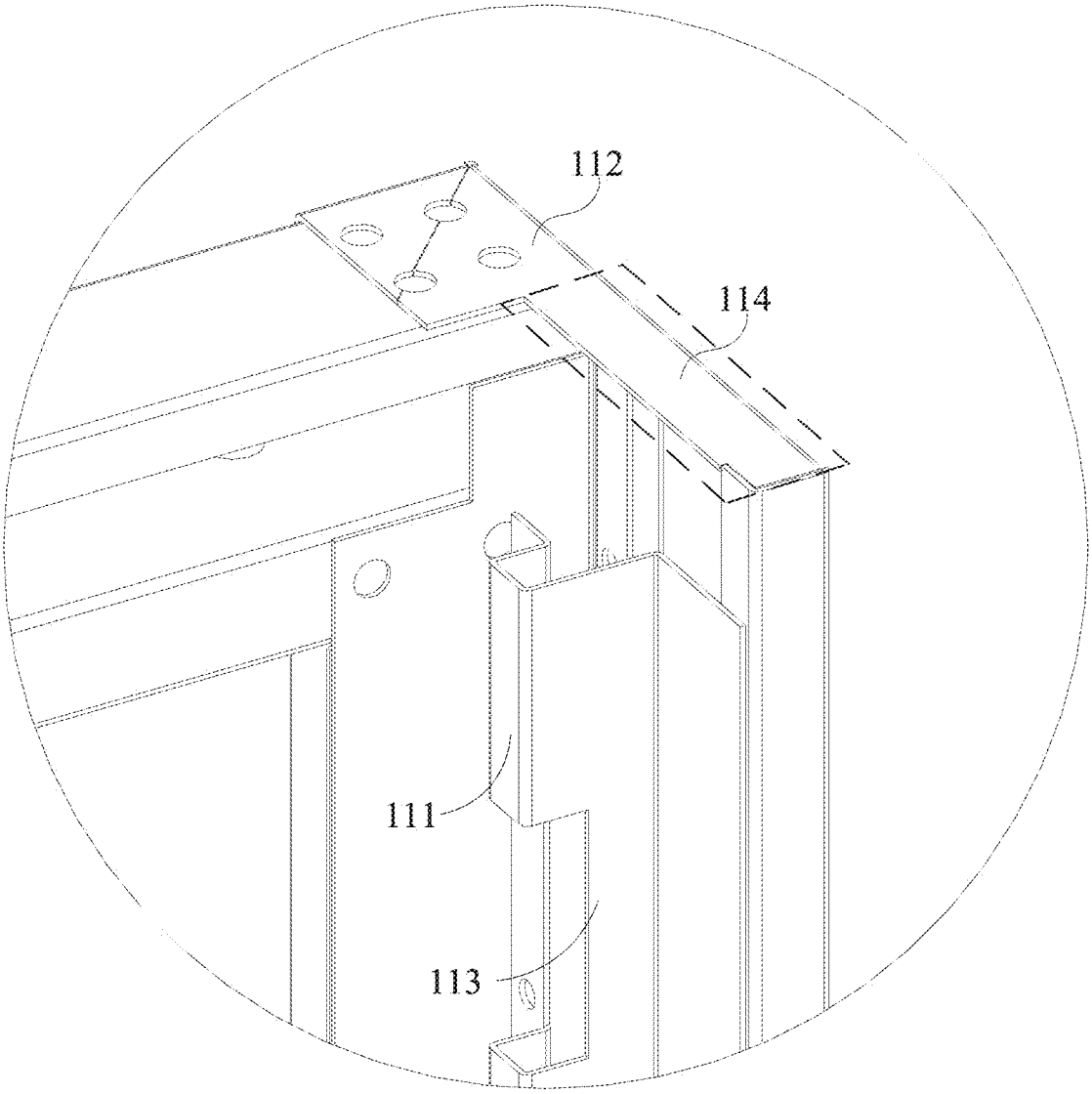
FIG. 4 is a schematic view which illustrates a side frame of FIG. 3 being separated.
Figure 5:
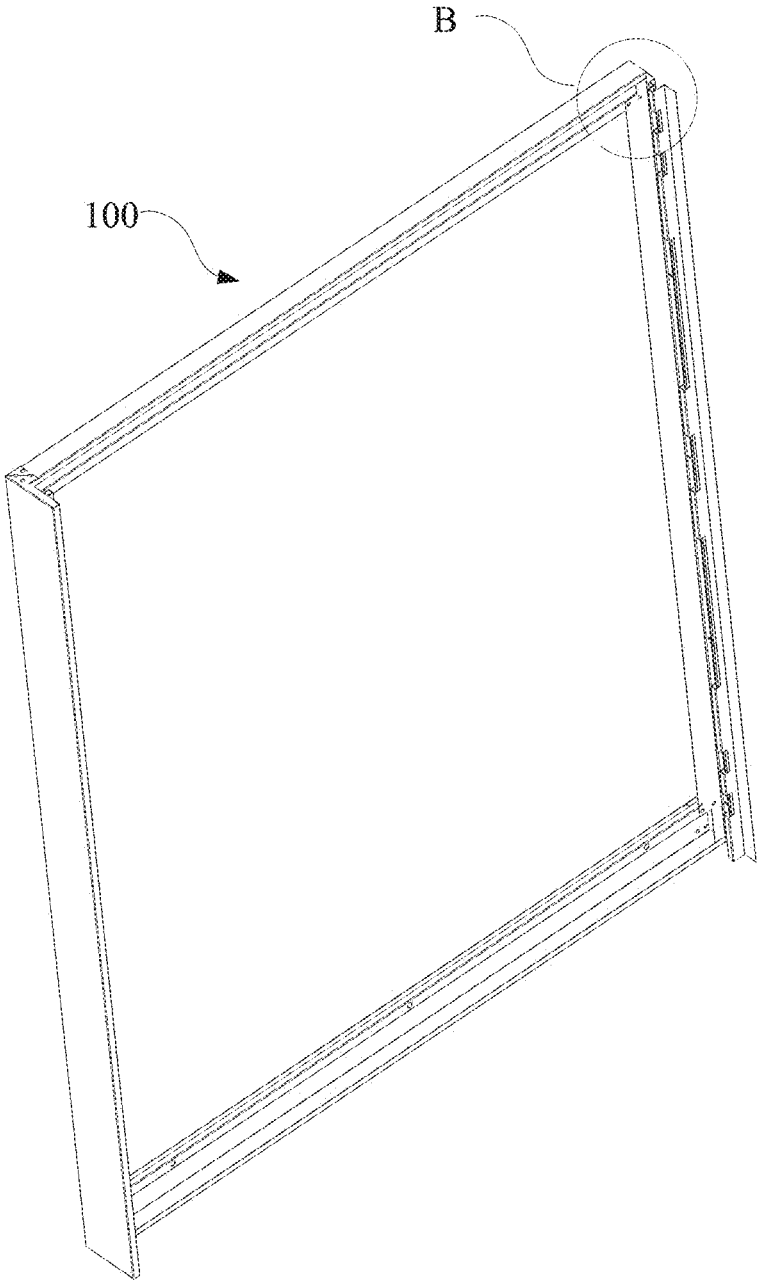
FIG. 5 is a partially schematic structural view illustrating framework according to an embodiment of the application.
Figure 6:
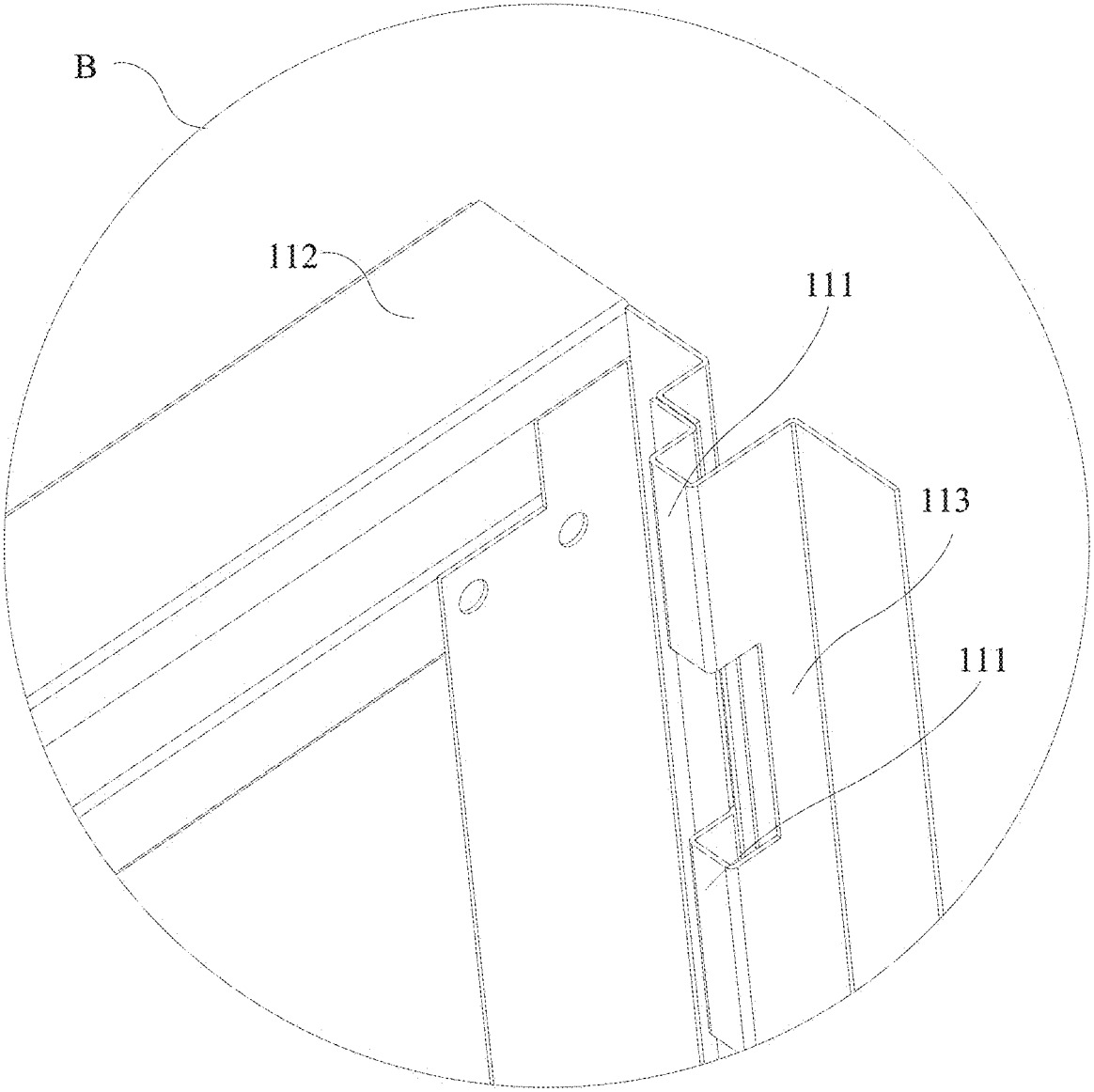
FIG. 6 is an enlarged schematic view of portion B of FIG. 4.

Please referring to FIG. 4, the side frame 110 in some embodiments may be further provided with an extending portion 114 located behind the side frame body 112, and the fifth connecting portions 111 are connected with the extending portion 114 via the first limiting portion 113.

The side frame body 112 may be designed to be integrally formed with the extending portion 114, but not integrally formed with the fifth connecting portions 111 or the first limiting portion 113.

In some embodiments, the side board body 210, the first connecting portion 220, and the first turning portion 230 may be integrally formed; and the back board body 310, the second turning portion 320, and the fourth connecting portion 330 may be integrally formed.

In other words, the side board body 210, the first connecting portion 220, and the first turning portion 230 may be formed by processing of a whole board; and the back board body 310, the second turning portion 320, and the fourth connecting portion 330 may be formed by processing of a whole board.

With such integral arrangement, in order to assemble the framework 100 and the side boards 200, it only needs to pass the first shaft 400 sequentially through the first connecting portions 220 and the fifth connecting portions 111, to complete the assembly and achieve the hinge connection between the framework 100 and the side boards 200. Similarly, the side boards 200 and the back boards 300 can be assembled to achieve the hinge connection by passing the second shaft 500 sequentially through the second connecting portions 231 and the third connecting portions 321, to complete the assembly. With such integral arrangement, it further reduces assembly difficulty, simplifies the hinge structure, and meanwhile reduces mounting difficulty and saves economic costs.

Figure 2:
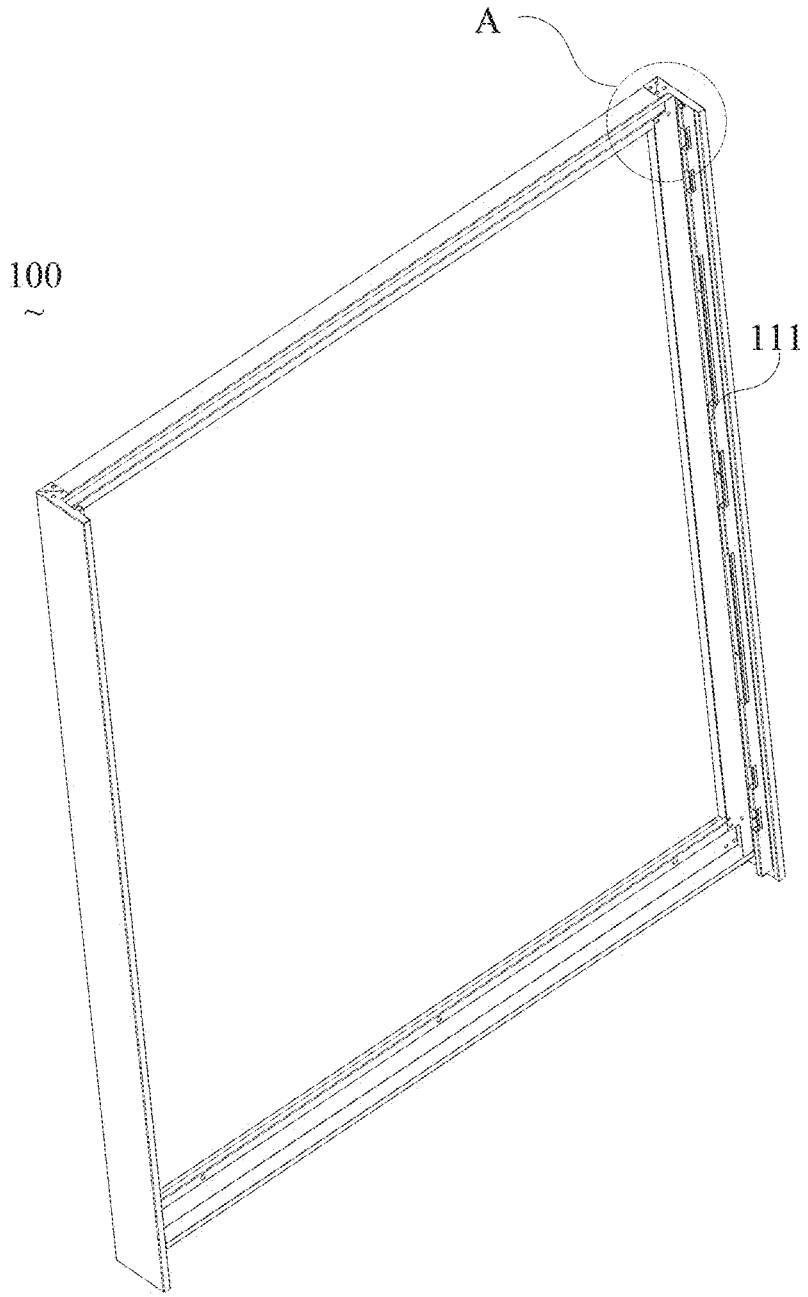
FIG. 2 is a schematic structural view illustrating a framework according to an embodiment of the application.
Figure 3:
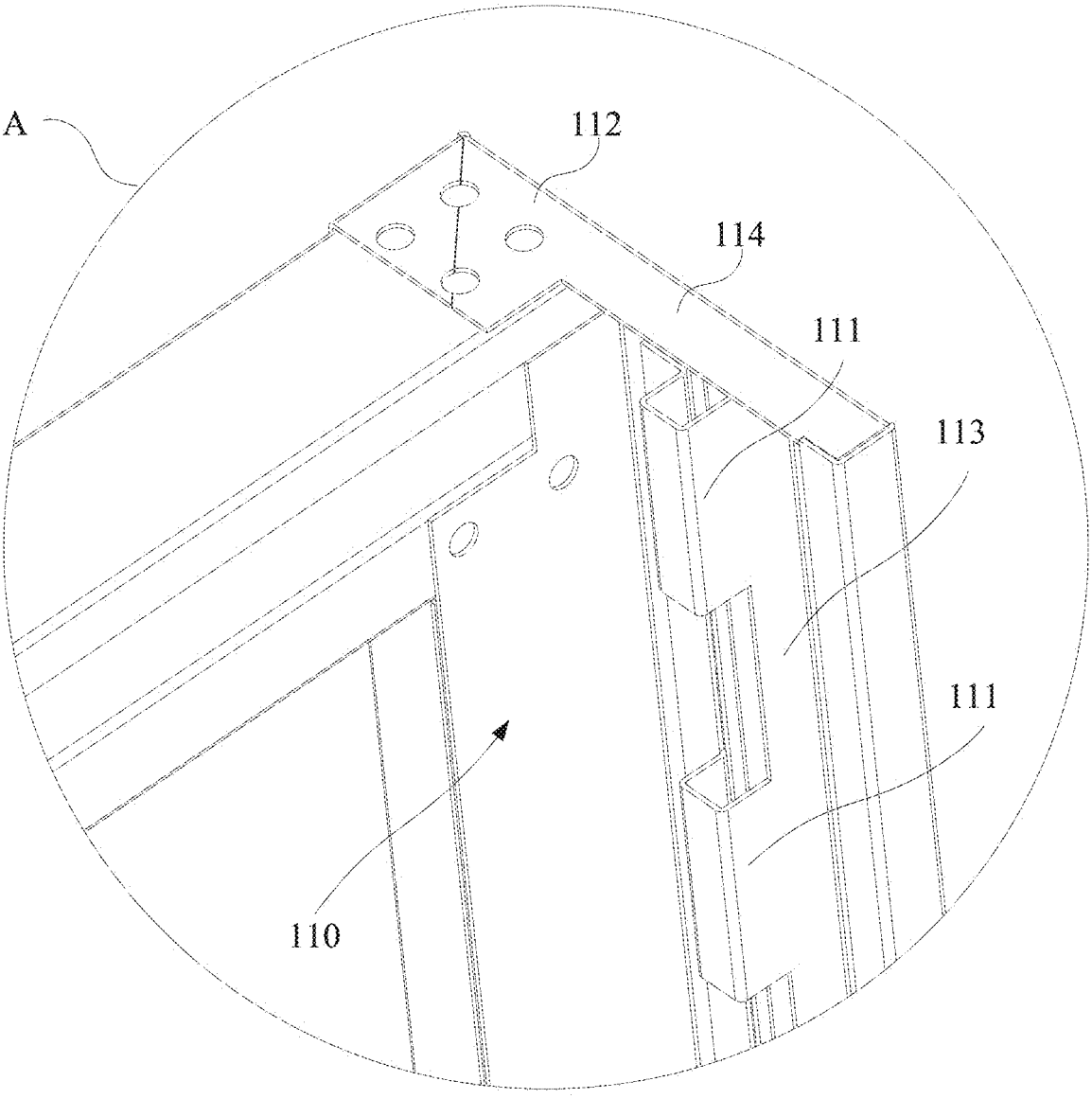
FIG. 3 is an enlarged schematic view of portion A of FIG. 2.

Please referring to FIG. 2, the framework 100 may be designed as a frame for connecting the side boards 200, the top board 600, and the bottom board 700. In some embodiments, the frame may be mounted with cabinet doors.

In the embodiment, the number of the fifth connecting portions 111 may be plural, and the plurality of fifth connecting portions 111 may be spaced apart and disposed along the vertical direction. The interval between each two adjacent fifth connecting portions 111 can make room for the first connecting portion 220. The fifth connecting portions 111 bend to define the second grooves. The groove width, i.e., the size of the fifth connecting portions 111 along the front-rear direction, and the groove height, i.e., the size along the left-right direction, may be adaptively sized depending on the outer diameter of the first shaft 400. The length of the fifth connecting portion 111, i.e., the size along the vertical direction, may be adaptively sized depending on assembly requirements in specific practice. Please referring to FIG. 7, the first connecting portion 220 may be arranged in a similar manner. The plurality of first connecting portions 220 may be spaced apart and disposed along the vertical direction. The interval between each two adjacent first connecting portion 220 can make room for the fifth connecting portion 111. The first groove defined by the bent first connecting portion 220 has a groove width and a groove height which fit the outer diameter of the first shaft 400. The length of the first connecting portion 220, i.e., the size of the first connecting portion 220 along the vertical direction, may be adaptively sized depending on assembly requirements in specific practice.

Figure 11:
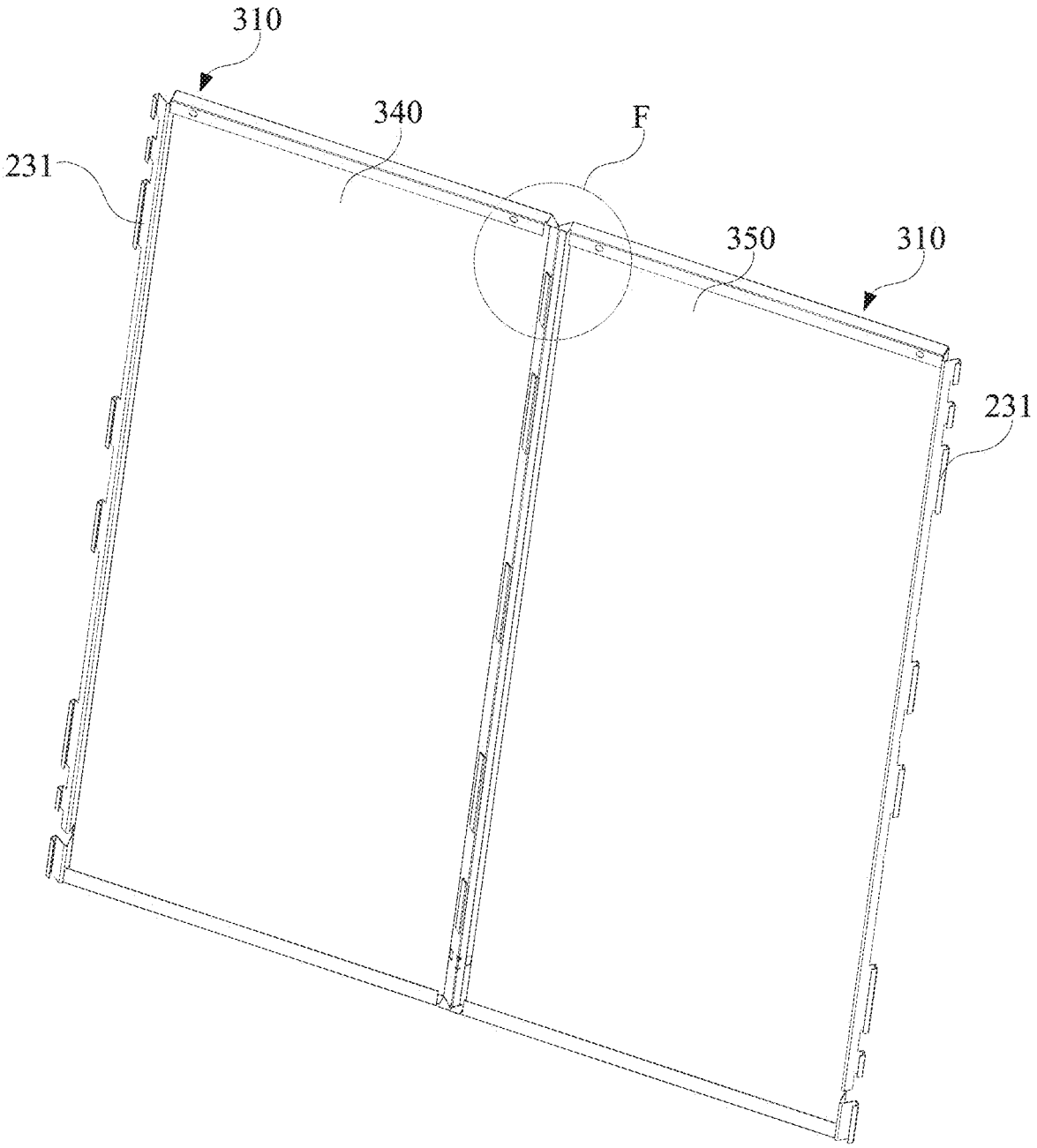
FIG. 11 is a schematic structural view illustrating a back board according to an embodiment of the application.

Please referring to FIGS. 7 and 11, the number of the second connecting portions 231 and the number of the third connecting portions 321 are plural and may be different. The plurality of second connecting portions 231 may be spaced apart and disposed along the vertical direction. The interval between each two adjacent second connecting portions 231 can make room for the third connecting portion 321. In the unfolded state, the second connecting portion 231 and the third connecting portion 321 are arranged in a staggered manner. The third groove defined by the bent second connecting portion 231 has a groove width and a groove height which fit the outer diameter of the second shaft 500. The length of the second connecting portion 231, i.e., the size of the second connecting portion 231 along the vertical direction, may be adaptively sized depending on assembly requirements in specific practice.

Similarly, the plurality of third connecting portion 321 may be spaced apart and disposed along the vertical direction. The interval between each two adjacent third connecting portion 321 can make room for the second connecting portion 231. The fourth groove defined by the bent third connecting portion 321 has a groove width and a groove height which fit the outer diameter of the second shaft 500. The length of the third connecting portion 321, i.e., the size of the third connecting portion 321 along the vertical direction, may be adaptively sized depending on assembly requirements in specific practice.

The first turning portion 230 may be further provided with a first bend 233, a second bend 234, and a first transition board 235. One end of the first transition board 235 may be connected with the side board body 210 via the first bend 233, and the other end of the first transition board 235 may be connected with the second limiting portion 232 via the second bend 234. The side board 200 may bend towards one direction at least twice, to form the side board body 210, the first bend 233, the first transition board 235, the second bend 234, and the second limiting portion 232.

Please referring to FIG. 9, as the first turning portion 230 and the side board body 210 are integrally formed, the first turning portion 230 may be formed by bending a whole board at least twice. As it bends twice in the embodiment, the first bend 233 and the second bend 234 are formed at the two bent portions, respectively. With such arrangement, it further reduces assembly difficulty, simplifies the hinge structure, and meanwhile reduces mounting difficulty and saves economic costs.

The second turning portion 320 may be further provided with a third bend 323, a fourth bend 324, and a second transition board 325. One end of the second transition board 325 may be connected with the back board body 310 via the third bend 323, and the other end of the second transition board 325 may be connected with the third limiting portion 322 via the fourth bend 324. The back board 300 may bend at least twice, towards different directions, to form the side back board body 310, the third bend 323, the second transition board 325, the fourth bend 324, and the third limiting portion 322.

Please referring to FIG. 14, as the second turning portion 320 and the back board body 310 are integrally formed, the second turning portion 320 may be formed by bending a whole board at least twice. As it bends twice in the embodiment, the third bend 323 and the fourth bend 324 are formed at the two bent portions, respectively. With such arrangement, it further reduces assembly difficulty, simplifies the hinge structure, and meanwhile reduces mounting difficulty and saves economic costs.

Herein, the first bend 233 and the second bend 234 are formed by two bending processes towards a same direction, and the third bend 323 and the fourth bend 324 are formed by two bending processes towards different directions. The angles of the third bend 323 and the fourth bend 324 fit with the angles of the first bend 233 and the second bend 234, and the second connecting portion 231, the third connecting portion 321 and the second shaft 500 are concealed inside the foldable cabinet by the first transition board 235.

According to such structure, the second connecting portion 231 and the third connecting portion 321 can be concealed inside the foldable cabinet, and the hinge joint between the back board 300 and the side board 200 would not be exposed. In such a case, it ensures good appearance of the foldable cabinet and improves safety as well.

In addition, the external joint of the side board 200 and the back board 300 is exactly the position where the first turning portion 230 and the second turning portion 320 are directly contacted. Not only can the second connecting portion 231 and the third connecting portion 321 be concealed, but also the male tab can hardly be inserted from the external joint, thereby facilitating privacy protection of the foldable cabinet.

The second bend 234 may be an acute angle, to allow the outer surface of the first transition board 235 to be aligned with the outer surface of the back board body 310.

The outer surface of the first transition board 235 may be aligned with the outer surface of the back board body 310, to facilitate good appearance of the foldable cabinet.

The first connecting portions 220, the second connecting portions 231, the third connecting portions 321, and the fifth connecting portions 111 each has the opening due to inherent characteristics of the bending process. The first connecting portions 220 and the fifth connecting portions 111 can rotate about respective first shaft 40, and the second connecting portions 231 and the third connecting portions 321 can rotate about respective second shaft 500. In such a case, by limiting the relative rotation angles, the defect that the first shaft 400 may fall off from the openings of the first connecting portions 220 and the fifth connecting portions 111 and that the second shaft 500 may fall off from the openings of the second connecting portion 231 and the third connecting portion 321, can be avoided.

In the embodiment, further configurations may be provided to limit relative rotation angles of the side boards 200 on the framework 100.

Please referring to FIGS. 17 and 18, the fifth connecting portion 111 is located between the front and rear ends of the extending portion 114, and the end of the extending portion 114 proximal to the rear side is located at the outer side of the side board body 210, to limit the maximum rotation angle of the side board 200 on the framework 100.

When the side board 200 has been rotated into position in the unfolded state, due to the rear end of the extending portion 114 which is located at the outer side of the side board body 210, the side board 200 can be stopped from continuing to rotate outwards, whereby the maximum rotation angle of the side board 200 on the framework 100 can be limited. It ensures that, at the hinge joint between the side board 200 and the framework 100, the defect that the first shaft 400 may fall off from the openings of the first connecting portion 220 and the fifth connecting portion 111 can be avoided.

In addition, as the fifth connecting portion 111 is located between the front end and the rear end of the extending portion 114, the external joint of the framework 100 of the foldable cabinet corresponds to the edge of the extending portion 114, the edge of the framework 100 and the edge of the side board 200 are staggered, the male tab can hardly be inserted from the external joint, thereby facilitating privacy protection of the foldable cabinet.

In the embodiment, further configurations may be provided to limit relative rotation angles of the back boards 300 on the side boards 200.

In the unfolded state of the foldable cabinet, the second bend 234 abuts against the third bend 323, or the second bend 234 abuts against the second transition board 325, thereby limiting the maximum rotation angle of the back board 300 on the side board 200.

When the back board 300 has been rotated into position in the unfolded state, the second bend 234 abuts against the third bend 323 or the second transition board 325, and the back board 300 can be stopped from continuing to rotate outwards, whereby the maximum rotation angle of the back board 300 on the side board 200 can be limited. It ensures that, at the joint between the back board 300 and the side board 200, the defect that the second shaft 500 may fall off from the openings of the second connecting portion 231 and the third connecting portion 321 can be avoided.

In the folded state, the openings of the first connecting portion 220 and the fifth connecting portion 111 face different directions. The first shaft 400, the first limiting portion, and the side board body 210 have position limiting functions at the same time. Regardless of the direction from which the force is applied to the first connecting portion 220 or the fifth connecting portion 111, a whole stable structure of the first shaft 400, the first connecting portion 220, and the fifth connecting portion 111 can be ensured. In such a case, the first shaft 400 can be prevented from falling off, and the first connecting portion 220 and the fifth connecting portion 111 can remain connected.

Similarly, in the unfolded state, the openings of the second connecting portion 231 and the third connecting portion 321 face different directions. The second shaft 500, the second limiting portion 232, and the third limiting portion 322 have position limiting functions at the same time. Regardless of the direction from which the force is applied to the second connecting portion 231 or the third connecting portion 321, a whole stable structure of the second shaft 500, the second connecting portion 231, and the third connecting portion 321 can be ensured. In such a case, the second shaft 500 can be prevented from falling off, and the second connecting portion 231 and the third connecting portion 321 can remain connected.

During the transition between the folded state and the unfolded state, the first shaft 400 would not fall off, and the first connecting portion 220 and the fifth connecting portion 111 can remain connected; the second shaft 500 would not fall off, and the second connecting portion 231 and the third connecting portion 321 can remain connected.

When the foldable cabinet is in the unfolded state, the opening of the first groove of the first connecting portion 220 faces backwards, the opening of the first groove of the first connecting portion 220 is provided at the side of the side board body 210 which faces the inner side of the foldable cabinet, the opening of the second groove of the fifth connecting portion 111 faces the outer side of the foldable cabinet, and the opening of the second groove of the fifth connecting portion 111 is located in front of the first limiting portion 113.

Consequently, the side board body 210 and the first limiting portion 113 not only have the function of ensuring a whole stable structure of the first shaft 400, the first connecting portion 220, and the fifth connecting portion 111, but also limit the maximum rotation angle between the first connecting portion 220 and the fifth connecting portion 111.

When the foldable cabinet is in the folded state, the opening of the first groove of the first connecting portion 220 faces right towards the inner side of the foldable cabinet, the opening of the first connecting portion 220 is located in front of the side board body 210, the opening of the second groove of the fifth connecting portion 111 and the opening of the first groove of the first connecting portion 220 face different directions, and the opening of the second groove of the fifth connecting portion 111 is located in front of the first limiting portion 113.

Consequently, the function of ensuring the whole stable structure of the first shaft 400, the first connecting portion 220, and the fifth connecting portion 111 can be achieved after it has changed into the unfolded state from the folded state. After entering the unfolded state, the first connecting portion 220 and the fifth connecting portion 111 can be stopped from continuing to rotate relative to each other.

When the foldable cabinet is in the unfolded state, the opening of the third groove of the second connecting portion 231 faces a direction intersecting with the front-rear direction, the opening of the third groove of the second connecting portion 231 is inclined towards the back board 300, the opening of the third groove of the second connecting portion 231 is located at the side of the second limiting portion 232 facing away from the back board 300, the opening of the fourth groove of the third connecting portion 321 faces a direction intersecting with the front-rear direction, the opening of the fourth groove of the third connecting portion 321 is inclined towards the inner side of the foldable cabinet, and the opening of the fourth groove of the third connecting portion 321 is located in front of the third limiting portion 322.

In the unfolded state, the openings of the second connecting portion 231 and the third connecting portion 321 face different directions. The second shaft 500, the second limiting portion 232, and the third limiting portion 322 have position limiting functions at the same time. Regardless of the direction from which the force is applied to the second connecting portion 231 and the third connecting portion 321, a whole structure of the second shaft 500, the second connecting portion 231, and the third connecting portion 321 can be ensured. In such a case, the second shaft 500 can be prevented from falling off, and the second connecting portion 231 and the third connecting portion 321 can remain connected.

When the foldable cabinet is in the folded state, the opening of the third groove of the second connecting portion 231 faces a direction intersecting with the left-right direction, the opening of the third groove of the second connecting portion 231 is inclined towards the back board 300, the opening of the third groove of the second connecting portion 231 is located behind the third limiting portion 322, the opening of the fourth groove of the third connecting portion 321 faces a direction intersecting with the left-right direction, the opening of the fourth groove of the third connecting portion 321 is inclined towards the side board 200, and the opening of the fourth groove of the third connecting portion 321 is located behind the third limiting portion 322.

Similarly, in the folded state, the openings of the second connecting portion 231 and the third connecting portion 321 face different directions. The second shaft 500, the second limiting portion 232, and the third limiting portion 322 have position limiting functions at the same time. Regardless of the direction from which the force is applied to the second connecting portion 231 or the third connecting portion 321, a whole structure of the second shaft 500, the second connecting portion 231, and the third connecting portion 321 can be ensured. In such a case, the second shaft 500 can be prevented from falling off, and the second connecting portion 231 and the third connecting portion 321 can remain connected.

During the transition between the folded state and the unfolded state, similarly, a whole stable structure of the second shaft 500, the second connecting portion 231, and the third connecting portion 321 can be ensured. In such a case, the second shaft 500 would not fall off, the second connecting portion 231 and the third connecting portion 321 can remain connected.

In the embodiment, when the foldable cabinet is in the folded state, the back board 300 is located at the side of the side board 200 facing the framework 100. That is, the back board 300 is located between the side board 200 and the framework 100.

In the folded state, please referring to FIGS. 24-26, the back board 300 is superposed on the inner side of the foldable cabinet. To change from the folded state to the unfolded state, it only needs to rotate approximately 90°, to ensure the openings of the second connecting portion 231 and the third connecting portion 321 always face different directions, such that the second shaft 500 would not fall off from the second connecting portion 231 and the third connecting portion 321.

If the back board 300 is arranged at the side of the side board 200 facing away from the framework 100, the back board 300 needs to rotate approximately 270° to change from the folded state to the unfolded state. If the case that the relative rotation angle is 270°, there must be an angle at which the openings of the second connecting portion 231 and the third connecting portion 321 face a same direction, and thus the defect that the second shaft 500 may fall off from the openings of the second connecting portion 231 and the fourth groove of the third connecting portion 321 cannot be avoided.

In the embodiment, the two back boards 300 are respectively referred to as the first back board 340 and the second back board 350, the fourth connecting portion 330 of the first back board 340 is referred to as the first matching portion 331, the fourth connecting portion 330 of the second back board 350 is referred to as the second matching portion 332, and the first matching portion 331 and the second matching portion 332 are connected in a rotatable manner within a certain angle.

The first matching portion 331 and the second matching portion 332 are formed by bending the edge of the first back board 340 and the edge of the second back board 350.

Figure 12:
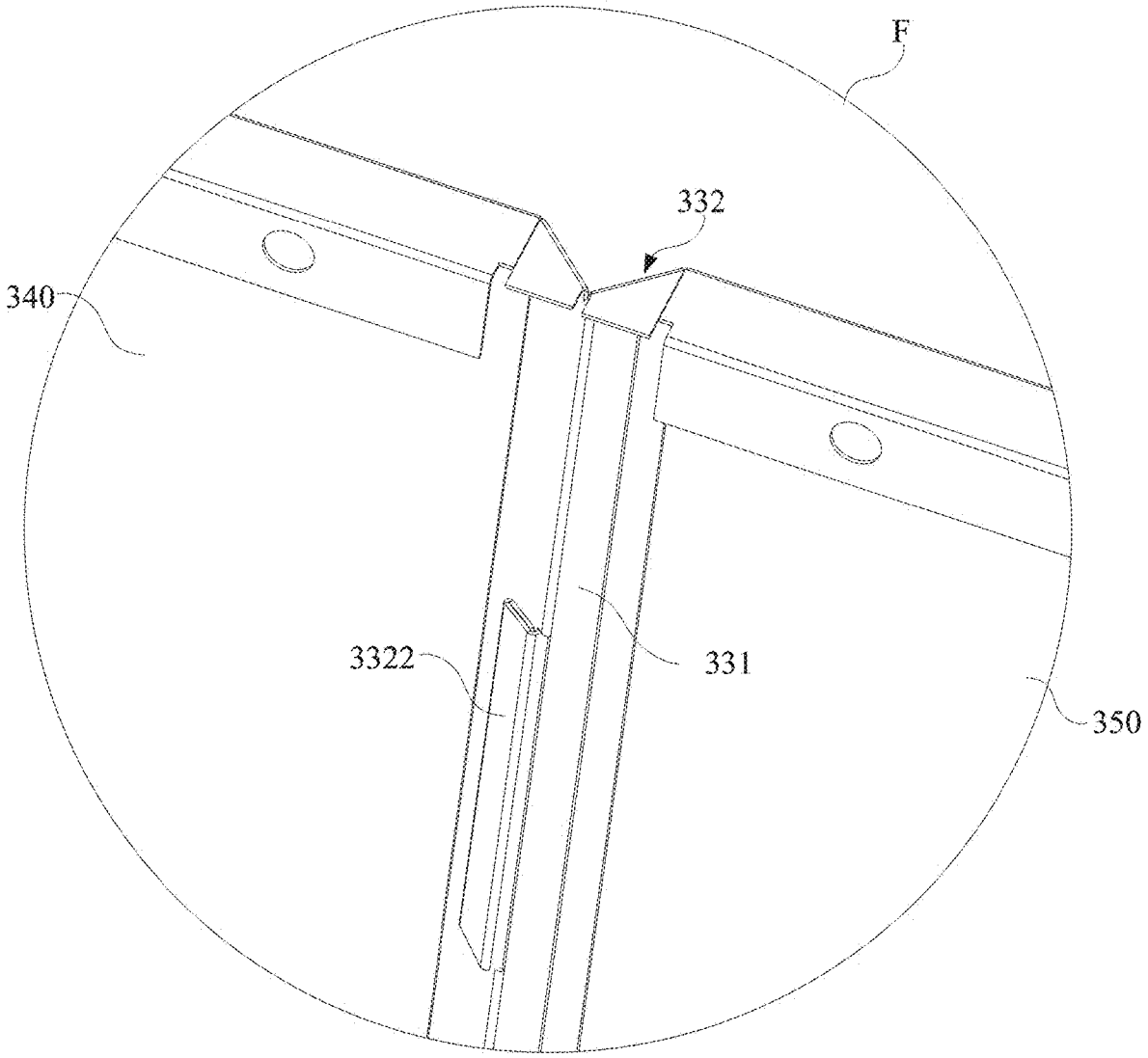
FIG. 12 is an enlarged schematic view of portion F of FIG. 11.

In the unfolded state, please referring to FIGS. 11 and 12, the first back board 340 and the second back board 350 are connected with each other.

In the folded state of the foldable cabinet, please referring to FIGS. 24 and 25, the first back board 340 and the second back board 350 are not connected, however, the first back board 340 and the second back board 350 are respectively hingedly connected with the two side boards 200.

In particular, in order to fold the foldable cabinet, the top board 600 and the bottom board 700 may be removed respectively. Please referring to FIGS. 30-31, the first back board 340 and the second back board 350 may be disconnected from each other, the first back board 340 and the second back board 350 may be respectively rotated towards respective hingedly connected side board 200 until they are superposed thereon, and the two side boards 200 may be rotated towards the framework 100 until they are superposed thereon. Then, the top board 600 and the bottom board 700 may be superposed on the assembly of the framework 100, the side board 200, the first back board 340, and the second back board 350, whereby the foldable cabinet enters the folded state.

Figure 32:
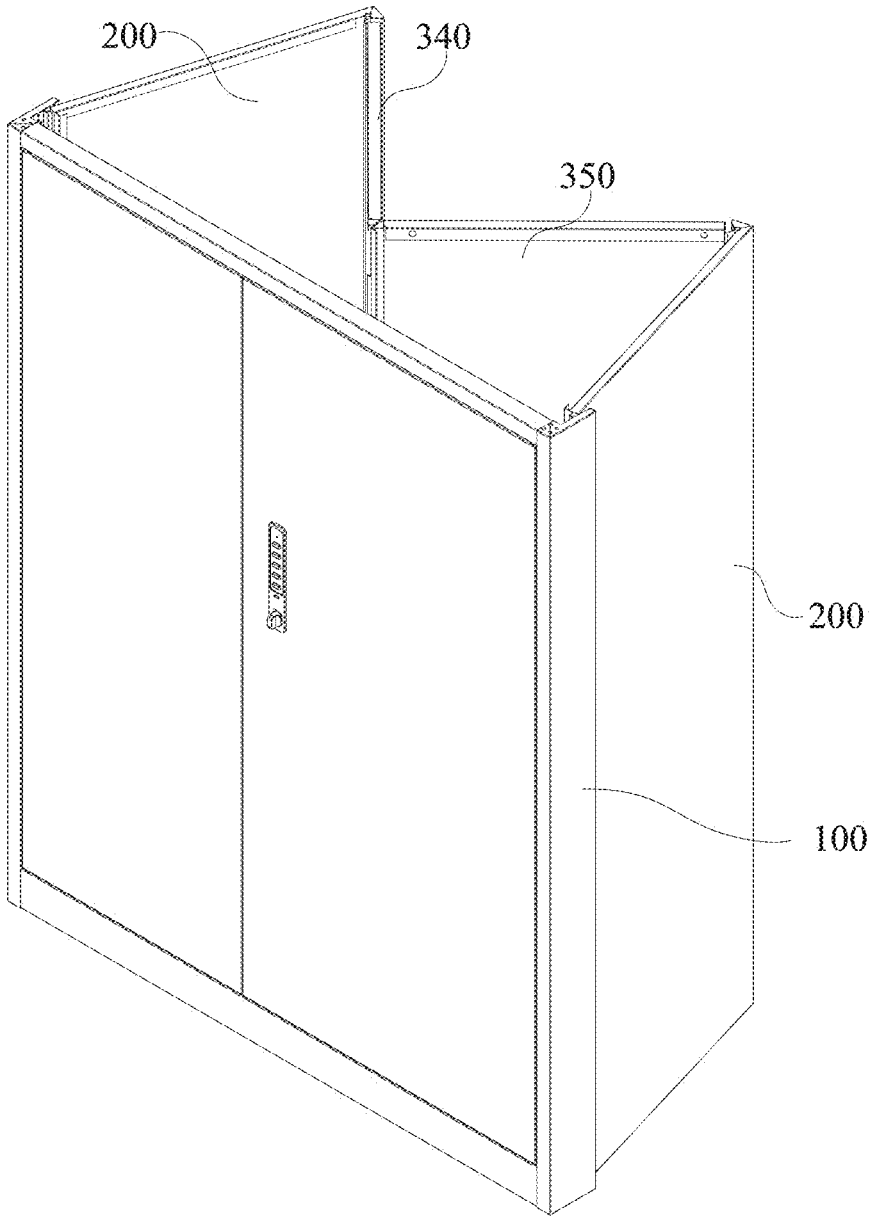
FIG. 32 is a schematic view which illustrates a foldable cabinet according to an embodiment of the application transitioning from a folded state to an unfolded state, with a first back board and a second back board being connected.
Figure 33:
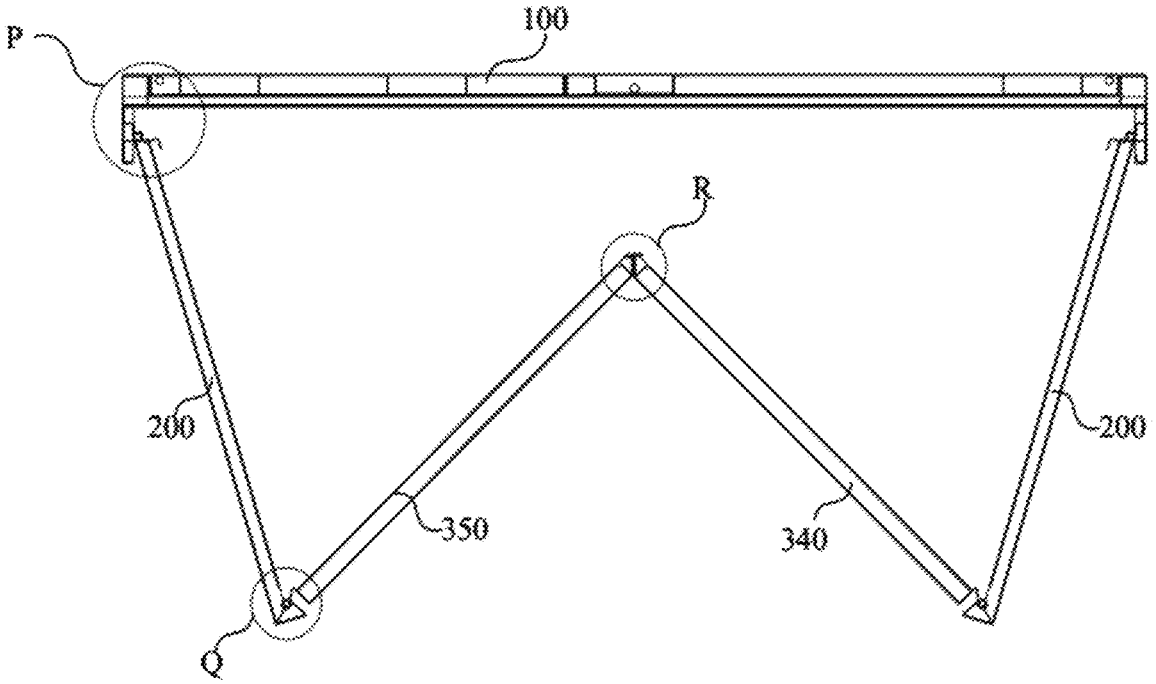
FIG. 33 is a top view of the structure illustrated in FIG. 32.
Figure 34:
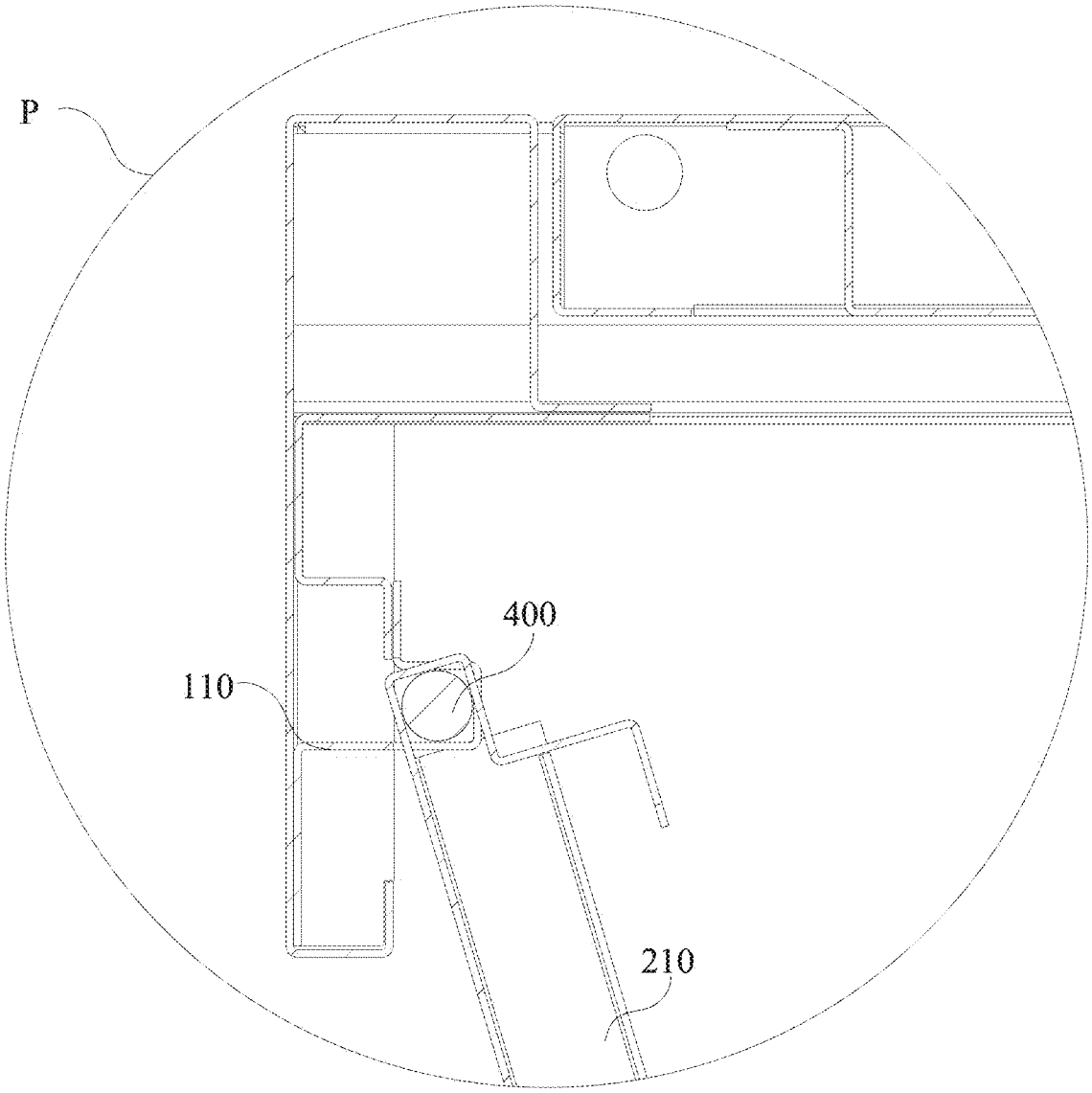
FIG. 34 is an enlarged schematic view of portion P of FIG. 33.
Figure 35:
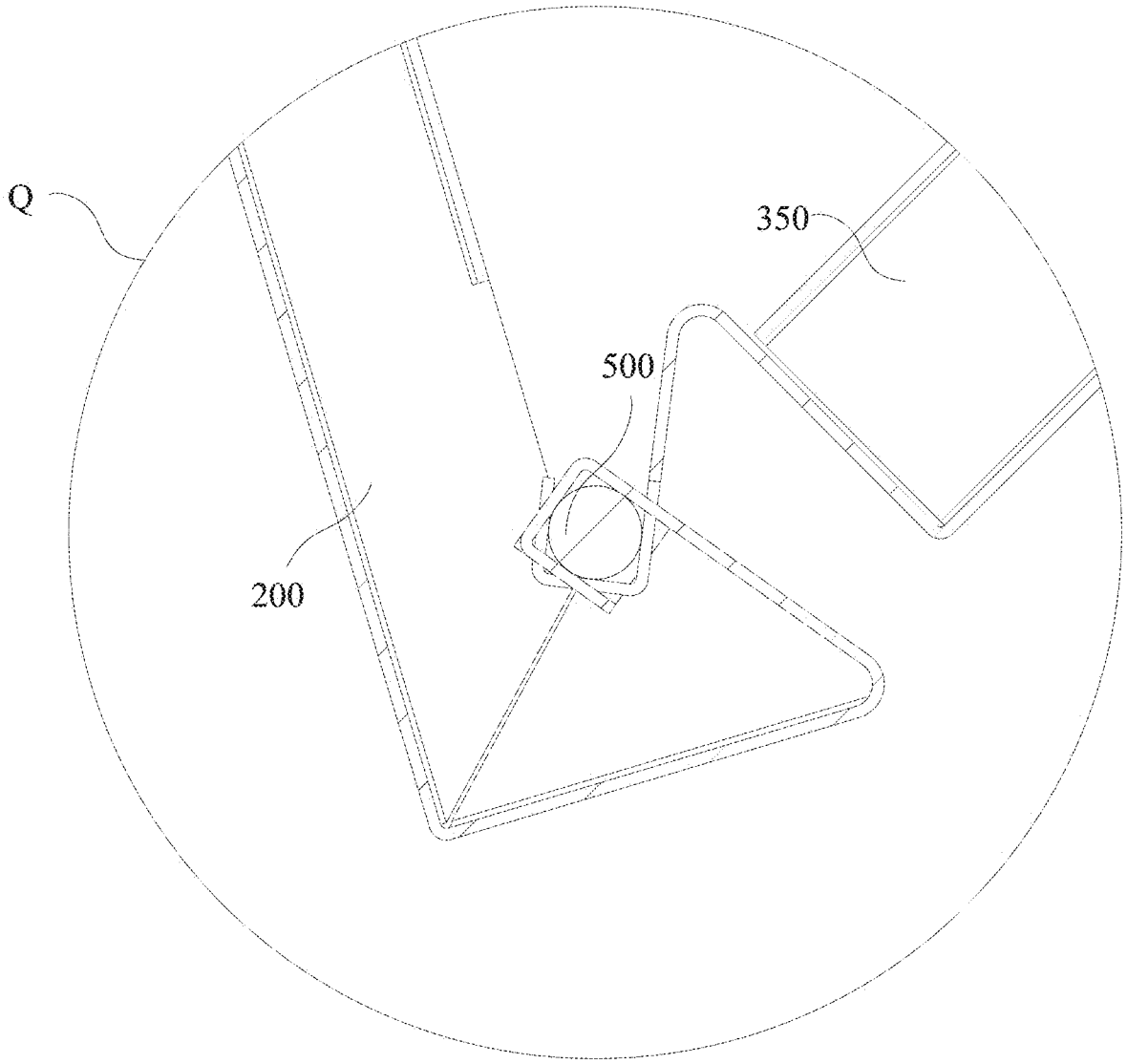
FIG. 35 is an enlarged schematic view of portion Q of FIG. 33.

When it needs to assemble the foldable cabinet, please referring to FIGS. 32-33, it needs to reversely rotate the two side boards 200 and the first back board 340 and the second back board 350 which are superposed on respective side board 200 respectively, and then reversely rotate the first back board 340 and the second back board 350, and connect the first back board 340 and the second back board 350 in such a manner that the framework 100, the two side boards 200, the first back board 340, and the second back board 350 are unfolded in a cuboid shape. Then, please referring to FIGS. 37-38, the top board 600 and the bottom board 700 may be respectively mounted, whereby the foldable cabinet may be unfolded to enter the unfolded state.

The first matching portion 331 may be provided with slots 3311.

The second matching portion 332 may be provided with tabs 3321 corresponding to the slots 3311. The tabs 3321 may be inserted in the slots 3311 to allow the tabs 3321 to rotate a certain angle in the slots 3311. In such a case, a detachable connection between the first matching portion 331 and the second matching portion 332 can be provided.

When the planes in which the back board bodies 310 of the first back board 340 and the second back board 350 lie are perpendicular to each other, the tabs 3321 can get in or out of the slots 3311.

Please referring to FIGS. 13-16, the third connecting portion 321 and the fourth connecting portion 330 of the first back board 340 are respectively provided on the edges of the first back board 340 opposite to each other.

Figure 21:
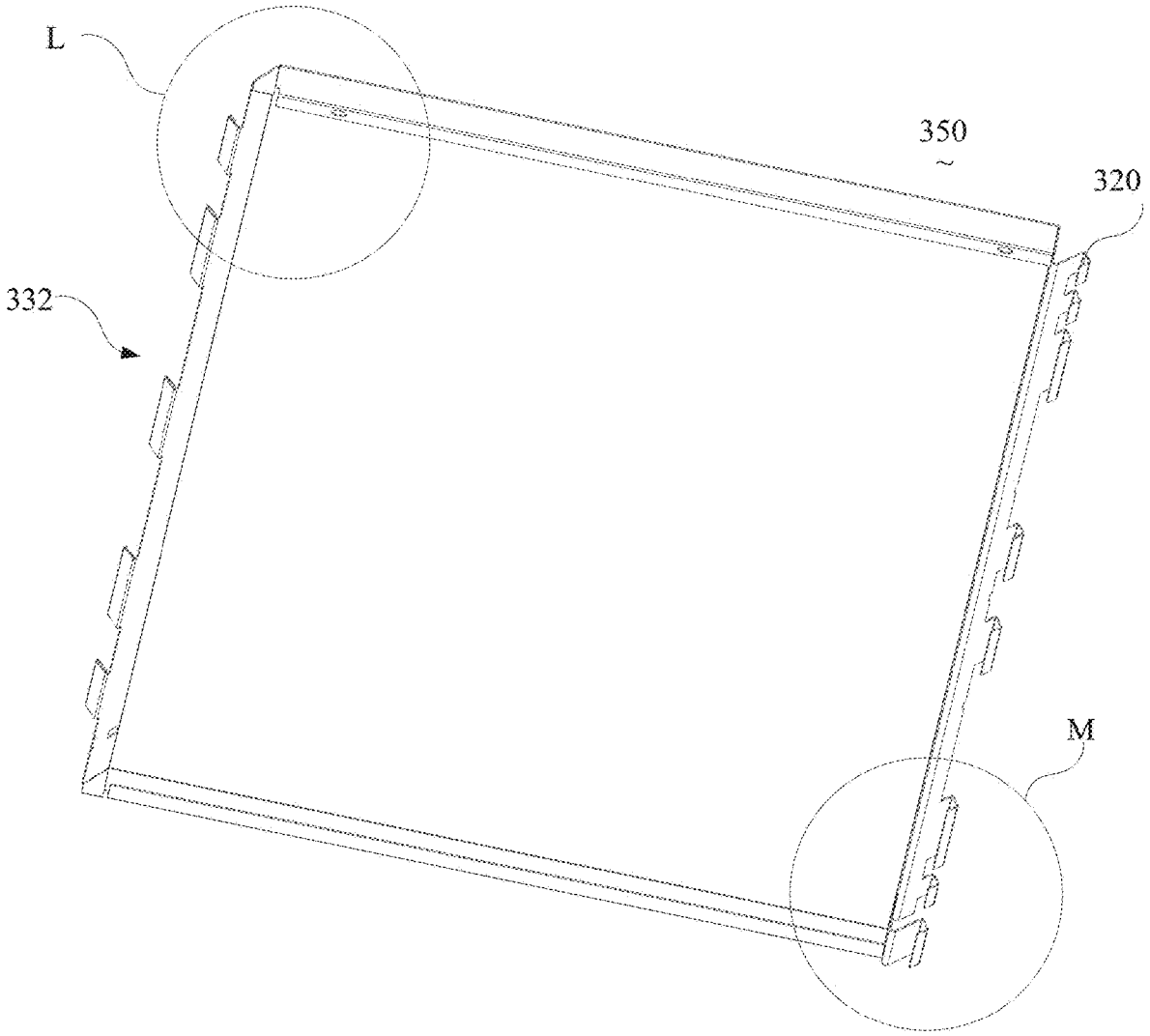
FIG. 21 is a schematic structural view illustrating a second back board according to an embodiment of the application.
Figure 22:
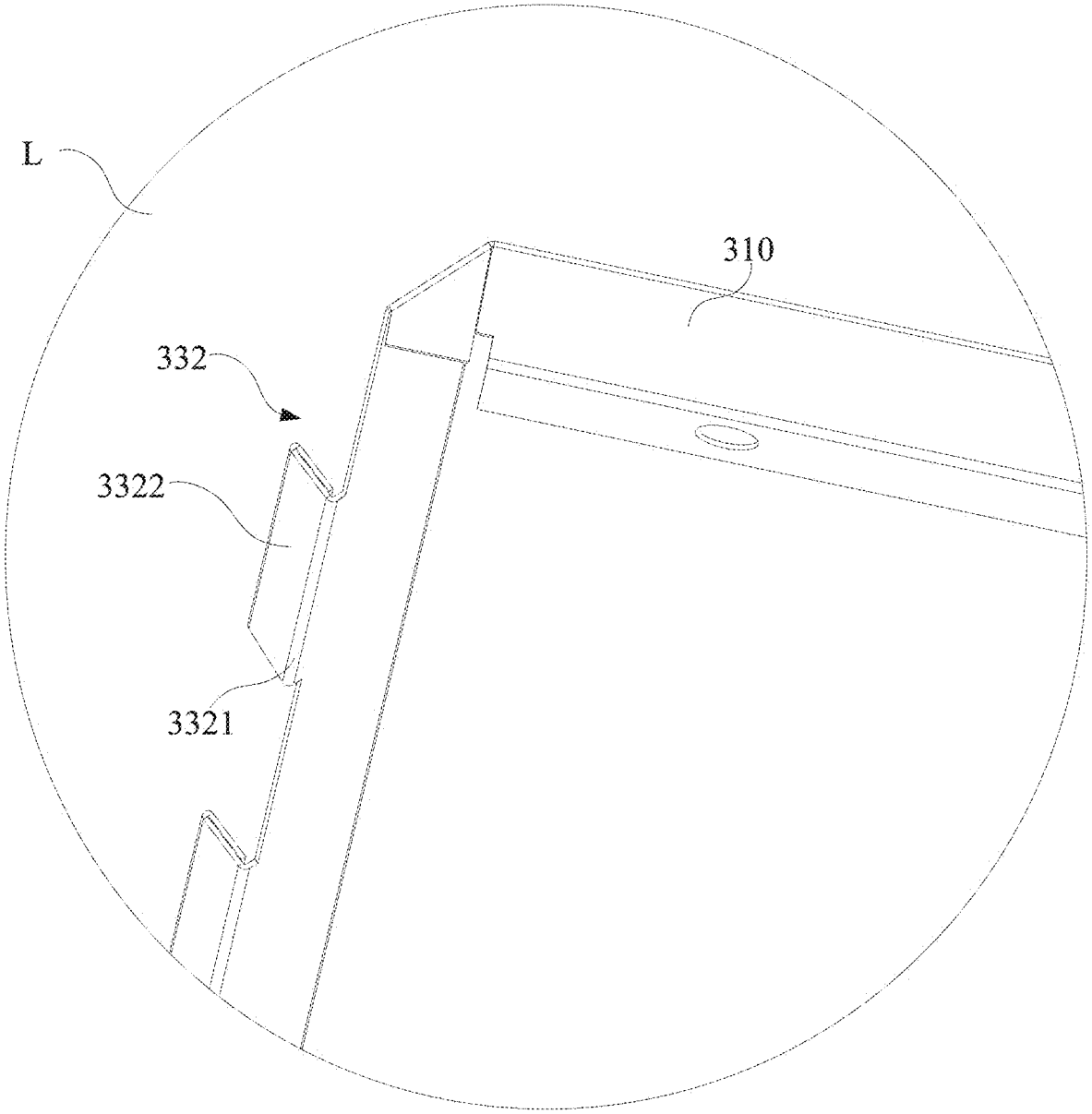
FIG. 22 is an enlarged schematic view of portion L of FIG. 21.
Figure 23:
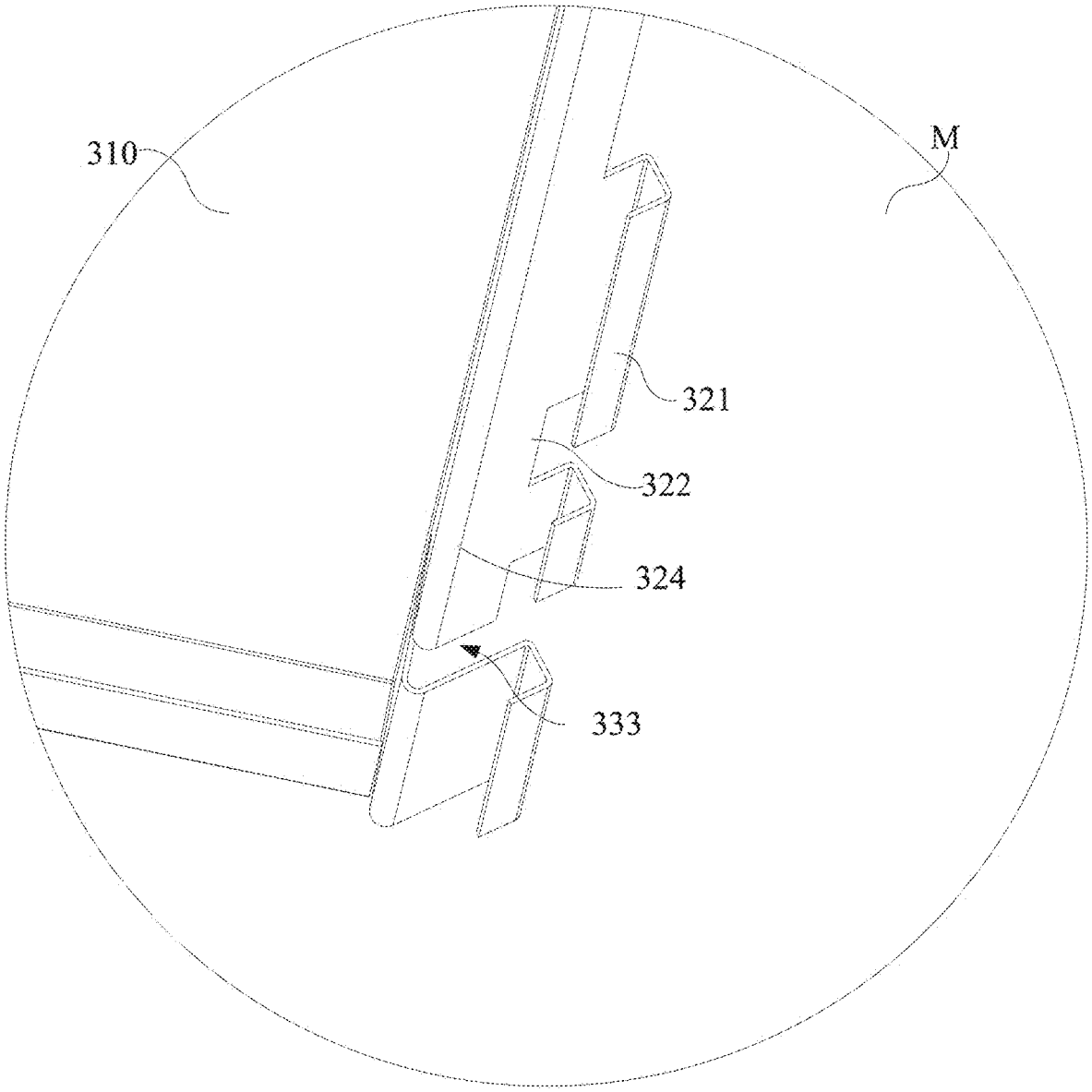
FIG. 23 is an enlarged schematic view of portion M of FIG. 21.

Please referring to FIGS. 21-23, the third connecting portion 321 and the fourth connecting portion 330 of the second back board 350 are respectively provided on the edges of the second back board 350 opposite to each other.

When the tabs 3321 are inserted in the slots 3311, the first back board 340 and the second back board 350 are connected with each other. Once the tabs 3321 are removed from the slots 3311, the first back board 340 and the second back board 350 are disconnected.

Figure 16:
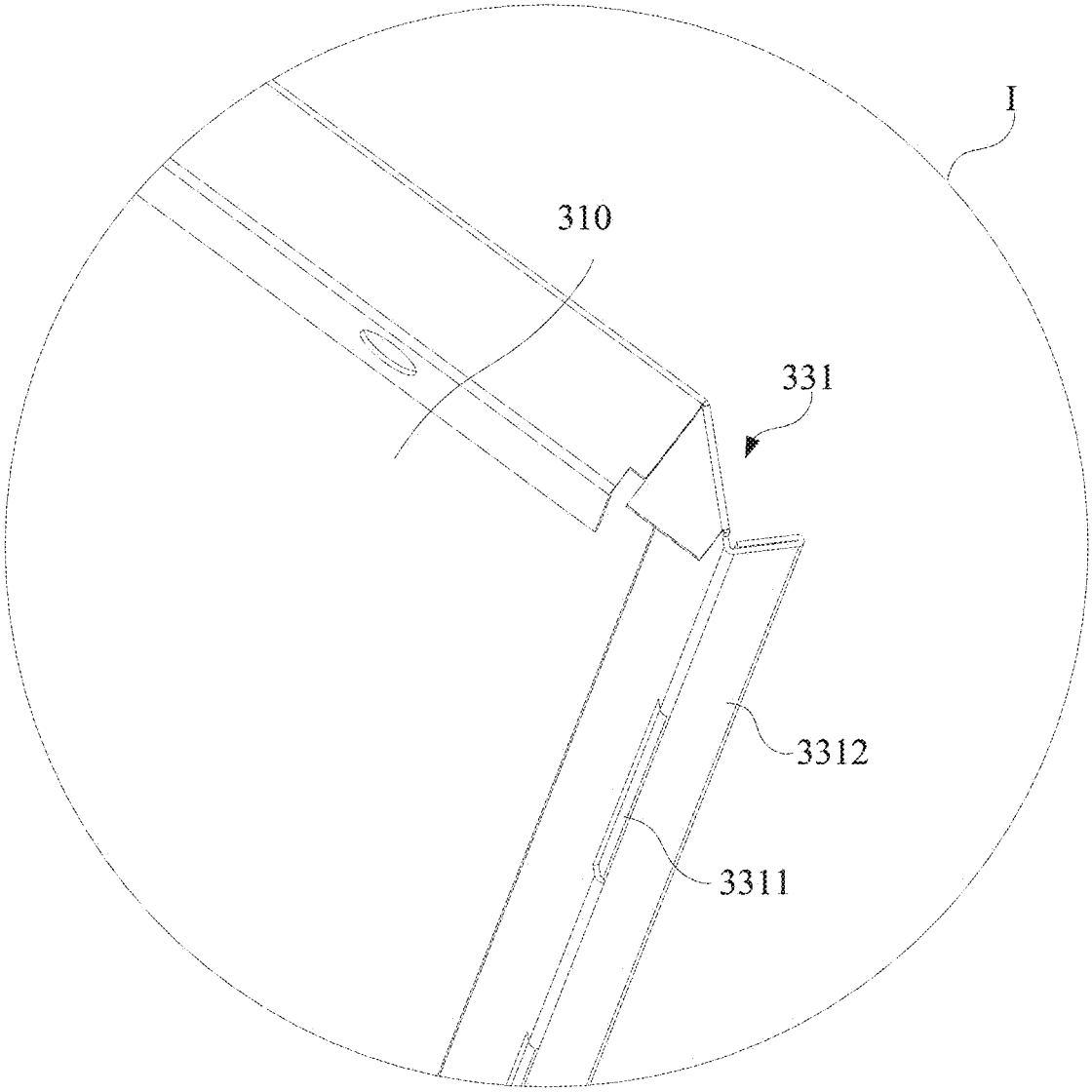
FIG. 16 is an enlarged schematic view of portion I of FIG. 13.
Figure 36:
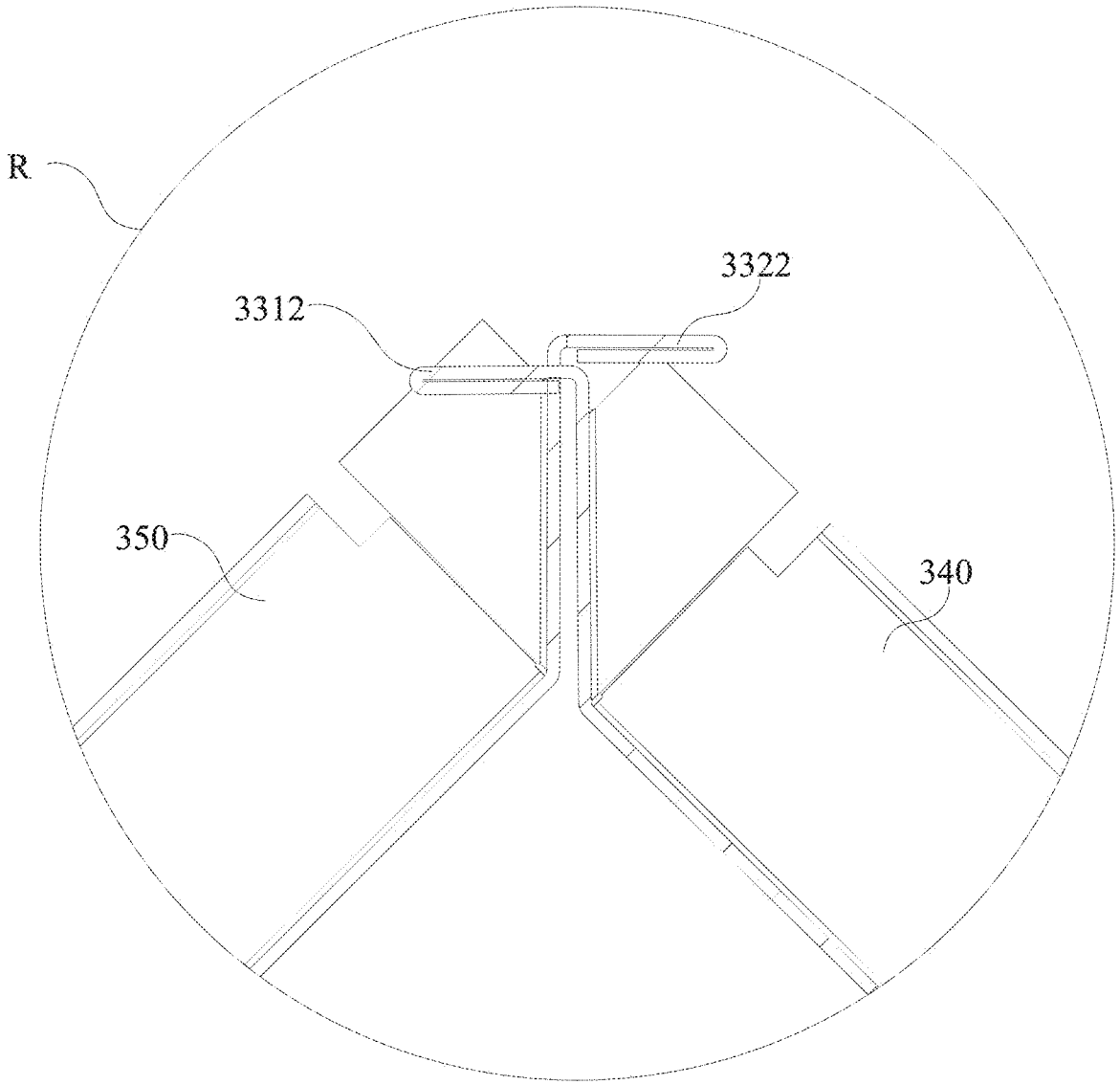
FIG. 36 is an enlarged schematic view of portion R of FIG. 33.
Figure 37:
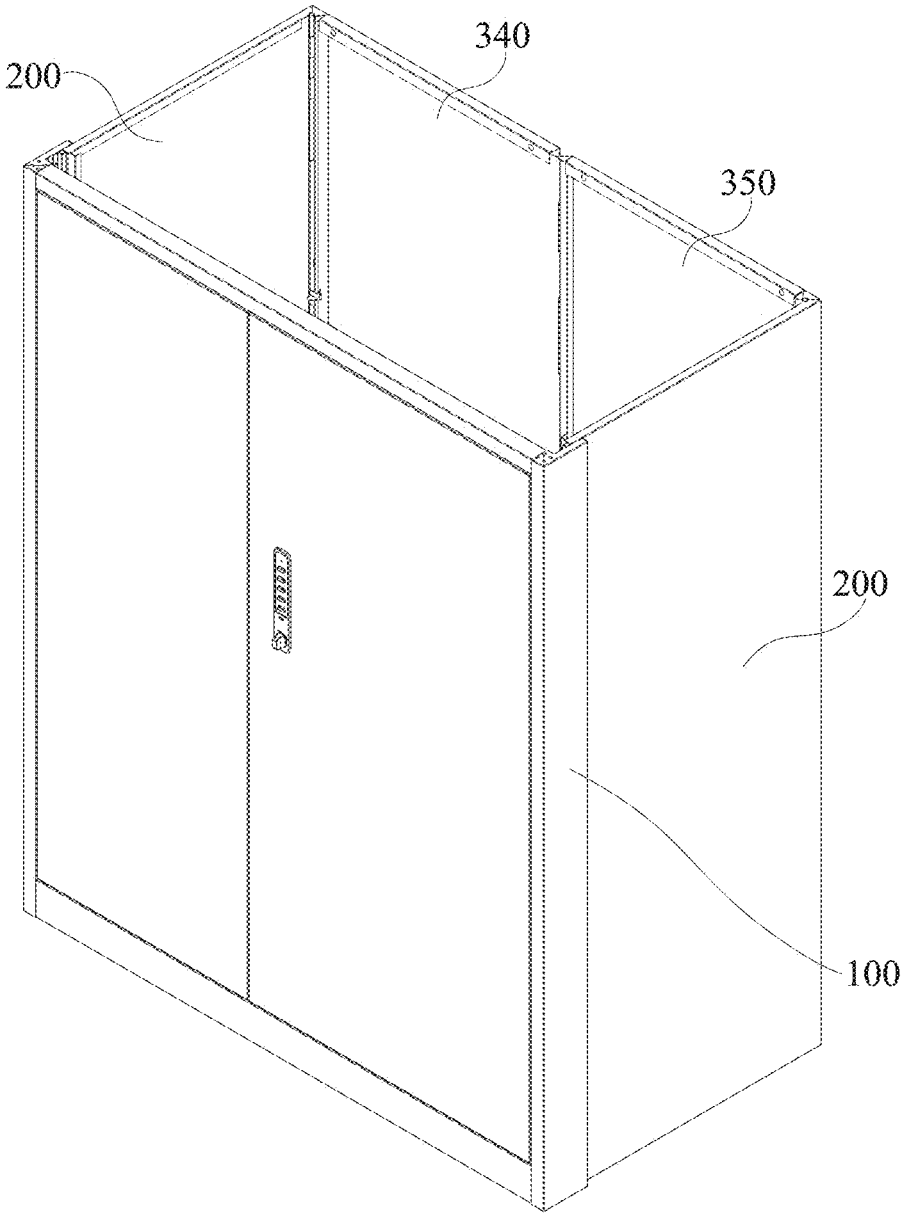
FIG. 37 is a schematic view illustrating a framework, a side board, and a back board according to an embodiment of the application in an unfolded state.
Figure 38:
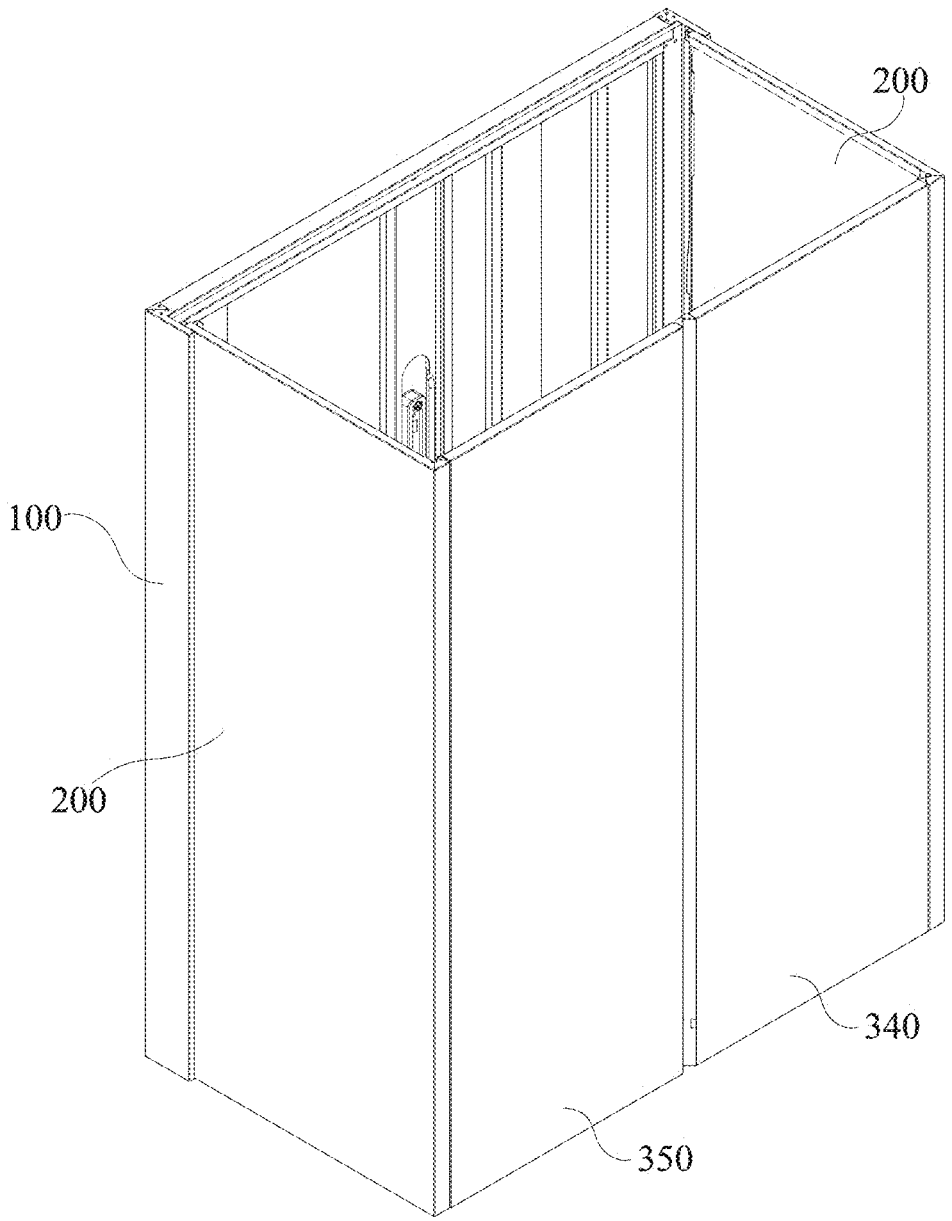
FIG. 38 is a schematic view illustrating a rear side of the structure of FIG. 37.
Figure 39:
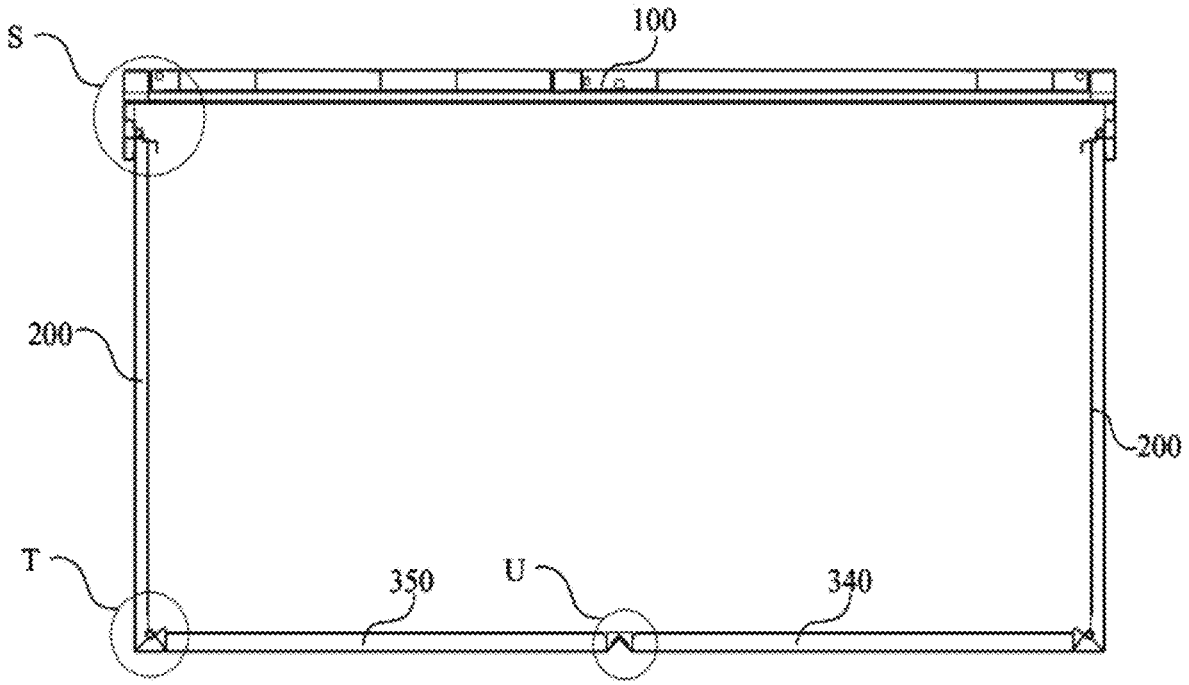
FIG. 39 is a top view of the structure illustrated in FIG. 37.
Figure 40:
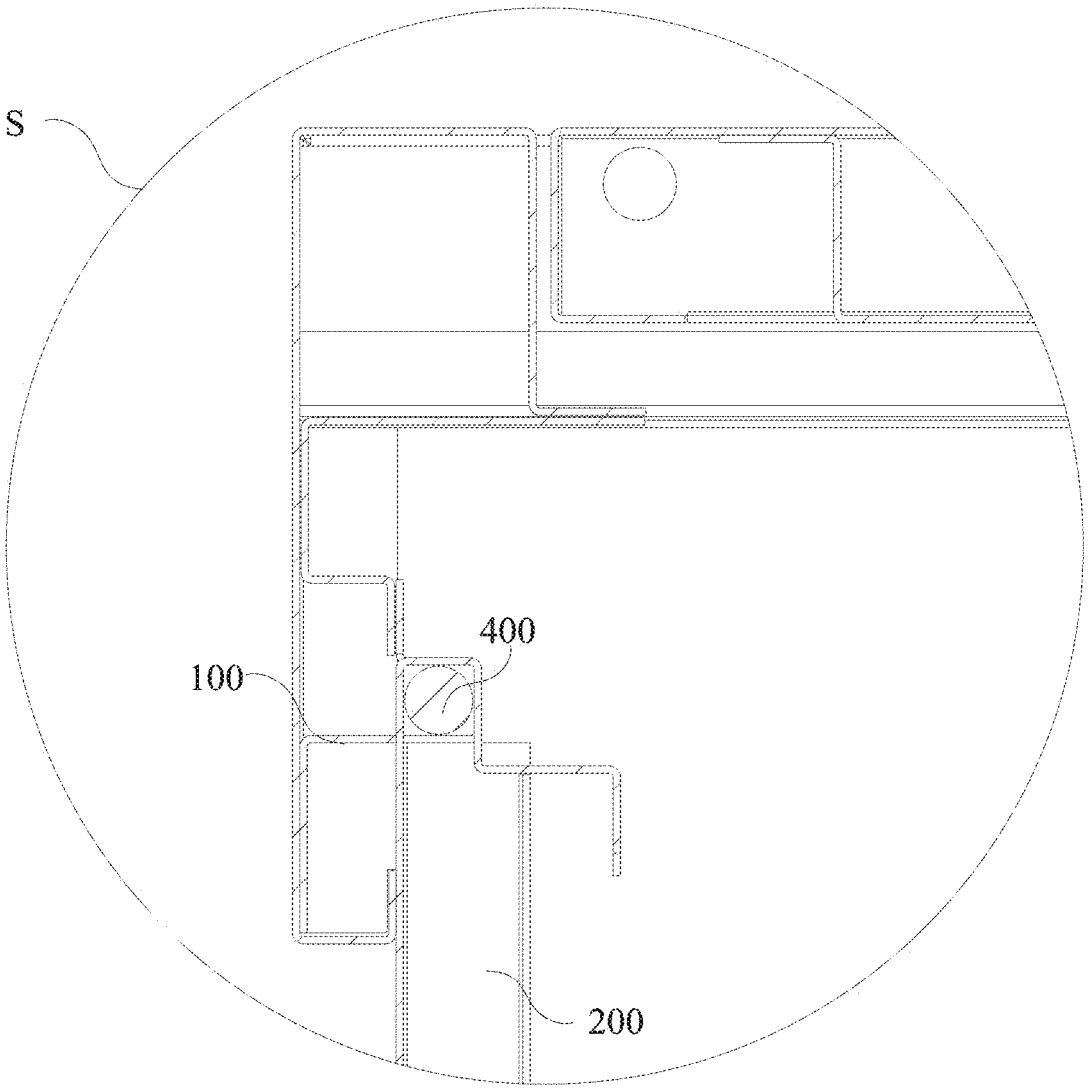
FIG. 40 is an enlarged schematic view of portion S of FIG. 39.
Figure 41:
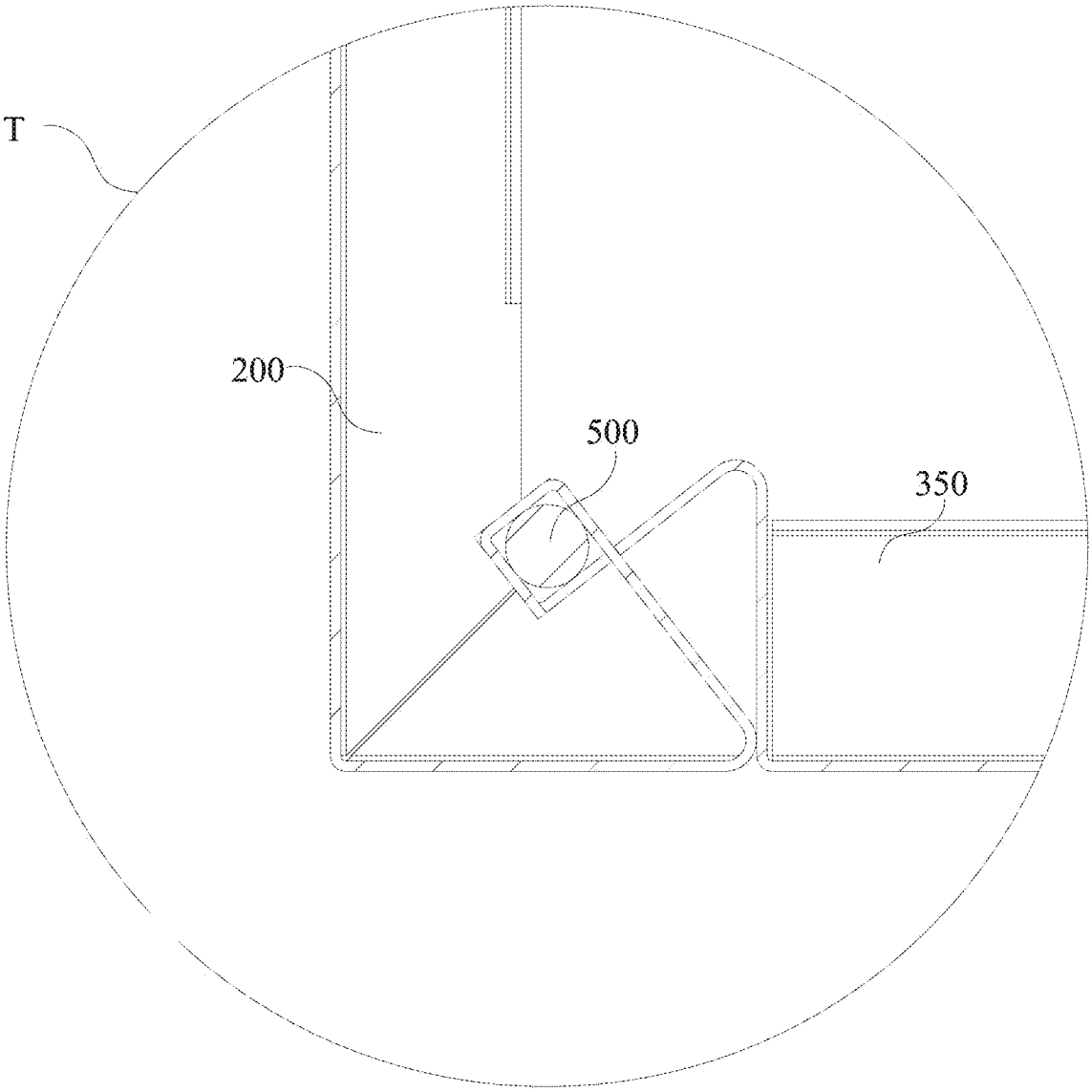
FIG. 41 is an enlarged schematic view of portion T of FIG. 39.
Figure 42:
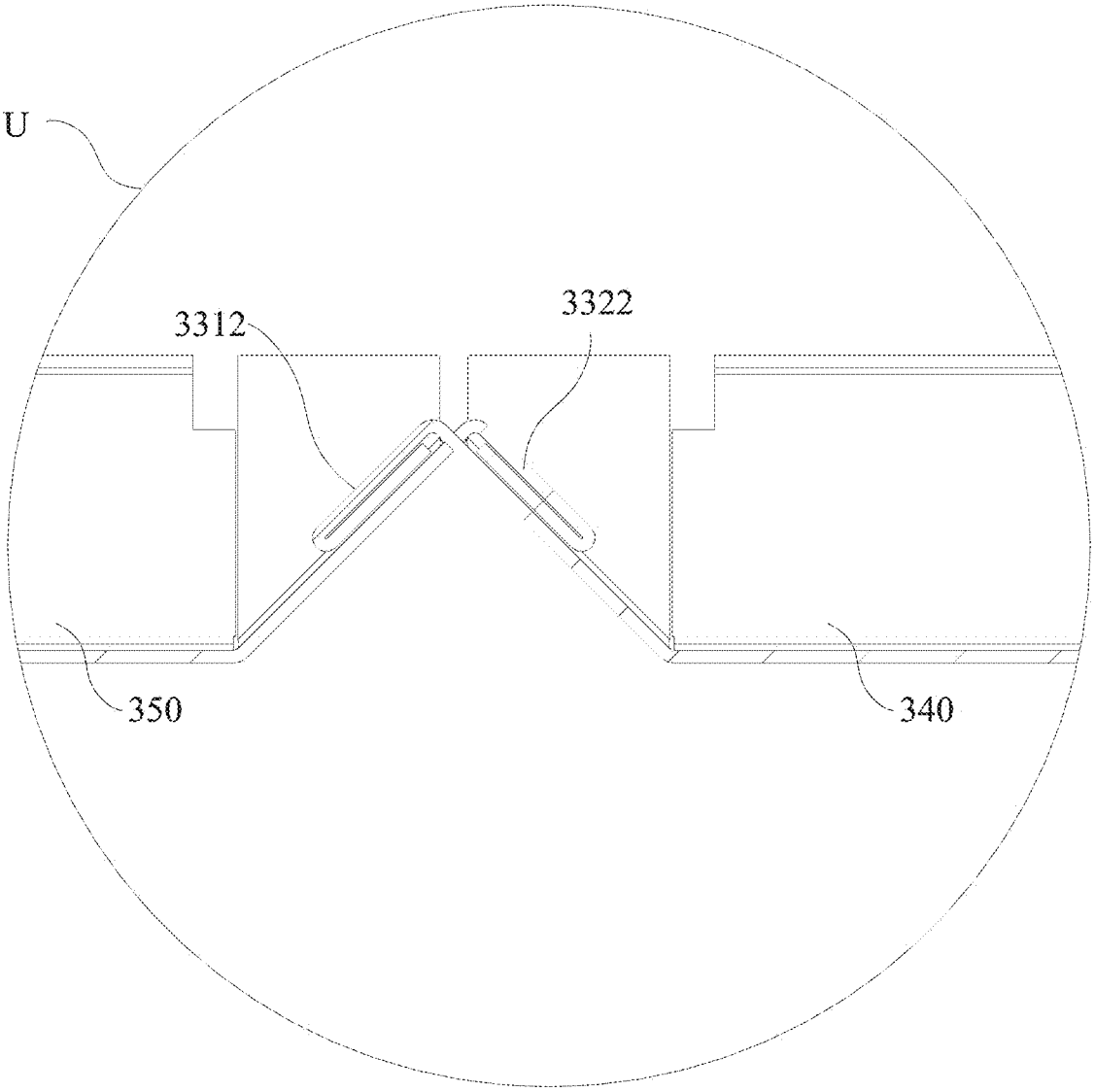
FIG. 42 is an enlarged schematic view of portion U of FIG. 39.

In order to facilitate the control of connection and disconnection between the first back board 340 and the second back board 350, and the stable connection between the tabs 3321 and the slots 3311 in the unfolded state, please referring to FIGS. 16 and 36, the slots 3311 are formed at an angle inclined to the plane in which the board body of the first back board 340 lies, and the plane in which the tabs 3321 lie is inclined to the plane in which the board body of the second back board 350 lies. When the planes in which the first back board 340 and the second back board 350 lie are perpendicular to each other, the tabs 3321 can get in or out of the slots 3311. The slots 3311 directly opposite the tabs 3321, to allow the tabs 3321 to get in or out of the slots 3311.

The slot 3311 are formed on the first matching portion 331 to allow the tabs 3321 to rotate a certain angle in the slots 3311, and the angle may be 90° in the embodiment. After the tabs 3321 are inserted in the slots 3311, the first back board 340 and the second back board 350 can continue to rotate relative to respective hingedly connected side board 200, until the back board bodies 310 of the first back board 340 and the second back board 350 lie in the same plane. During such process, the connection of the tab 3321 and the slot 3311 would not affect the relative movement of the first back board 340 and the second back board 350. In addition, the angle at which the tab 3321 inserted in the slot 3311 gradually changes during such process, the friction force at the joint of the slot 3311 and the tab 3321 increases and provides a certain locking function to reduce the risk of the tab 3321 falling off from the slot 3311.

The tab 3321 may be provided with a fourth limiting portion 3322, which fourth limiting portion 3322 may be formed by bending a portion of the tab 3321. When the foldable cabinet is in the unfolded state, the back board bodies 310 of the first back board 340 and the second back board 350 lie in the same plane, the fourth limiting portion 3322 fits the first matching portion 331 to maintain the connection state of the tab 3321 and the slot 3311, and meanwhile limits the rotation angle of the tab 3321 in the slot 3311.

When the foldable cabinet is in the unfolded state, the back board bodies 310 of the first back board 340 and the second back board 350 lie in the same plane, the second limiting portion 232 fits the first matching portion to maintain the connection state of the tab 3321 and the slot 3311, and meanwhile limits the rotation angle of the tab 3321 in the slot 3311.

The fourth limiting portion 3322 is formed as a board by bending, and the fourth limiting portion 3322 is bent relative to the tab 3321 about 90°. With such arrangement, when the planes in which the back board bodies 310 of the first back board 340 and the second back board 350 lie are perpendicular to each other, the fourth limiting portion 3322 can be inserted through the slot 3311.

When it changes from the folded state to the unfolded state, after the fourth limiting portion 3322 is inserted in the slot 3311, the first back board 340 and the second back board 350 can continue to rotate relative to respective hingedly connected side board 200, until the back board bodies 310 of the first back board 340 and the second back board 350 lie in the same plane. During such process, the fourth limiting portion 3322 gradually catches the first matching portion 331 proximate to the slot 3311, and a portion of the tab 3321 which is not bent gradually moves to the slot 3311. Finally, in the unfolded state, the portion of the tab 3321 which is not bent can be inserted in the slot 3311, and the fourth limiting portion 3322 totally hooks the first matching portion 331 proximate to the slot 3311. Due to the fourth limiting portion 3322, the tab 3321 can be prevented from falling off from the slot 3311, and thus the stability of the connection between the first back board 340 and the second back board 350 can be improved.

On the contrary, when it changes from the unfolded state to the folded state, the back board bodies 310 of the first back board 340 and the second back board 350 which lie in the same plane may be rotated until they form an angle of about 90°. During such process, a portion of the tab 3321 which is not bent gradually moves away from the slot 3311, and the fourth limiting portion 3322 moves to the slot 3311. Then, the fourth limiting portion may fall off from the slot 3311, to release the connection between the first back board 340 and the second back board 350.

The first matching portion 331 may be provided with a fifth limiting portion 3312, which fifth limiting portion 3312 may be formed by bending at least a portion of the first matching portion 331.

When the foldable cabinet is in the unfolded state, the back board bodies 310 of the first back board 340 and the second back board 350 lie in the same plane, and the fifth limiting portion 3312 fits the second matching portion 332, to limit the rotation angle of the tab 3321 in the slot 3311.

Please referring to FIG. 16, the fifth limiting portion 3312 has a board shape and is formed by bending the first matching portion 331. The fifth limiting portion is bent about 90°.

The fifth limiting portion 3312 is arranged similar to the fourth limiting portion 3322. In particular, when it changes from the folded state to the unfolded state, after the fourth limiting portion 3322 is inserted in the slot 3311, the first back board 340 and the second back board 350 can continue to rotate relative to respective hingedly connected side board 200, until the back board bodies 310 of the first back board 340 and the second back board 350 lie in the same plane. During such process, the fourth limiting portion 3322 gradually catches the first matching portion 331 proximate to the slot 3311, and the fifth limiting portion 3312 gradually fits onto the second matching portion 332. The fifth limiting portion 3312 and the fourth limiting portion 3322 mutually limit the rotation angle of the first back board 340 and the second back board 350. The critical state is the state in which the back board bodies 310 of the first back board 340 and the second back board 350 lie in the same plane. Such arrangement facilitates the unfolding of the foldable cabinet, and reduces the difficulty in assembling the foldable cabinet.

when the planes in which the back board bodies 310 of the first back board 340 and the second back board 350 lie form an angle about 90°, the fifth limiting portion 3312 would not affect the insertion or release of the tab 3321 to or from the slot 3311. During relative rotation of the first back board 340 and the second back board 350, the fifth limiting portion 3312 and the second matching portion 332 would not interfere with each other, and would not affect the relative rotation of the first back board 340 and the second back board 350.

Figure 43:
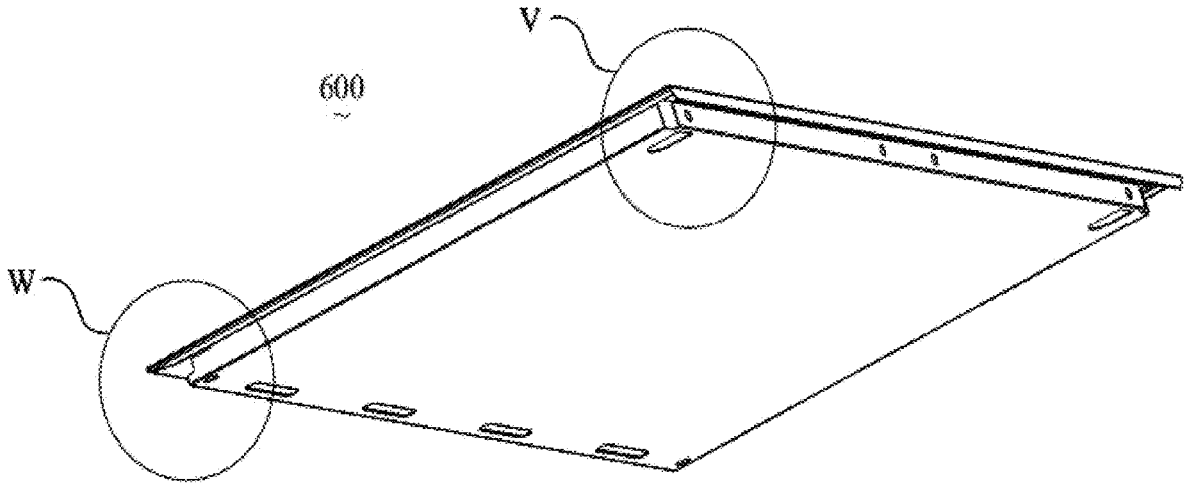
FIG. 43 is a schematic structural view illustrating a top board according to an embodiment of the application.
Figure 44:
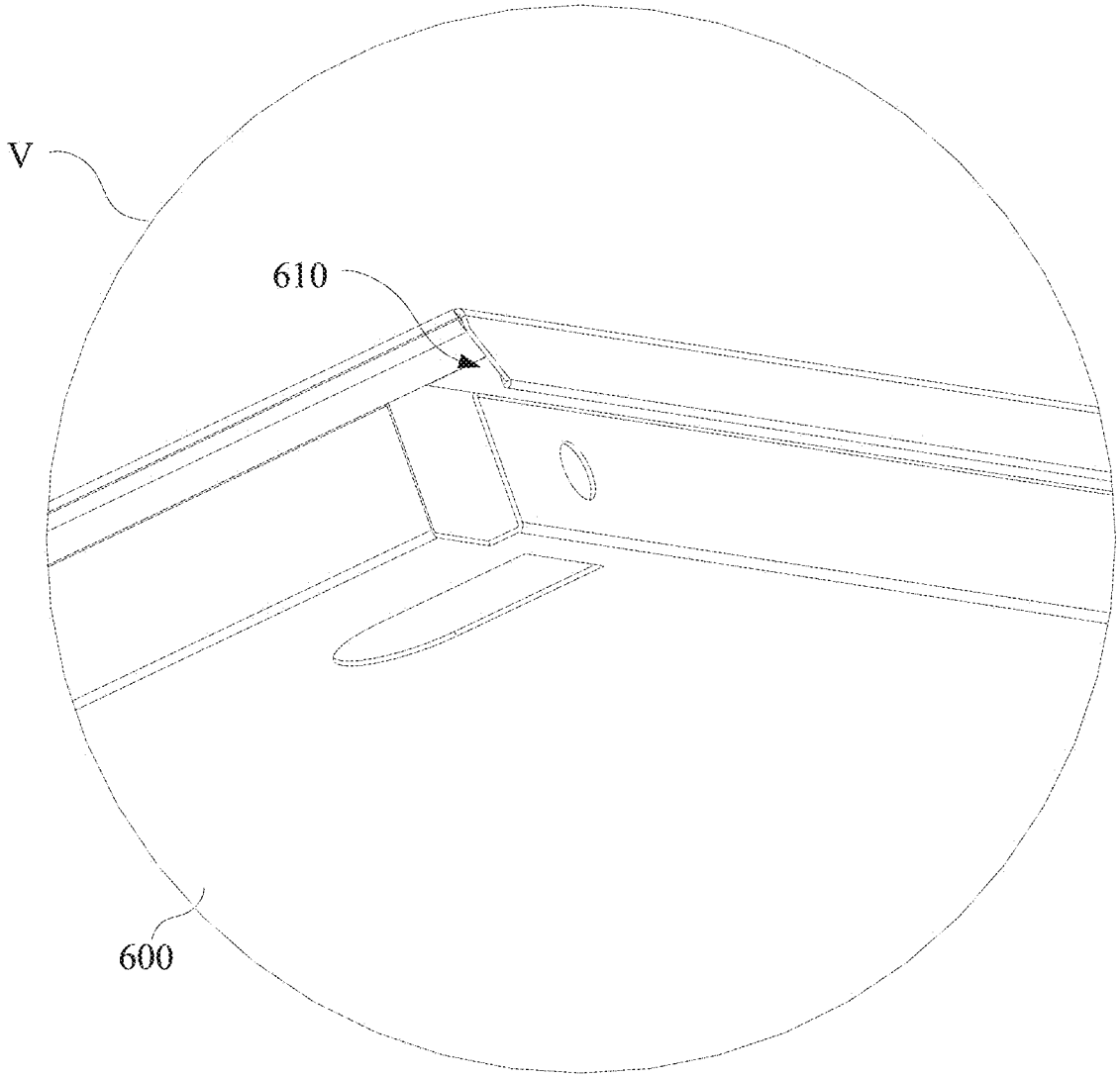
FIG. 44 is an enlarged schematic view of portion V of FIG. 43.
Figure 45:
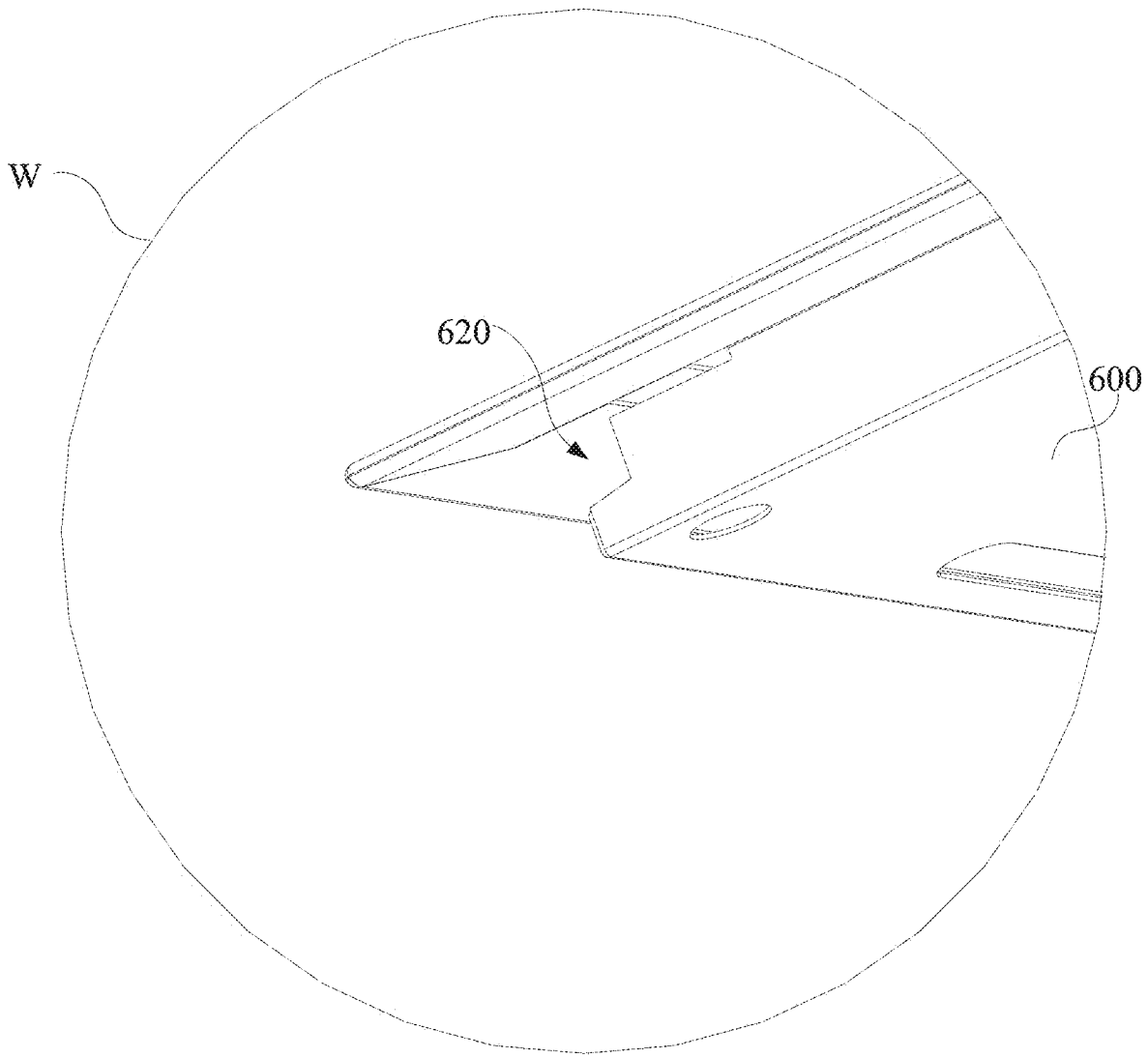
FIG. 45 is an enlarged schematic view of portion W of FIG. 43.

Please referring to FIGS. 43-45, the foldable cabinet in the embodiment may further comprise the top board 600, which is removably mounted on top of the framework 100, the side boards 200, and the back boards 300. The edge of the top board 600 may be provided with a first rabbet 610 and a second rabbet 620 which extend along the left-right direction of the foldable cabinet. The first rabbet 610 and the second rabbet 620 are respectively located at the rear end and the front end of the top board 600, the top end of the framework 100 may be inserted in the second rabbet 620, and the top portion of the back board 300 may be inserted in the first rabbet 610.

Please referring to FIGS. 43-45, the top board 600 may be provided with a cabinet insert for insertion into the foldable cabinet. The cabinet insert may be provided with the first rabbet 610 opening downwardly and the second rabbet 620 opening forwardly. The top portions of the first back board 340 and the second back board 350 may be inserted in the first rabbet 610, to connected the top board 600 and meanwhile to allow the first back board 340 and the second back board 350 to lie in the same plane. In such a case, the foldable cabinet in the unfolded state can be more secure. During assembly, firstly the top portion of the framework 100 may be inserted into the second rabbet 620, with the cabinet insert of the top board 600 being inserted into the foldable cabinet. Then, the first back board 340 and the second back board 350 may be inserted into the first rabbet 610 such that the top board 600 can be tightly secured by the framework 100 and the back board 300, thereby finishing the assembling. When it needs to remove the top board 600, firstly the connection of the first rabbet 610 with the first back board 340 and with the second back board 350 can be released. Then, the connection between the second rabbet 620 and the framework 100 can be released. After that, the top board 600 can be removed from the foldable cabinet.

In the embodiment, the foldable cabinet may be further provided with a first fastener, the first fastener may be disposed on the top board 600, to maintain the connection state of the top board 600 and the back board 300.

In the embodiment, the foldable cabinet may be further provided with: a bottom board 700 removeably mounted at the bottom of the framework 100, the side boards 200, and the back boards 300. The first turning portion 230 and the second turning portion 320 may be provided with a notch, at least a portion of the edge of the bottom board 700 is inserted in the notch, and at least a further portion of the edge of the bottom board 700 is lapped on the framework 100.

Figure 46:
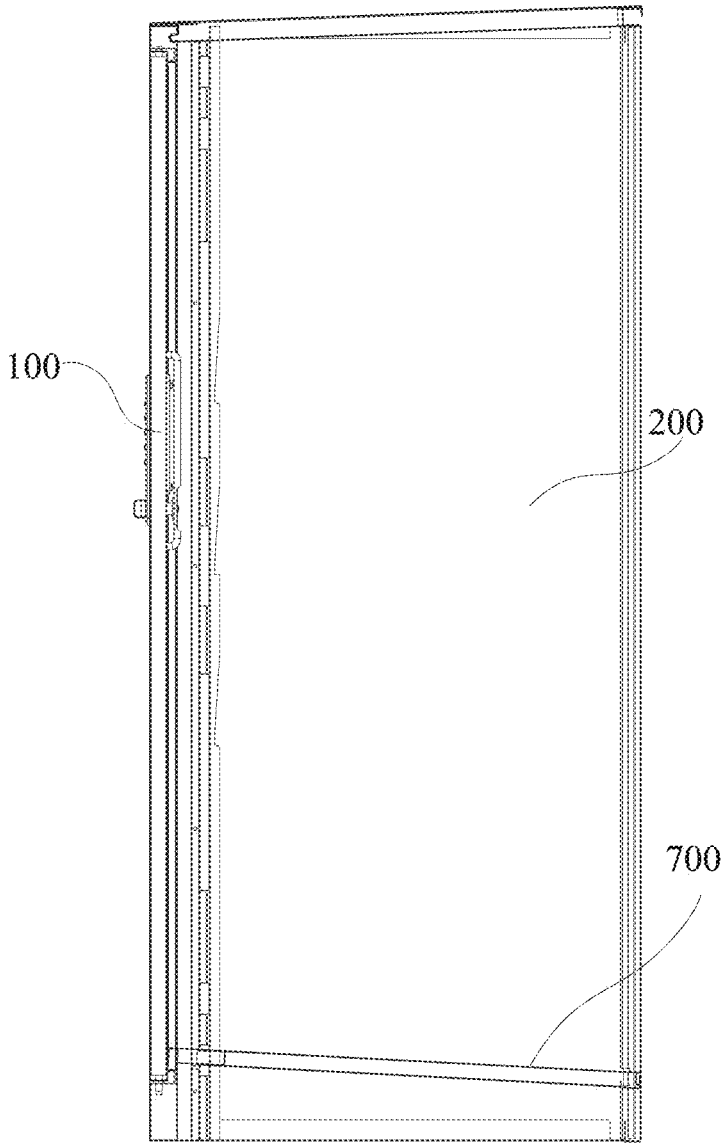
FIG. 46 is a schematic view illustrating an inner structure of a foldable cabinet according to an embodiment of the application.
Figure 47:
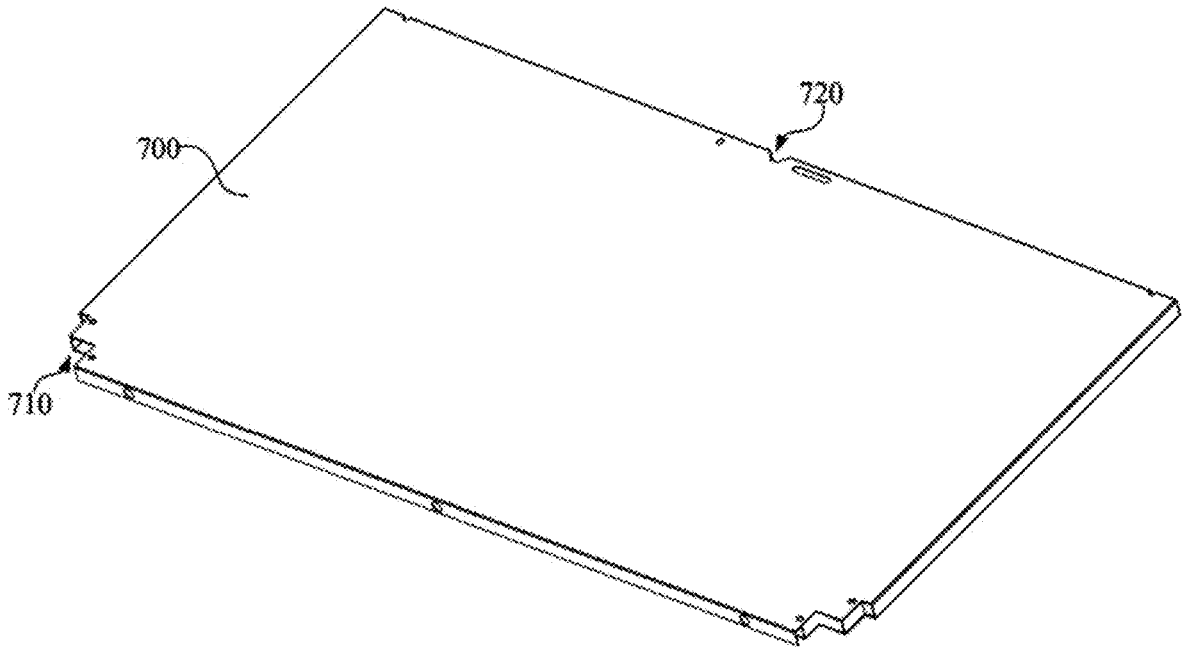
FIG. 47 is a schematic structural view illustrating a bottom board according to an embodiment of the application.

Please referring to FIGS. 46 and 47, the board edge of the bottom board 700 is stuck in the notch. Please referring to FIGS. 10, 15, and 23, the first turning portion 230 and the second turning portions 320 of the first back board 340 and the second back board 350 are each provided with a notch, wherein the notch of the first turning portion 230 is referred to as the first notch 236, and the notch of the second turning portion 320 is referred to as the second notch 333. As the first turning portion 230 protrudes towards the inner side of the foldable cabinet, the protruding portion may be provided with the notch. The second turning portion 320 is designed similarly.

In addition, the bottom board 700 may be further provided with a first gap 710 and a second gap 720. The first gap 710 serves to make room for the bending structure at the hinge joint between the framework 100 and the side board 200, and the second gap 720 serves to make room for the fourth connecting portion 330 at the joint between the first back board 340 and the second back board 350.

In the embodiment, the foldable cabinet may be further provided with a second fastener, the second fastener may be disposed on the bottom board 700, to maintain the connection state of the bottom board 700 and the back board 300.

In the embodiment, the foldable cabinet may be further provided with a third fastener for stably connecting the bottom board 700 and the framework 100.

Embodiment 2

Figure 54:
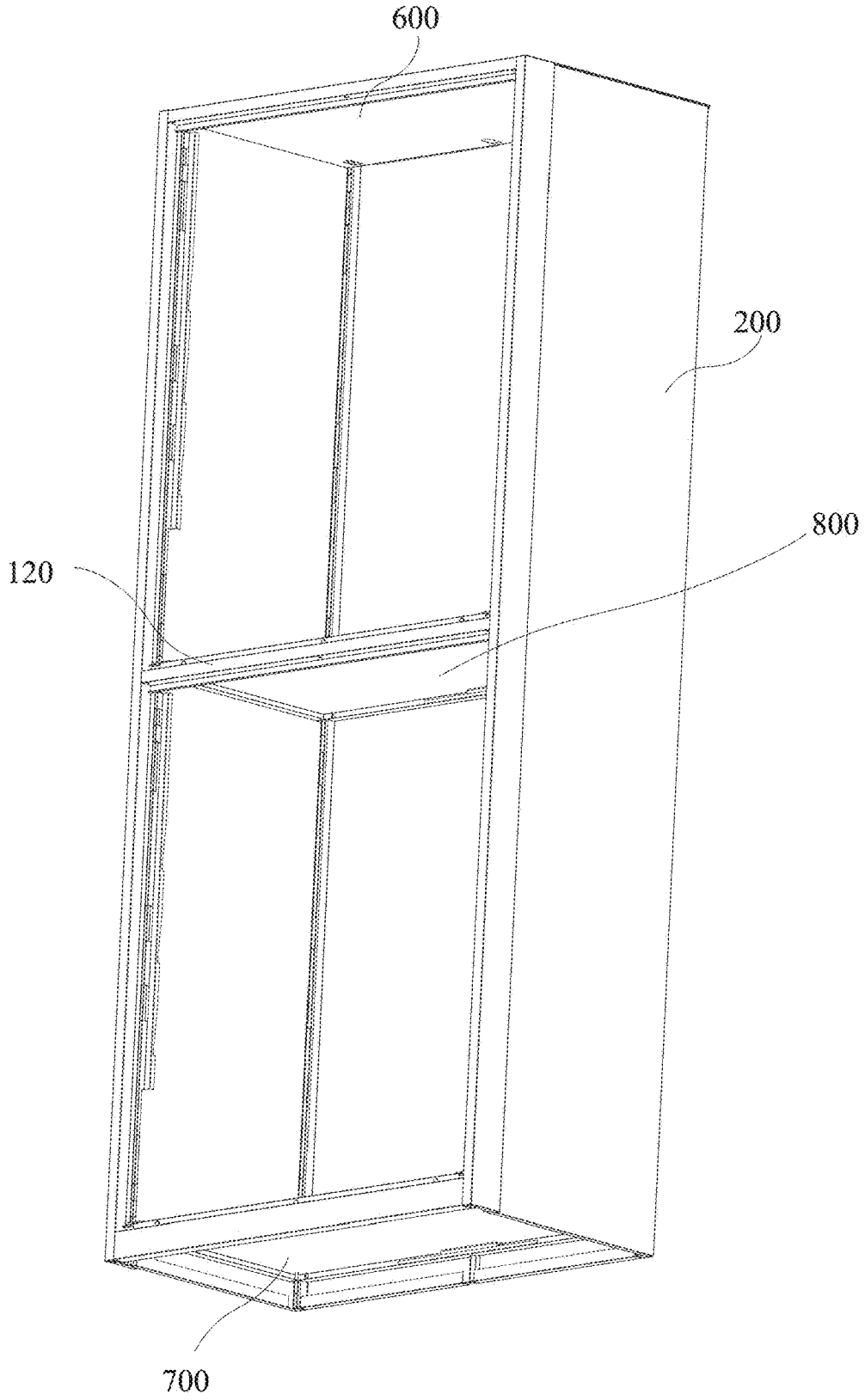
FIG. 54 is a schematic view illustrating an inner structure according to a second embodiment.

Embodiment 2 is different from Embodiment 1 in that, the foldable cabinet may be further provided with a separator board 800 and a dividing strip 120, please referring to FIG. 54.

The separator board 800 may be removeably mounted between the top portions and the bottom portions of the framework 100, the side boards 200, and the back boards 300.

The dividing strip 120 may be provided on the framework 100, between the top portion and the bottom portion of the framework 100, and at least a portion of the edge of the separator board 800 is lapped on the dividing strip 120.

The first turning portion 230 and the second turning portion 320 may be respectively provided with an assembly slot, and at least a portion of the edge of the separator board 800 may be inserted in the assembly slot.

In the case that the foldable cabinet is relatively high, the foldable cabinet may be provided with a separator board 800 for dividing the space inside the foldable cabinet.

The dividing strip 120 may be provided on the framework 100, and the dividing strip 120 can facilitate mounting of separate cabinet doors for the space divided by the separator board 800. The dividing strip 120 may further function to support the separator board 800.

The separator board 800 may have a same structure as the bottom board 700. Similarly, the assembly slot may have a same shape and function as the above mentioned notch, though being provided at positions different from the notch. The connection structures of the separator board 800 with the back board 300 and with the side board 200 is same as the connection structures of the bottom board 700 with the back board 300 and with the side board 200.

Similarly, the separator board 800 may be provided with a second fastener for maintaining the connection state of the separator board 800 and the back board 300. The separator board 800 may be provided with a third fastener for maintaining the connection state of the separator board 800 and the dividing strip 120.

All the above are merely preferred embodiments of the present application. It should be noted that, the present application is intended to cover the modifications and equivalent arrangements obtained by those skilled in the art without departing from the technical principle of the present application.

The invention claimed is:

1. A foldable cabinet, comprising:

a framework provided with two side frames which are oppositely disposed and vertically arranged;

panel assemblies provided into two sets, corresponding to the two side frames, respectively; wherein each set of panel assembly comprises a side board and a back board, each side board is provided with a side board body, and first connecting portions and a first turning portion which are disposed on two lateral sides thereof, each back board is provided with a back board body, and a second turning portion and a fourth connecting portion which are disposed on two lateral sides thereof, the first connecting portions are hingedly connected with the side frames through first shafts which are vertically arranged, the first turning portion is hingedly connected with the second turning portion through a vertically arranged second shaft, and the fourth connecting portions of the two back boards are detachably connected;

wherein each first connecting portion extends from a portion of the edge of respective side board body and bends to define a first groove, the first turning portion is provided with a second connecting portion bending to define a third groove, the second turning portion is provided with a third connecting portion bending to define a fourth groove, each side frame is provided with a fifth connecting portion bending to define a second groove, each first shaft is disposed to extend through the first groove of the first connecting portion and the second groove of corresponding fifth connecting portion, each second shaft is disposed to extend through the third groove of the second connecting portion and the fourth groove of corresponding third connecting portion;

when the foldable cabinet is in a folded state, the side boards, the back boards, and the framework are superposed, with the back boards being located between the side boards and the framework;

when the foldable cabinet is in an unfolded state, the side boards are located between the framework and the back boards in such a manner that the side boards are perpendicular to the framework, and the sideboards are perpendicular to the back boards; and throughout the folded state and the unfolded state of the foldable cabinet and a transition state therebetween, an opening of the first groove of each first connecting portion and an opening of the second groove of corresponding fifth connecting portion always face different directions, and an opening of the third groove of each second connecting portion and an opening of the fourth groove of corresponding third connecting portion always face different directions;

wherein each first connecting portion is provided on a portion of an edge of the side board;

the side frame is further provided with a side frame body and a first limiting portion, and the first limiting portion and the fifth connecting portion are located behind the side frame body, a portion of the edge of the first limiting portion extends and bends to define the fifth connecting portion;

the first turning portion is further provided with a second limiting portion, the second connecting portion is connected with the side board body through the second limiting portion, and a portion of an edge of the second limiting portion extends and bends to define the second connecting portion;

the second turning portion is further provided with a third limiting portion, the third connecting portion is connected with the back board body through the third limiting portion, and a portion of an edge of the third limiting portion extends and bends to define the third connecting portion; and when the foldable cabinet is in the unfolded state, a portion of an edge of the side board body abuts against the fifth connecting portion, a portion of an edge of the first limiting portion abuts against the first connecting portion, a portion of an edge of the second limiting portion abuts against the third connecting portion, and a portion of an edge of the third limiting portion abuts against the second connecting portion.

2. The foldable cabinet according to claim 1, wherein the side frame is further provided with an extending portion located behind the side frame body, and the fifth connecting portion is connected with the extending portion via the first limiting portion.

3. The foldable cabinet according to claim 1, wherein the side board body, the first connecting portion, and the first turning portion are integrally formed; and the back board body, the second turning portion, and the fourth connecting portion are integrally formed.

4. The foldable cabinet according to claim 3, wherein the first turning portion is further provided with a first bend, a second bend, and a first transition board, the first transition board has one end connected with the side board body via the first bend, and the other end connected with the second limiting portion via the second bend; the side board bends towards one direction at least twice, to form the side board body, the first bend, the first transition board, the second bend, and the second limiting portion;

the second turning portion is further provided with a third bend, a fourth bend, and a second transition board, the second transition board has one end connected with the back board body via the third bend, and the other end connected with the third limiting portion via the fourth bend; the back board bends at least twice, towards different directions, to form the back board body, the third bend, the second transition board, the fourth bend, and the third limiting portion; and the second connecting portion, the third connecting portion, and the second shaft are concealed inside the foldable cabinet by the first transition board.

5. The foldable cabinet according to claim 4, wherein the second bend is an acute angle, to allow an outer surface of the first transition board to be aligned with an outer surface of the back board body.

6. The foldable cabinet according to claim 2, wherein the fifth connecting portion is located between front and rear ends of the extending portion, and the end of the extending portion proximal to the rear side is located at the outer side of the side board body, to limit a maximum rotation angle of the side board on the framework.

7. The foldable cabinet according to claim 5, wherein when the foldable cabinet is in the unfolded state, the second bend abuts against the third bend, or, the second bend abuts against the second transition board, to limit a maximum rotation angle of the back board on the side board.

8. The foldable cabinet according to claim 1, wherein when the foldable cabinet is in the unfolded state, an opening of the first groove of the first connecting portion faces backwards, the opening of the first groove of the first connecting portion is located at the side of the side board body which faces an inner side of the foldable cabinet, the opening of the second groove of the fifth connecting portion faces an outer side of the foldable cabinet, and the opening of the second groove of the fifth connecting portion is located in front of the first limiting portion.

9. The foldable cabinet according to claim 1, wherein when the foldable cabinet is in the folded state, an opening of the first groove of the first connecting portion faces right towards an inner side of the foldable cabinet, the opening of the first groove of the first connecting portion is located in front of the side board body, an opening of the second groove of the fifth connecting portion and the opening of the first groove of the first connecting portion face different directions, and the opening of the second groove of the fifth connecting portion is located in front of the first limiting portion.

10. The foldable cabinet according to claim 1, wherein when the foldable cabinet is in the unfolded state, an opening of the third groove of the second connecting portion faces a direction intersecting with a front-rear direction, the opening of the third groove of the second connecting portion is inclined towards the back board, the opening of the third groove of the second connecting portion is located at the side of the second limiting portion facing away from the back board, an opening of the fourth groove of the third connecting portion faces a direction intersecting with the front-rear direction, the opening of the fourth groove of the third connecting portion is inclined towards an inner side of the foldable cabinet, and the opening of the fourth groove of the third connecting portion is located in front of the third limiting portion.

11. The foldable cabinet according to claim 1, wherein when the foldable cabinet is in the folded state, an opening of the third groove of the second connecting portion faces a direction intersecting with a left-right direction, the opening of the third groove of the second connecting portion is inclined towards the back board, the opening of the third groove of the second connecting portion is located behind the third limiting portion, the opening of the fourth groove of the third connecting portion faces a direction intersecting with the left-right direction, an opening of the fourth groove of the third connecting portion is inclined towards the side board, and the opening of the fourth groove of the third connecting portion is located behind the third limiting portion.

12. The foldable cabinet according to claim 1, wherein the two back boards are respectively referred to as the first back board and the second back board, the fourth connecting portion of the first back board is referred to as the first matching portion, the fourth connecting portion of the second back board is referred to as the second matching portion, and the first matching portion and the second matching portion are connected in a rotatable manner within a certain angle.

13. The foldable cabinet according to claim 12, wherein the first matching portion is provided with a slot;

the second matching portion is provided with a tab, the tab corresponds to the slot in such a manner that the tab can be inserted in the slot and rotate a certain angle in the slot, to form a detachable connection between the first matching portion and the second matching portion; and the tab is allowed to get in or out of the slot when planes in which the back board bodies of the first back board and the second back board lie are perpendicular to each other.

14. The foldable cabinet according to claim 13, wherein the tab is provided with a fourth limiting portion, and the fourth limiting portion is formed by bending a portion of the tab; and when the foldable cabinet is in the unfolded state, the back board bodies of the first back board and the second back board lie in a same plane, the fourth limiting portion fits the first matching portion to maintain a connection state of the tab and the slot, and meanwhile limits rotation angle of the tab in the slot.

15. The foldable cabinet according to claim 13, wherein the first matching portion is further provided with a fifth limiting portion, and the fifth limiting portion is formed by bending at least a portion of the first matching portion; and when the foldable cabinet is in the unfolded state, the back board bodies of the first back board and the second back board lie in a same plane, and the fifth limiting portion fits the second matching portion, to limit a rotation angle of the tab in the slot.

16. The foldable cabinet according to claim 1, further comprising:

a top board removably mounted on top of the framework, the side boards, and the back boards, wherein an edge of the top board is provided with a first rabbet and a second rabbet which extend along a left-right direction, the first rabbet and the second rabbet are respectively located at a rear end and a front end of the top board, a top end of the framework is inserted in the second rabbet, and a top portion of the back board is inserted in the first rabbet.

17. The foldable cabinet according to claim 1, further comprising:

a bottom board removeably mounted at bottom of the framework, the side boards, and the back boards, and wherein the first turning portion and the second turning portion are respectively provided with a notch, at least a portion of an edge of the bottom board is inserted in the notch, and at least a portion of the edge of the bottom board is lapped on the framework.

18. The foldable cabinet according to claim 1, further comprising:

a separator board removeably mounted between respective top portions and bottom portions of the framework, the side boards, and the back boards;

a dividing strip provided on the framework, between the top portion and the bottom portion of the framework, and at least a portion of an edge of the separator board is lapped on the dividing strip; and the first turning portion and the second turning portion are respectively provided with an assembly slot, and at least a portion of an edge of the separator board is inserted in the assembly slot.

* * * * *